US011357339B2

(12) United States Patent
Fosse et al.

(10) Patent No.: US 11,357,339 B2
(45) Date of Patent: Jun. 14, 2022

(54) CHILD CARRYING SYSTEM WITH ADAPTABLE HEAD SUPPORT

(71) Applicant: Lalabu LLC, Statham, GA (US)

(72) Inventors: Brian Fosse, Bend, OR (US); Mirona Motoc, Seattle, WA (US)

(73) Assignee: Lalabu LLC, Statham, GA (US)

( * ) Notice: Subject to any disclaimer, the term of this patent is extended or adjusted under 35 U.S.C. 154(b) by 0 days.

(21) Appl. No.: 17/501,949

(22) Filed: Oct. 14, 2021

(65) Prior Publication Data

US 2022/0117408 A1 Apr. 21, 2022

Related U.S. Application Data

(60) Provisional application No. 63/092,836, filed on Oct. 16, 2020.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/158–160
See application file for complete search history.

(56) References Cited

U.S. PATENT DOCUMENTS 4,149,687 A 4/1979 Nunemacher
4,428,514 A * 1/1984 Elf ..... A47D 13/025 224/155
4,449,253 A 5/1984 Hettinger
4,467,945 A 8/1984 Schaapveld
4,602,390 A 7/1986 Morera et al.
5,205,450 A 4/1993 Derosier
5,246,152 A * 9/1993 Dotseth ..... A47D 13/025 224/158
5,547,461 A 8/1996 Levis
5,732,861 A 3/1998 Jakobson
(Continued)

FOREIGN PATENT DOCUMENTS

CN 101426456 A 5/2009
JP 3787778 B2 6/2006
WO 2017200451 A1 11/2017

OTHER PUBLICATIONS

Final Office Action, dated Jan. 8, 2019, from corresponding U.S. Appl. No. 15/861,546.

(Continued)

*Primary Examiner* — Adam J Waggenspack
(74) *Attorney, Agent, or Firm* — Brient IP Law, LLC

(57) ABSTRACT

A child carrying system comprising: (1) a carrier portion configured to support a child within; (2) a pair of fabric shoulder straps respectively coupled at a first end to the carrier portion proximate a top corner of the carrier portion and uncoupled at a second end opposite the first end; (3) a respective adjustment mechanism coupled to each respective side of the carrier portion, each adjustment mechanism configured to adjustably engage one of the pair of shoulder straps proximate its second end; (4) a waist belt coupled to a bottom end of the carrier portion, the waist belt having two opposing ends configured to wrap around the user and secure to one another; and (5) a head support moveably engaged with the pair of fabric shoulder straps and configured to be moveable along the pair of fabric shoulder straps between a lowered configuration and a raised configuration.

20 Claims, 61 Drawing Sheets

(56) References Cited

U.S. PATENT DOCUMENTS

| | | | | |
|---|---|---|---|---|
| 5,766,114 | A | 6/1998 | Campbell | |
| 5,799,851 | A | 9/1998 | Wulf et al. | |
| 5,813,580 | A | 9/1998 | Fair | |
| 5,848,741 | A | 12/1998 | Fair | |
| 6,179,187 | B1 | 1/2001 | Lemire et al. | |
| 6,240,564 | B1 | 6/2001 | Te Kanawa | |
| 6,409,060 | B2 | 6/2002 | Donine | |
| 6,460,746 | B1 | 10/2002 | Amram | |
| 6,598,771 | B2 | 7/2003 | Norman | |
| 6,666,361 | B1 | 12/2003 | Lin | |
| 6,776,317 | B1 | 8/2004 | Parker | |
| 6,836,902 | B2 | 1/2005 | Marquez et al. | |
| 7,204,002 | B2 | 4/2007 | Kaneko et al. | |
| 7,322,498 | B2 | 1/2008 | Frost | |
| 7,356,850 | B2 | 4/2008 | Turcotte et al. | |
| 7,484,645 | B2 | 2/2009 | Hoff et al. | |
| 7,574,750 | B2 | 8/2009 | Harris | |
| D615,749 | S | 5/2010 | Wagner | |
| 7,780,587 | B2 | 8/2010 | Thornton et al. | |
| 7,819,831 | B2 | 10/2010 | Dellanno | |
| 7,886,946 | B2 | 2/2011 | Gray | |
| 7,971,273 | B2 | 7/2011 | Grilliot et al. | |
| 8,028,871 | B2 | 10/2011 | Gray | |
| 8,267,290 | B2 | 9/2012 | Schlipper | |
| 8,272,507 | B1 | 9/2012 | Crump et al. | |
| 8,363,181 | B2 | 1/2013 | Nasu et al. | |
| 8,490,844 | B2 | 7/2013 | Favorito et al. | |
| 8,567,652 | B2 | 10/2013 | Di Stasio et al. | |
| 8,656,516 | B1 | 2/2014 | Reinhardt Rawlings et al. | |
| 8,973,794 | B2 | 3/2015 | Bergkvist et al. | |
| 9,017,226 | B2 | 4/2015 | Nash | |
| 9,038,868 | B2 | 5/2015 | Poiani | |
| 9,119,484 | B2 | 9/2015 | Hyppolite | |
| 9,185,993 | B2 | 11/2015 | Telford et al. | |
| 9,277,830 | B2 | 3/2016 | Schachtner | |
| 9,357,852 | B2 | 6/2016 | Salazar et al. | |
| 9,439,516 | B2 | 9/2016 | Workman | |
| 9,498,007 | B2 | 11/2016 | Rizk | |
| 9,521,912 | B2 | 12/2016 | Yen | |
| 9,545,159 | B2 | 1/2017 | Wang | |
| 9,629,477 | B2 | 4/2017 | Tagle | |
| 9,848,713 | B2 | 12/2017 | Rosen et al. | |
| 9,949,575 | B2 | 4/2018 | Pond et al. | |
| 9,955,797 | B2 | 5/2018 | Telford et al. | |
| 10,045,634 | B2 * | 8/2018 | Salazar | A47D 13/025 |
| 10,172,437 | B2 | 1/2019 | Barber | |
| 10,441,091 | B2 | 10/2019 | Salazar et al. | |
| 10,694,867 | B2 * | 6/2020 | Troutman | A47D 13/025 |
| 2003/0172430 | A1 | 9/2003 | Jarrett | |
| 2003/0173150 | A1 | 9/2003 | Sharp | |
| 2004/0065708 | A1 | 4/2004 | Amram | |
| 2004/0149790 | A1 | 8/2004 | Kassai et al. | |
| 2005/0045674 | A1 | 3/2005 | Rehbein | |
| 2007/0029356 | A1 | 2/2007 | Moriguchi et al. | |
| 2007/0125815 | A1 | 6/2007 | Tong | |
| 2007/0254129 | A1 | 11/2007 | Horblitt | |
| 2008/0185409 | A1 | 8/2008 | Kellenberger | |
| 2009/0206116 | A1 | 8/2009 | Grant | |
| 2009/0302075 | A1 | 12/2009 | Trainer | |
| 2010/0147910 | A1 | 6/2010 | Schachtner | |
| 2010/0155446 | A1 * | 6/2010 | Stein | A47D 13/025 224/576 |
| 2011/0062195 | A1 | 3/2011 | Jones et al. | |
| 2011/0185477 | A1 | 8/2011 | Olenicoff | |
| 2012/0152987 | A1 | 6/2012 | Beltrame et al. | |
| 2013/0240590 | A1 | 9/2013 | Montgomery | |
| 2014/0319189 | A1 * | 10/2014 | Hoppener-Visser | A47D 13/02 224/160 |
| 2014/0361055 | A1 | 12/2014 | Myers | |
| 2015/0101108 | A1 | 4/2015 | Wallace | |
| 2015/0181953 | A1 | 7/2015 | Brown | |
| 2015/0201761 | A1 | 7/2015 | Wollenberg | |
| 2016/0150893 | A1 | 6/2016 | Salazar et al. | |
| 2017/0119173 | A1 | 5/2017 | Telford | |
| 2018/0116426 | A1 | 5/2018 | Telford | |
| 2018/0125124 | A1 | 5/2018 | Jylkka-Tesler | |
| 2018/0184813 | A1 | 7/2018 | Salazar et al. | |
| 2018/0206653 | A1 | 7/2018 | Andrus et al. | |
| 2019/0014920 | A1 | 1/2019 | Matsuyama | |
| 2019/0038044 | A1 | 2/2019 | Cummings | |
| 2019/0075939 | A1 | 3/2019 | Plested et al. | |
| 2019/0216232 | A1 | 7/2019 | Kee et al. | |
| 2019/0246811 | A1 * | 8/2019 | Wiley | A47D 13/025 |
| 2021/0186234 | A1 * | 6/2021 | Dolk | A44B 11/06 |

OTHER PUBLICATIONS

Final Office Action, dated Oct. 30, 2019, from corresponding U.S. Appl. No. 15/861,546.

International Search Report, dated Feb. 7, 2020, from corresponding International Application No. PCT/US2019/054466.

Invitation to Pay Additional Fees, dated Dec. 12, 2019, from corresponding International Application No. PCT/US19/54466.

Notice of Allowance, dated Jan. 21, 2020, from corresponding U.S. Appl. No. 15/861,546.

Notice of Allowance, dated Mar. 13, 2020, from corresponding U.S. Appl. No. 16/591,284.

Office Action, dated Jul. 15, 2019, from corresponding U.S. Appl. No. 15/861,546.

Office Action, dated Jun. 22, 2018, from corresponding U.S. Appl. No. 15/861,546.

Office Action, dated Jun. 27, 2018, from corresponding U.S. Appl. No. 15/861,512.

Office Action, dated Nov. 26, 2019, from corresponding U.S. Appl. No. 16/591,284.

Restriction Requirement, dated Feb. 28, 2018, from corresponding U.S. Appl. No. 15/861,546.

Restriction Requirement, dated Mar. 1, 2018, from corresponding U.S. Appl. No. 15/861,512.

Written Opinion of the International Searching Authority, dated Feb. 7, 2020, from corresponding International Application No. PCT/US2019/054466.

* cited by examiner

CHILD CARRYING SYSTEM WITH ADAPTABLE HEAD SUPPORT

CROSS-REFERENCE TO RELATED APPLICATION

This application claims priority to U.S. Provisional Patent Application Ser. No. 63/092,836, filed Oct. 16, 2020, entitled, "CHILD CARRYING SYSTEM WITH ADAPTABLE HEAD SUPPORT," the disclosure of which is hereby incorporated by reference in its entirety.

BACKGROUND

Wearable child carriers for carrying a baby or child are often designed for carrying the child on either the front or the back of a person, without the versatility of doing both. Carriers often have bulky components like shoulder straps that are padded similar to a hiking backpack in an effort to increase comfort for the user. However, such padding can be bulky and cumbersome, often resulting in a large carrier that is difficult to carry or stow when not in use with a child.

Moreover, providing head support is important for infants and sleeping children, but less important with older children. Most conventional carriers are specifically designed either for infants requiring head support or for older children who do not require head support. If a conventional carrier has a removable head support, the head support is often bulky, which again creates a carrier that is not compact for carrying or stowage when not in use. Various embodiments of the present child carrying system recognize and address the foregoing considerations, and others, of prior art devices.

SUMMARY OF THE INVENTION

A child carrying system according to various embodiments is configured to be worn by a person to enable the person to carry a child. In particular embodiments, the child carrying system comprises: (1) a carrier portion configured to support a child within; (2) a pair of fabric shoulder straps, each fabric shoulder strap being coupled at a first end to the carrier portion proximate to a top corner of the carrier portion and uncoupled at a second (distal) end opposite the first end; (3) an adjustment mechanism coupled to each side of the carrier portion, each adjustment mechanism being configured to receive (and adjustably engage) one of the pair of fabric shoulder straps proximate its second, distal end; (4) a waist belt coupled to a bottom end of the carrier portion, the waist belt having two opposing ends configured to wrap around the person and secure to one another; and (5) a head support moveably engaged with the pair of fabric shoulder straps and configured to be moveable (e.g., with lateral sides that are independently slideably moveable) along the pair of fabric shoulder straps between a lowered configuration and a raised configuration.

A child carrying system, according to further embodiments, is adapted for supporting a child adjacent the body of a user. In particular embodiments, the child carrying system comprises: (1) a waist belt that is adapted to be selectively attached to a waist of the user; (2) a child carrier portion secured adjacent the waist belt; (3) a first adjustment mechanism attached adjacent a first lateral side of the child carrier portion; (4) a second adjustment mechanism attached adjacent a second lateral side of the child carrier portion; (5) a first shoulder strap extending from a top of the child carrier portion adjacent the first lateral side; and (6) a second shoulder strap extending from a top of the child carrier portion adjacent the second lateral side. In particular embodiments: (1) the child carrying system is adapted to support the child on a front side of the user's body when: (a) the first shoulder strap is attached to the second adjustment mechanism; (b) the second shoulder strap is attached to the first adjustment mechanism; and (c) the first and second shoulder straps are crossed over each other adjacent a back of the user; and (2) the child carrying system is adapted to support the child on the back of the user when: (a) the first shoulder strap is attached to the first adjustment mechanism; and (b) the second shoulder strap is attached to the second adjustment mechanism.

A method of carrying a child on a user's body, according to various embodiments, comprises: (1) providing a child carrying system for supporting a child adjacent the body of a user, the child carrying system comprising: (a) a waist belt that is adapted to be selectively attached around a waist of the user; (b) a child carrier portion; (c) a first adjustment mechanism attached adjacent a first lateral side of the child carrier portion; (d) a second adjustment mechanism attached adjacent a second lateral side of the child carrier portion; (e) a first shoulder strap extending from a top of the child carrier portion adjacent the first lateral side; and (f) a second shoulder strap extending from a top of the child carrier portion adjacent the second lateral side. In various embodiments, the child carrying system is adapted to: (1) support the child on a front side of the user's body when the child carrying system is in a first orientation in which: (a) the first shoulder strap is attached to the second adjustment mechanism; (b) the second shoulder strap is attached to the first adjustment mechanism; and (c) the first and second shoulder straps are crossed over each other adjacent the user's back; and (2) support the child on a back of the user when the child carrying system is in a second orientation in which: (a) the first shoulder strap is attached to the first adjustment mechanism; and (b) the second shoulder strap is attached to the second adjustment mechanism. In particular embodiments, the method further comprises supporting the child on the front side of the user when the child carrying system is in the first orientation and/or supporting the child on the back side of the user when the child carrying system is in the second orientation.

A flexible head support for selective attachment to a child carrier, according to various embodiments, comprises: (1) a flexible head support portion; (2) a first fastening system that is adapted to slideably attach to a first lateral side of the flexible head support portion to a first shoulder strap of the child carrier; and (3) a second fastening system that is adapted to slideably attach a second lateral side of the flexible head support portion to a second shoulder strap of the child carrier, wherein the flexible head support is adapted so that, when the first lateral side of the flexible head support portion is slideably attached to a first shoulder strap of the child carrier and the second lateral side of the flexible head support portion is slideably attached to a second shoulder strap of the child carrier: (1) the first lateral side of the head support may selectively slide along the first shoulder strap between a retracted position and an extended position; and (2) the second lateral side of the head support may selectively slide (e.g., independently of the first lateral side) along the second shoulder strap between a retracted and an extended position.

BRIEF DESCRIPTION OF THE DRAWINGS

Various embodiments of the invention are described below. In the course of the description, reference is made to the accompanying drawings, which are not necessarily drawn to scale, and wherein.

DETAILED DESCRIPTION OF VARIOUS EMBODIMENTS

Figure 1:
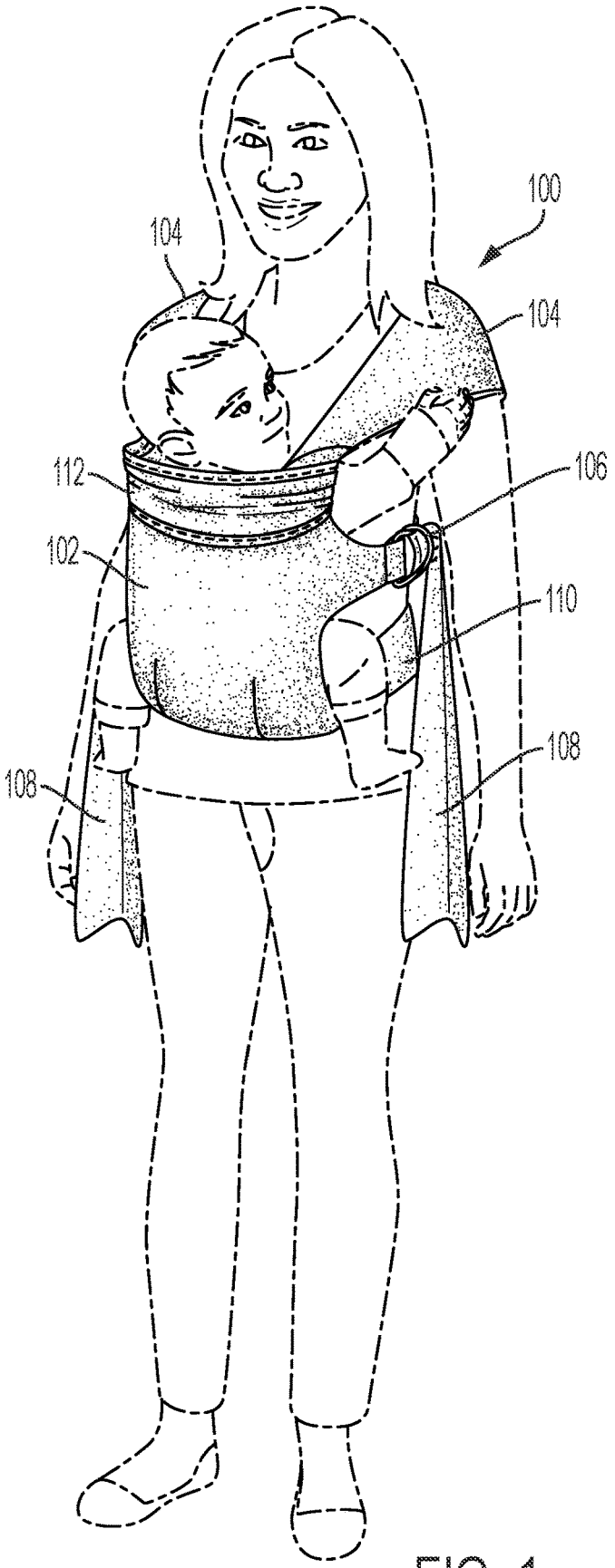
FIG. 1 is a perspective view of a child carrying system where the system is being utilized to carry a child on the front of a person with a head support in a lowered configuration according to various embodiments herein.
Figure 2:
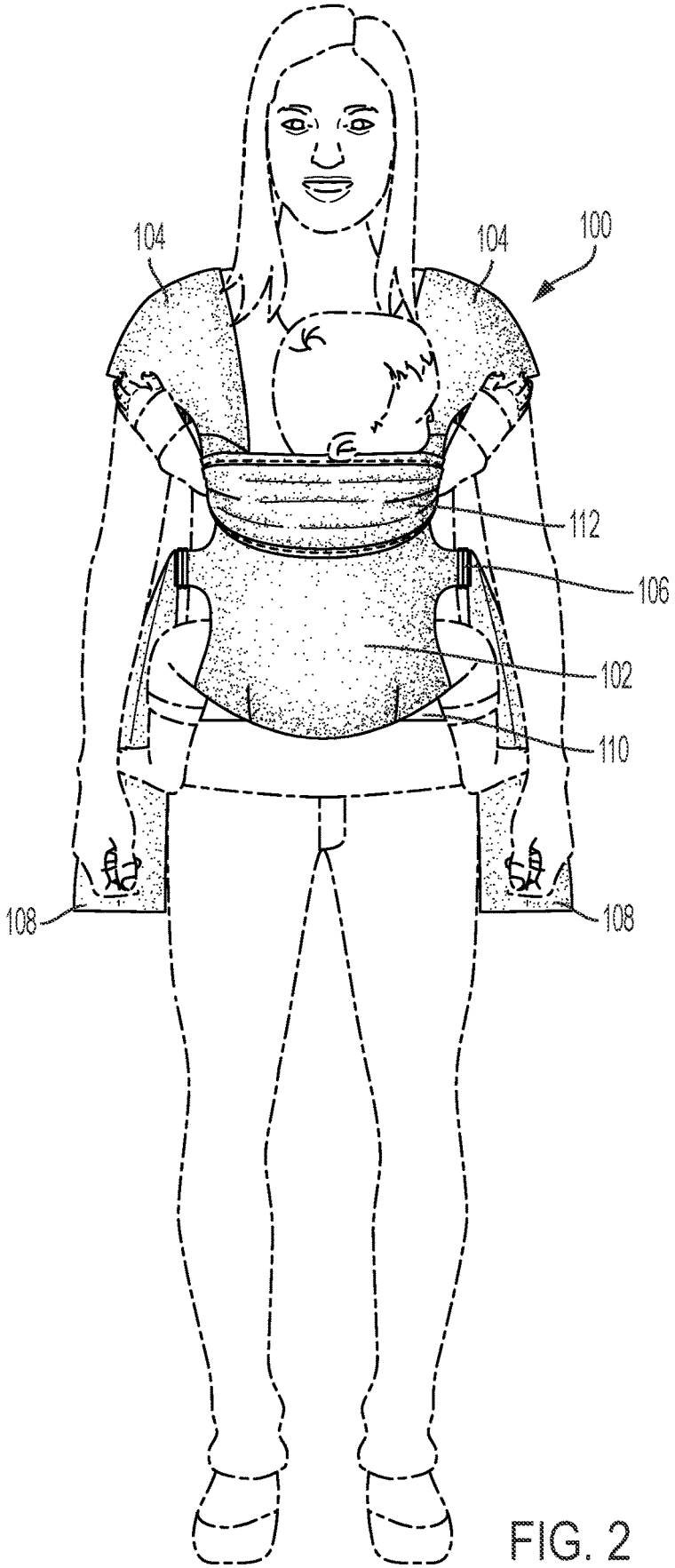
FIGS. 2-7 are, respectively, front, rear, right-side, left-side, top, and bottom views of the child carrying system of FIG. 1, where the system is being utilized to carry a child on the front of a person with the head support in a lowered configuration.
Figure 3:
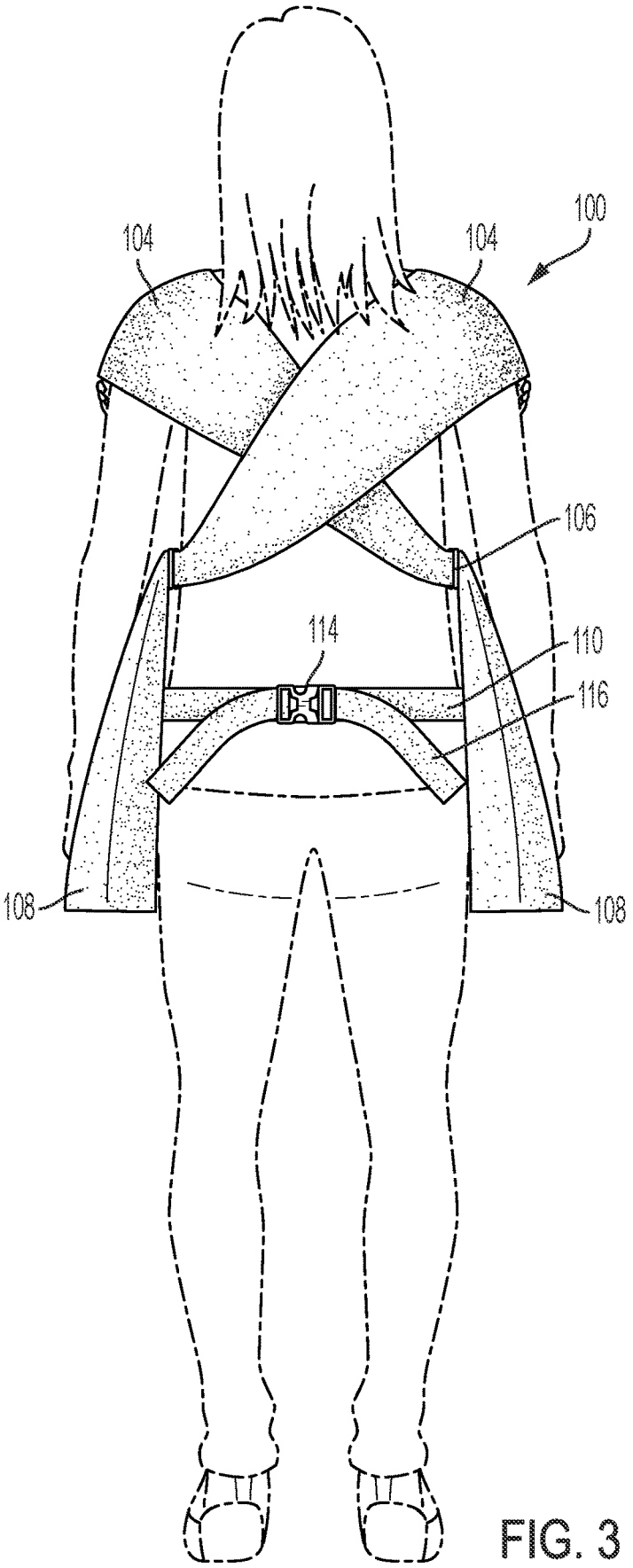
Figure 4:
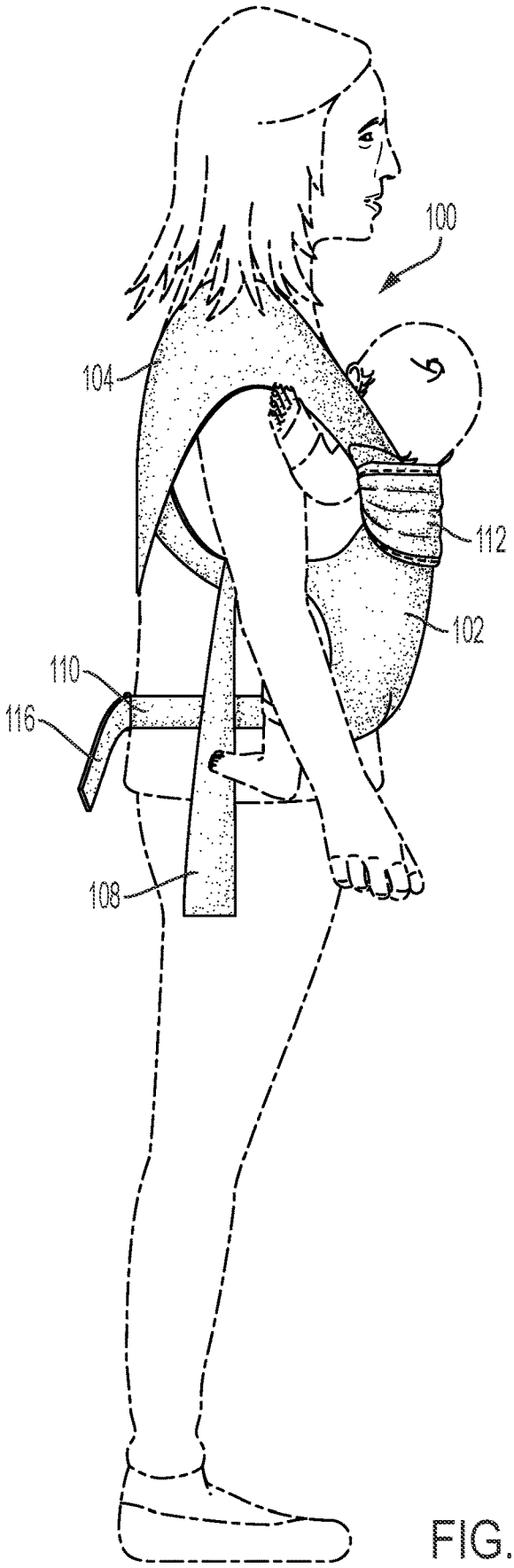
Figure 5:
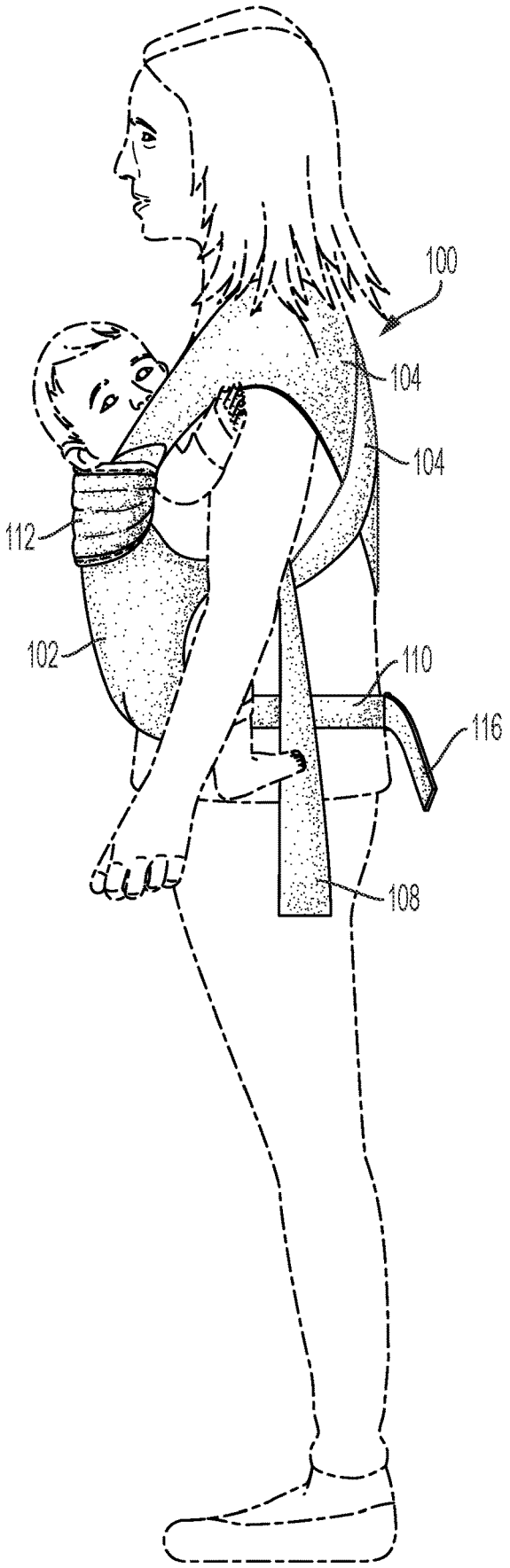
Figure 6:
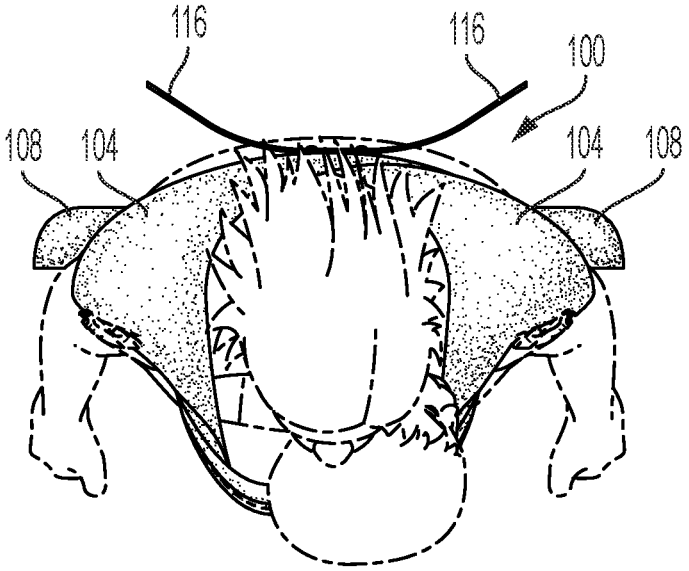
Figure 7:
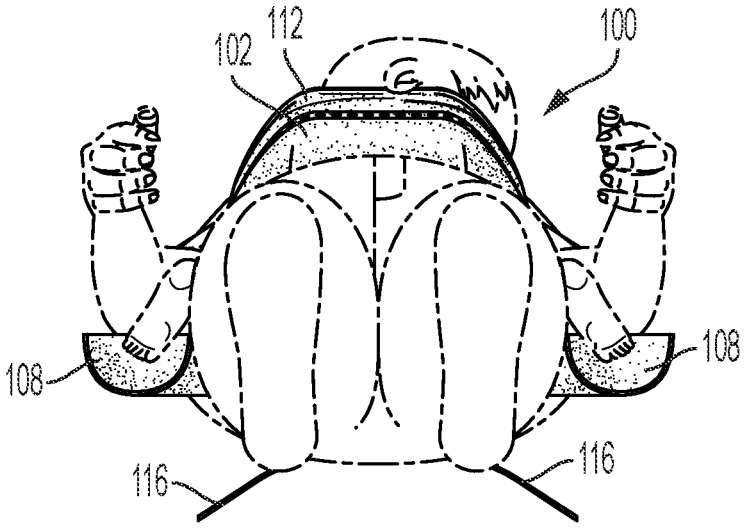
Figure 8:
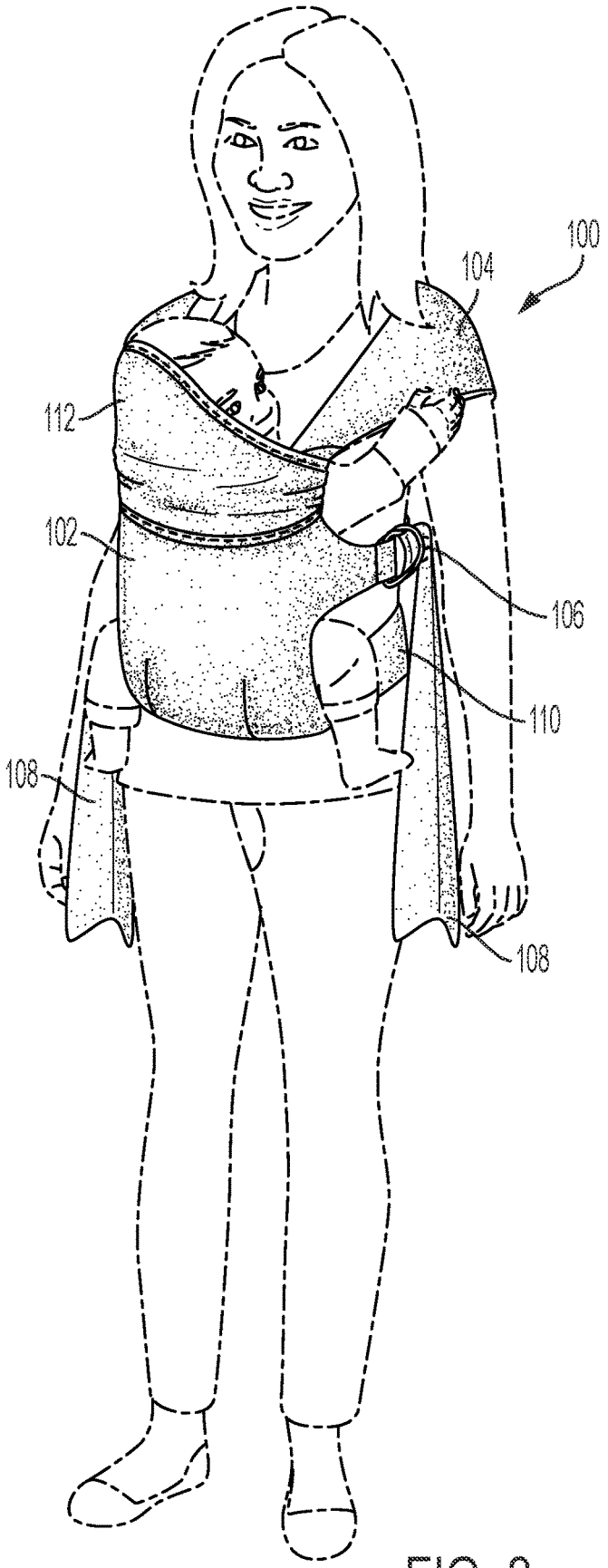
FIGS. 8-14 correspond, respectively, to the views of the child carrying system of FIGS. 1-7, where the system is being utilized to carry a child on the front of a person with the head support in a raised configuration.
Figure 9:
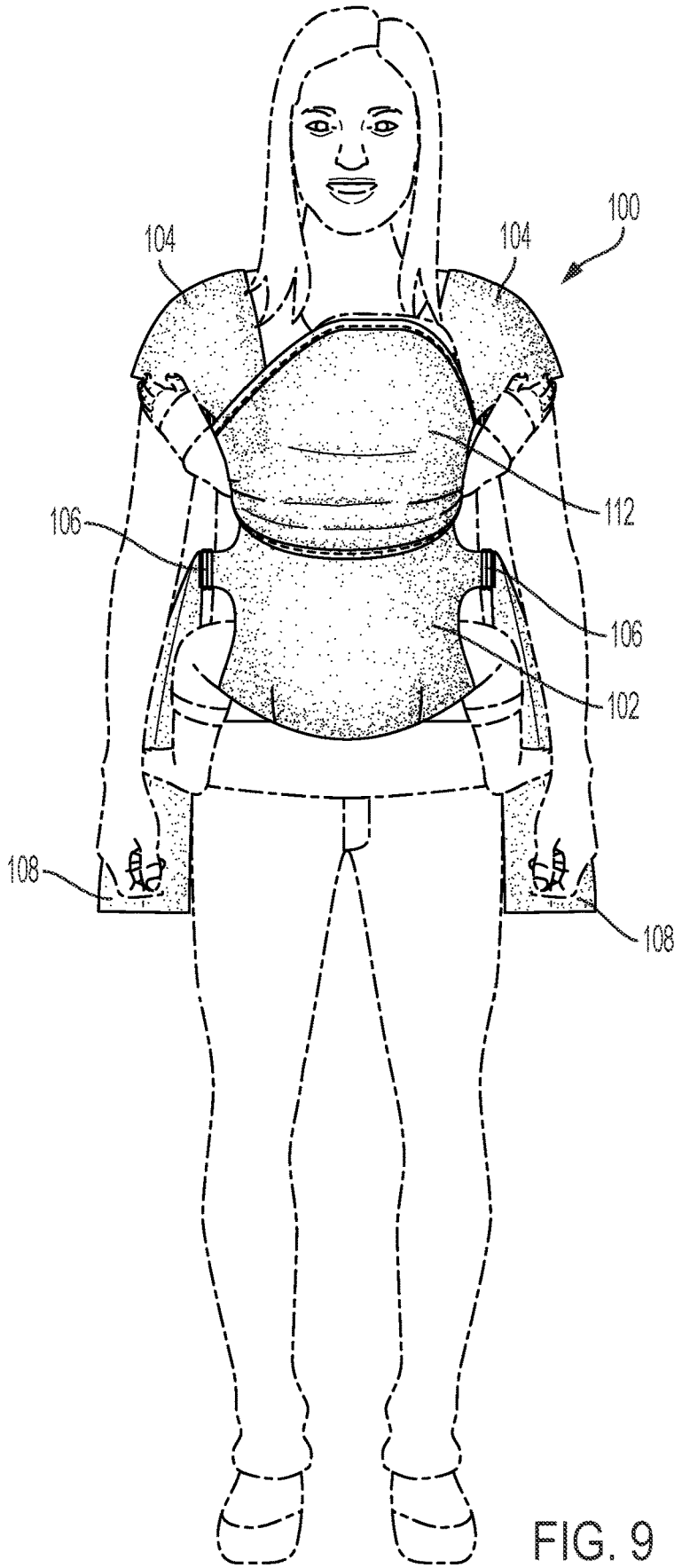
Figure 10:
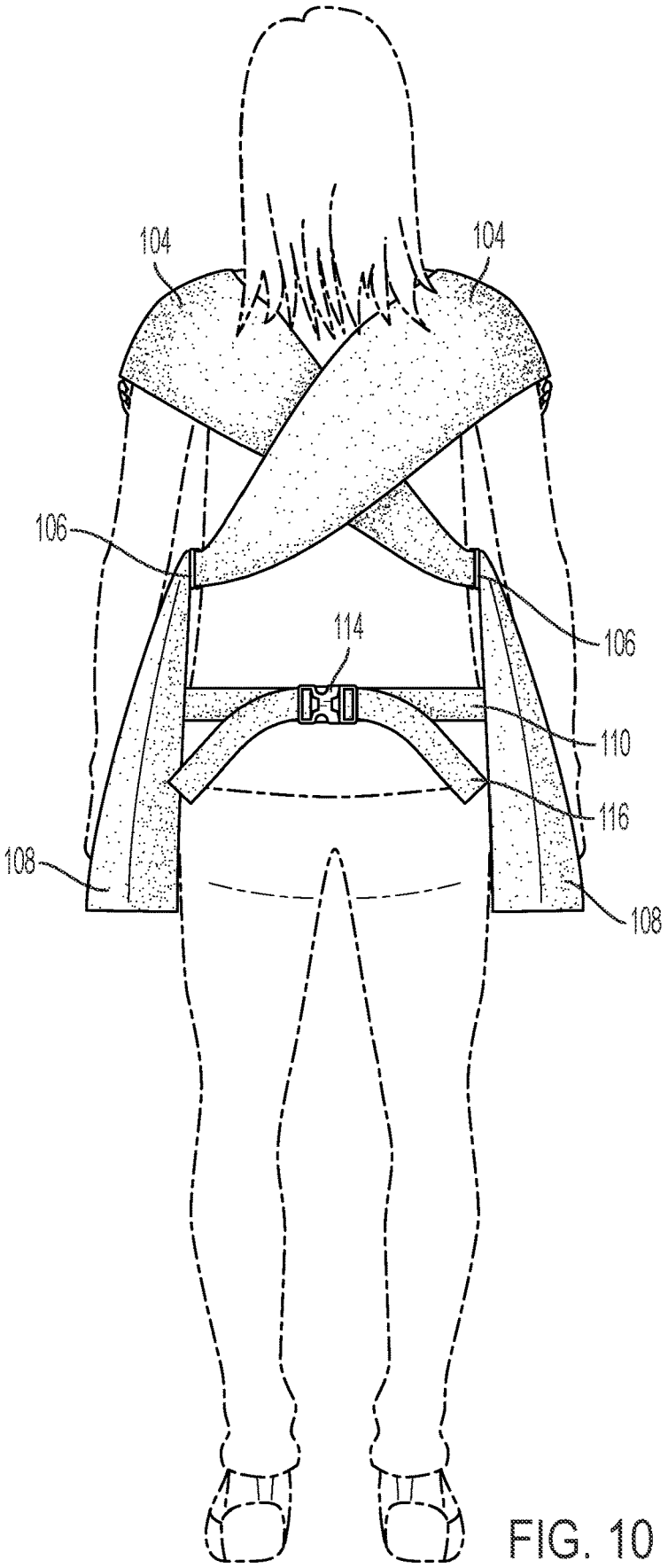
Figure 11:
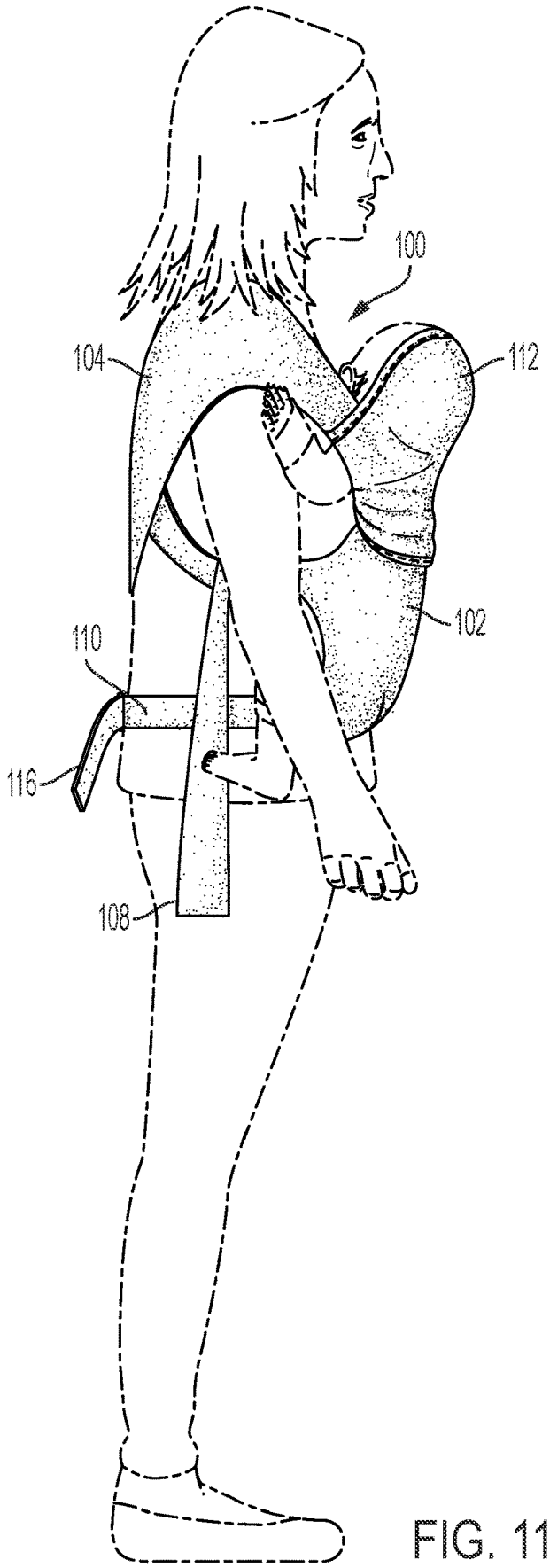
Figure 12:
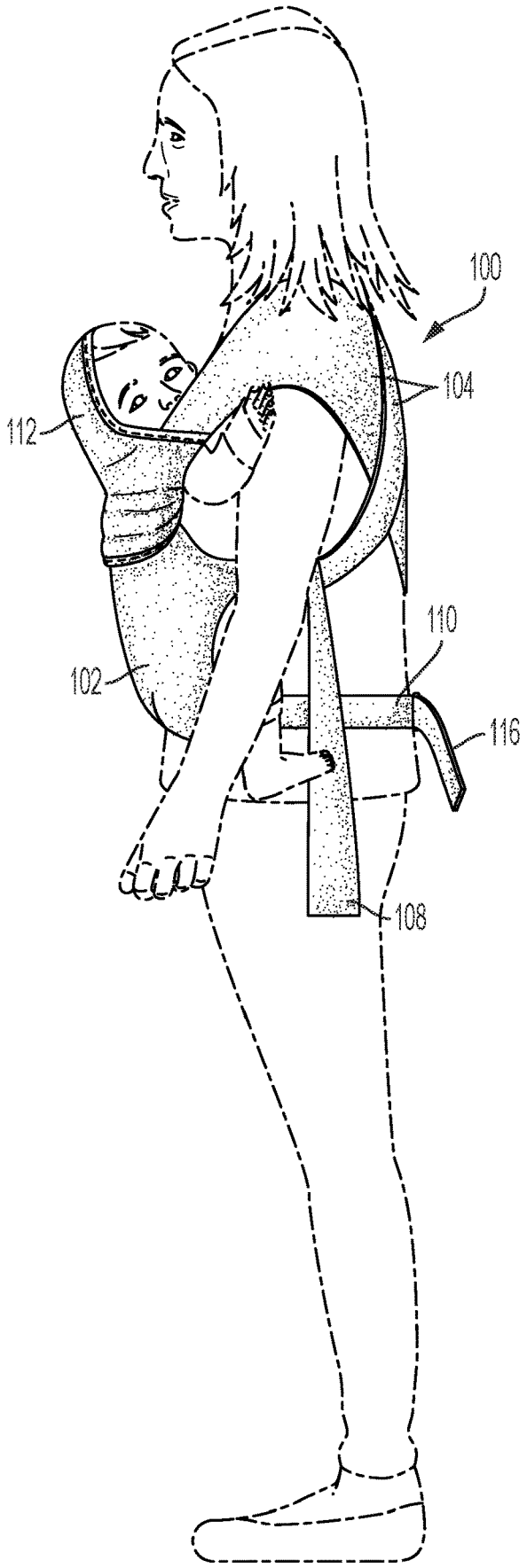
Figure 13:
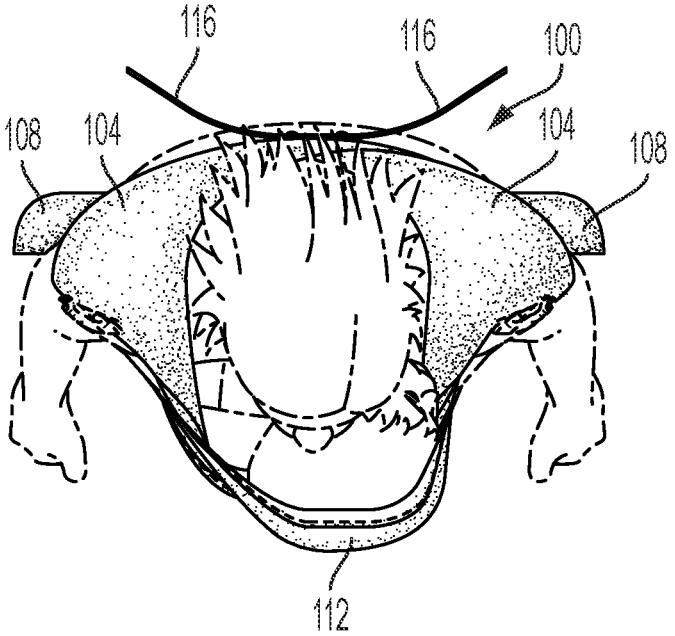
Figure 14:
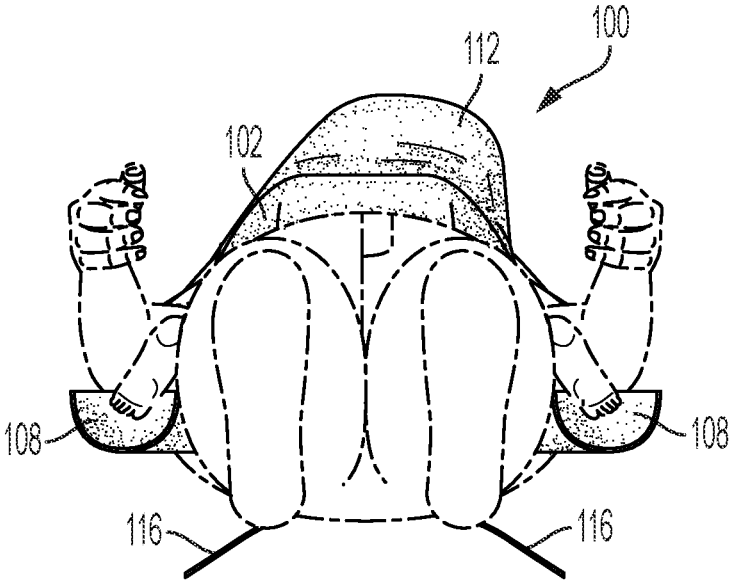
Figure 15:
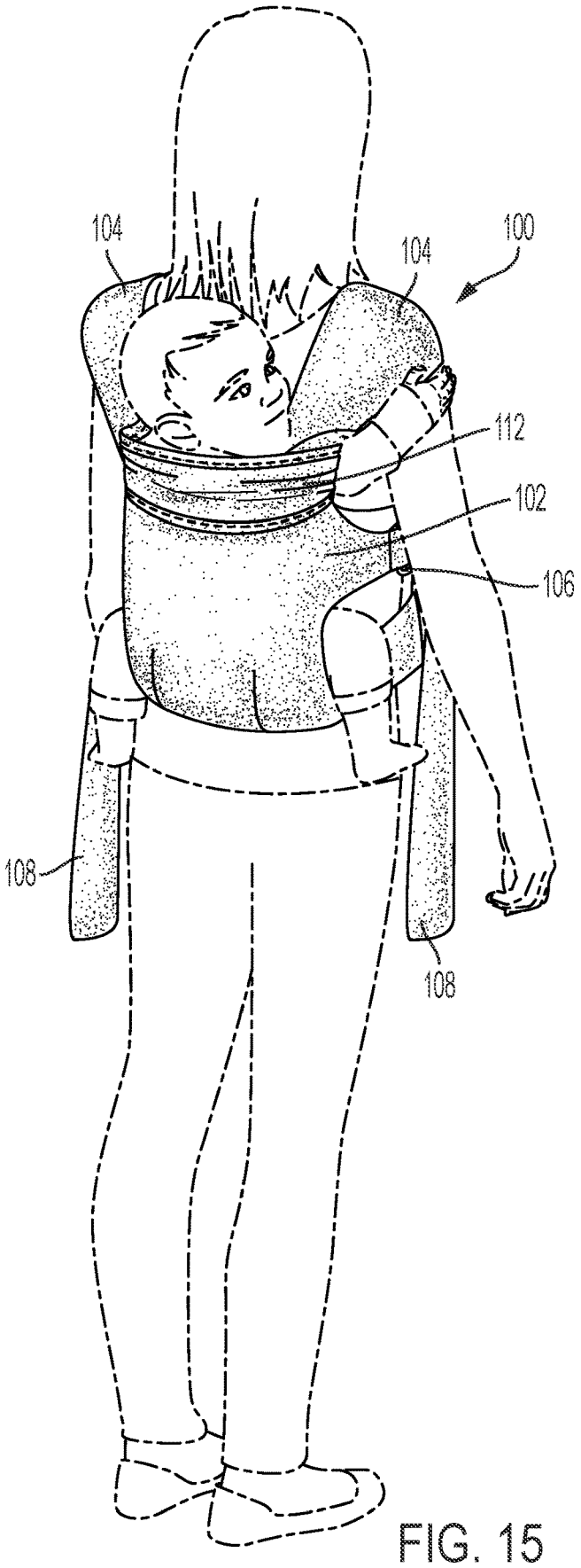
FIG. 15 is a perspective view of the child carrying system of FIG. 1, where the child carrying system is being utilized to carry a child on the back of a person with the child carrying system's head support in a lowered configuration.
Figure 16:
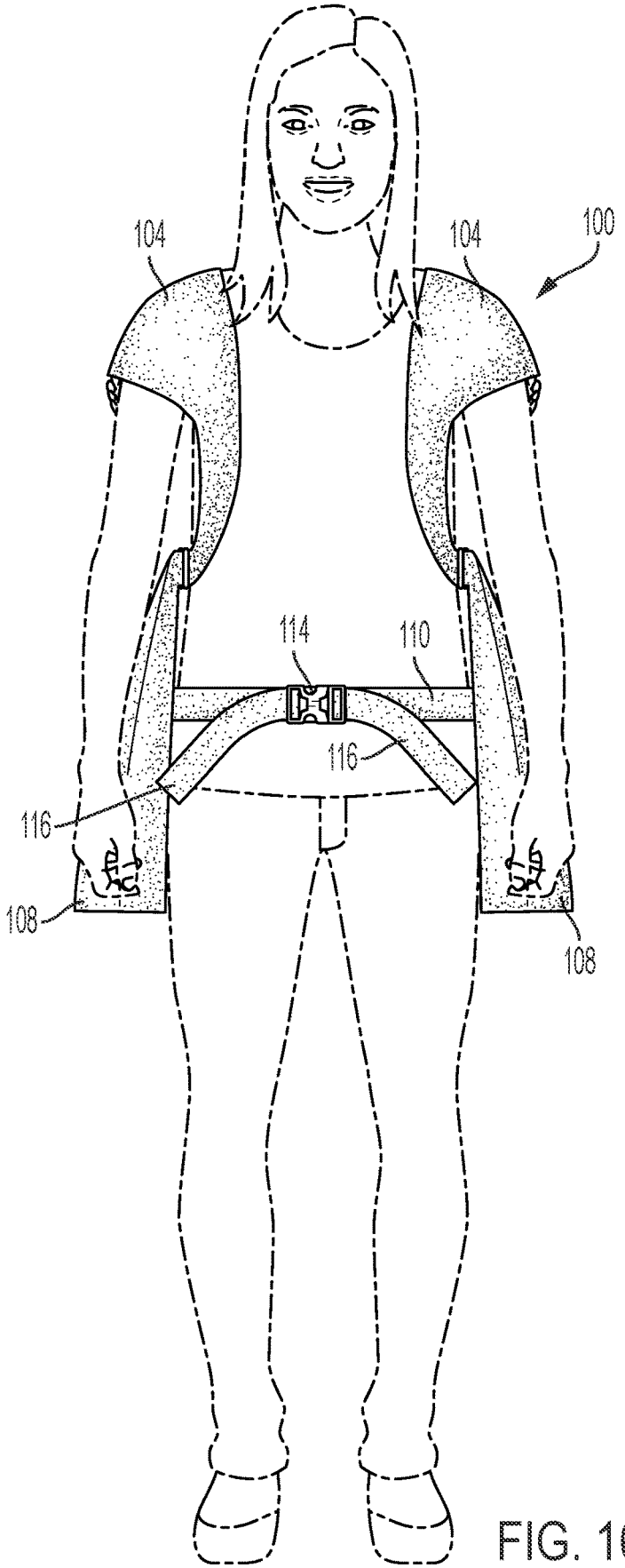
FIGS. 16-21 are, respectively, front, rear, right-side, left-side, top, and bottom views of the child carrying system of FIG. 1, where the system is being utilized to carry a child on the back of a person with the child carrying system's head support in a lowered configuration.
Figure 17:
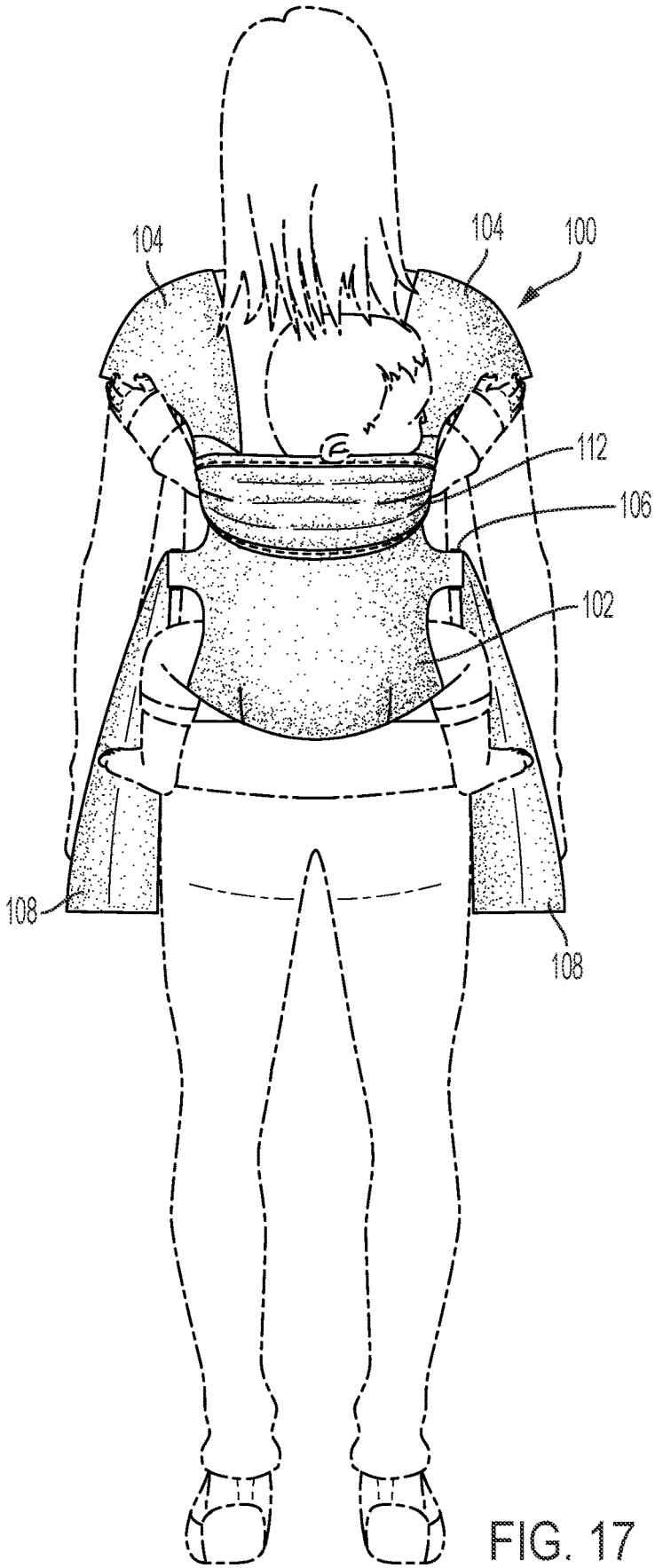
Figure 18:
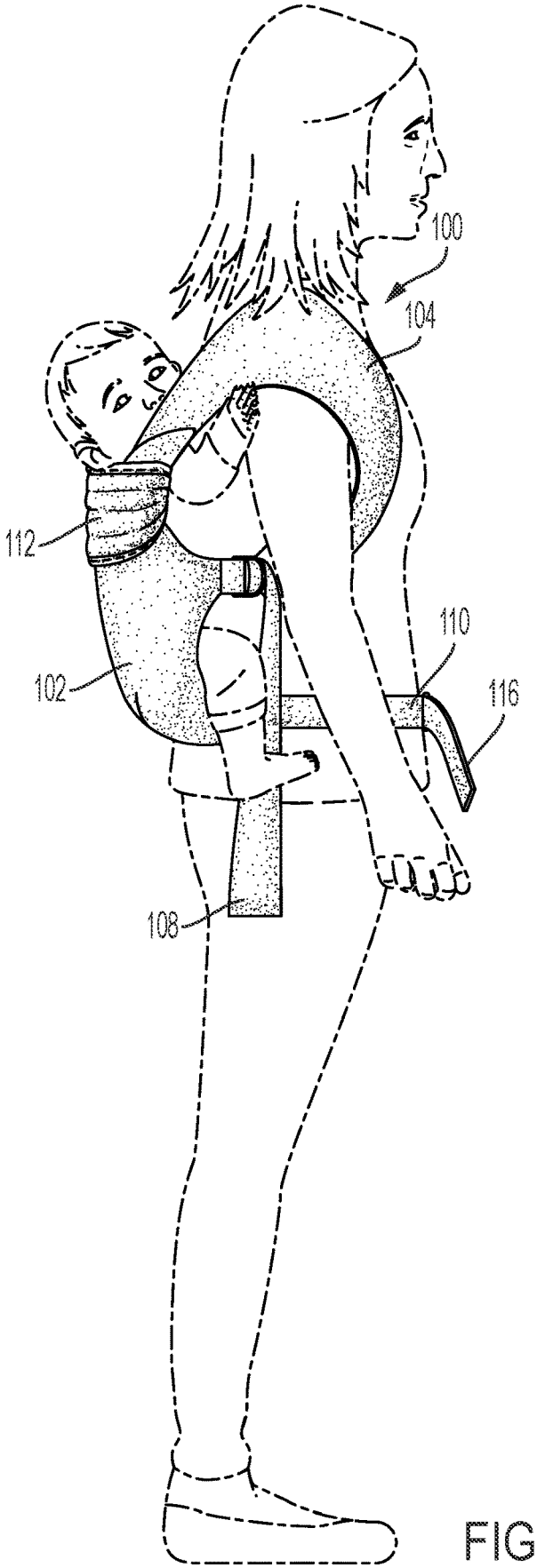
Figure 19:
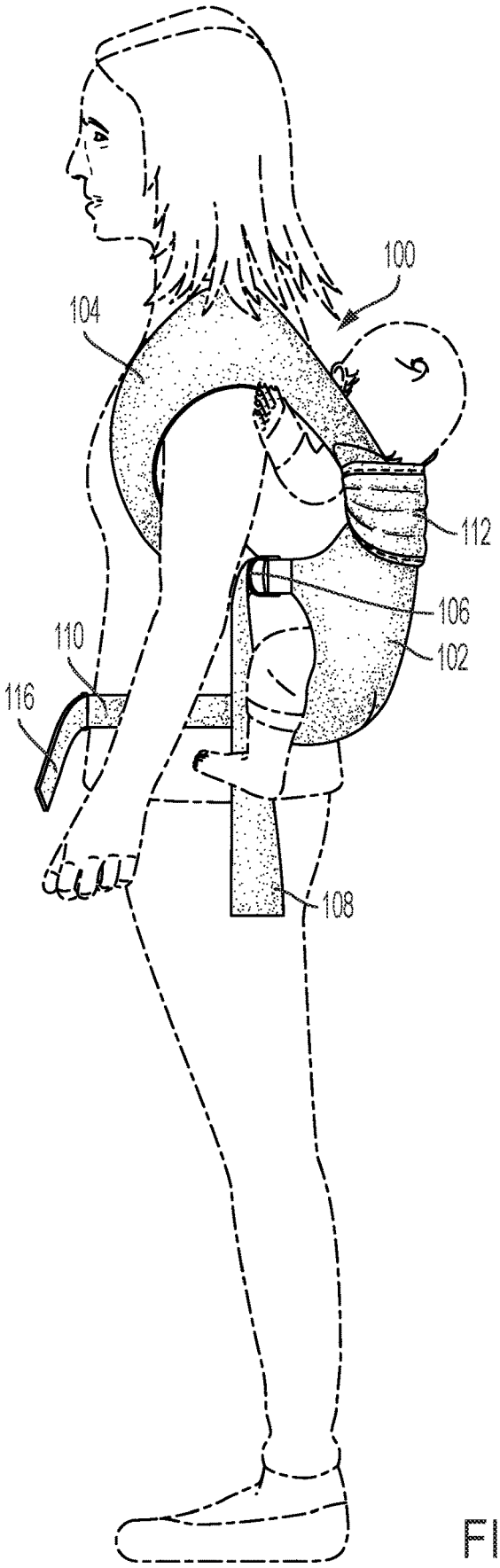
Figure 20:
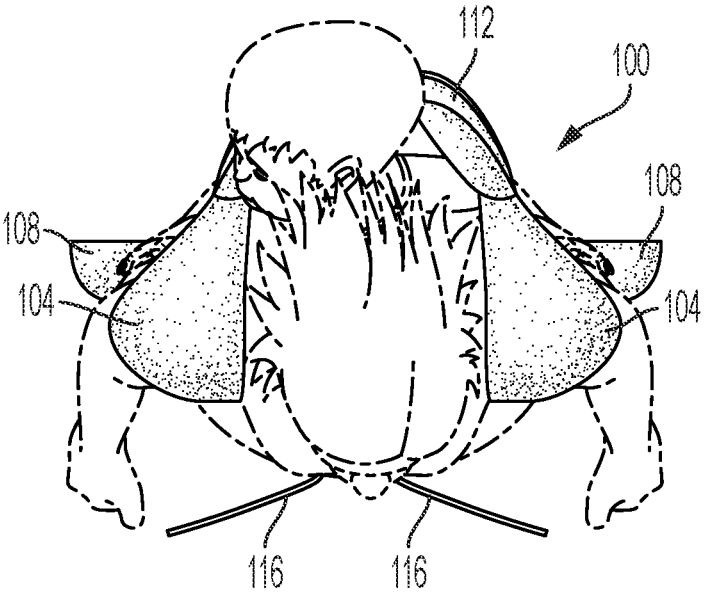
Figure 21:
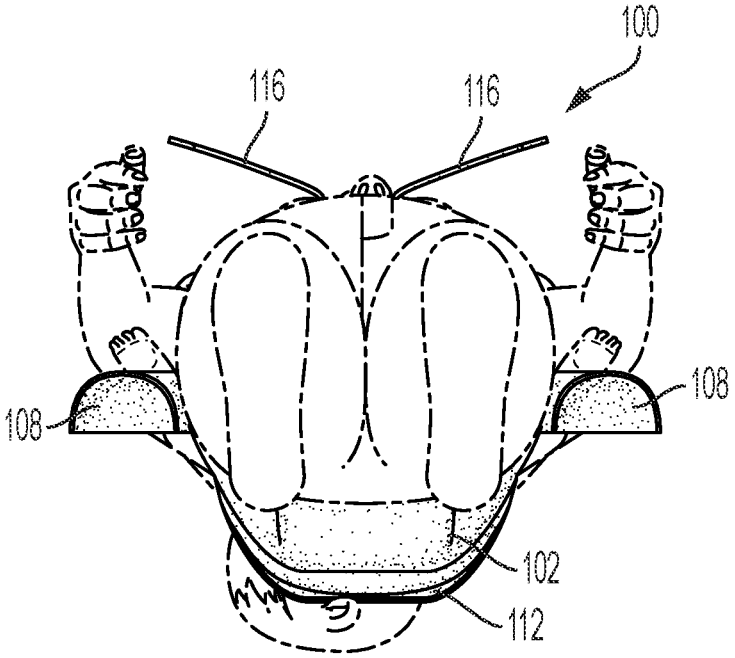
Figure 22:
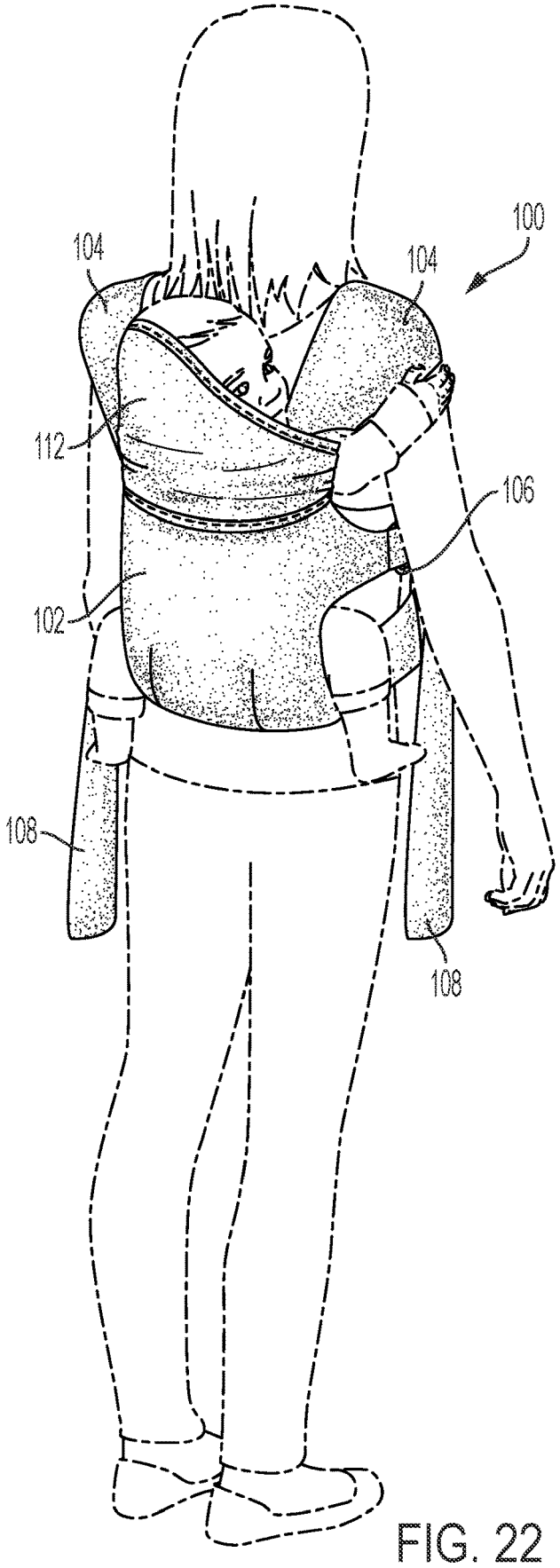
FIGS. 22-28 correspond to the views of the child carrying system of FIGS. 15-21, respectively, where the system is being utilized to carry a child on the back of a person with the head support in a raised configuration according to various embodiments herein.
Figure 23:
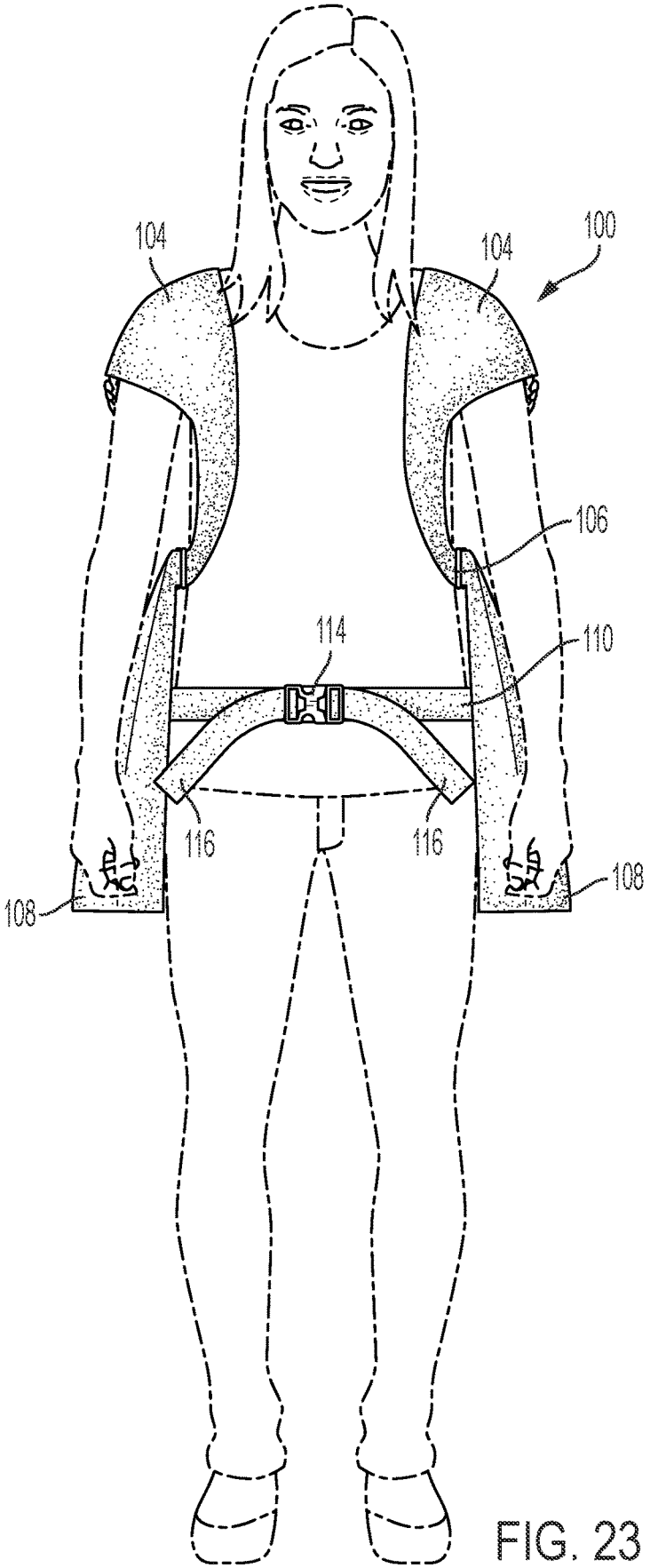
Figure 24:
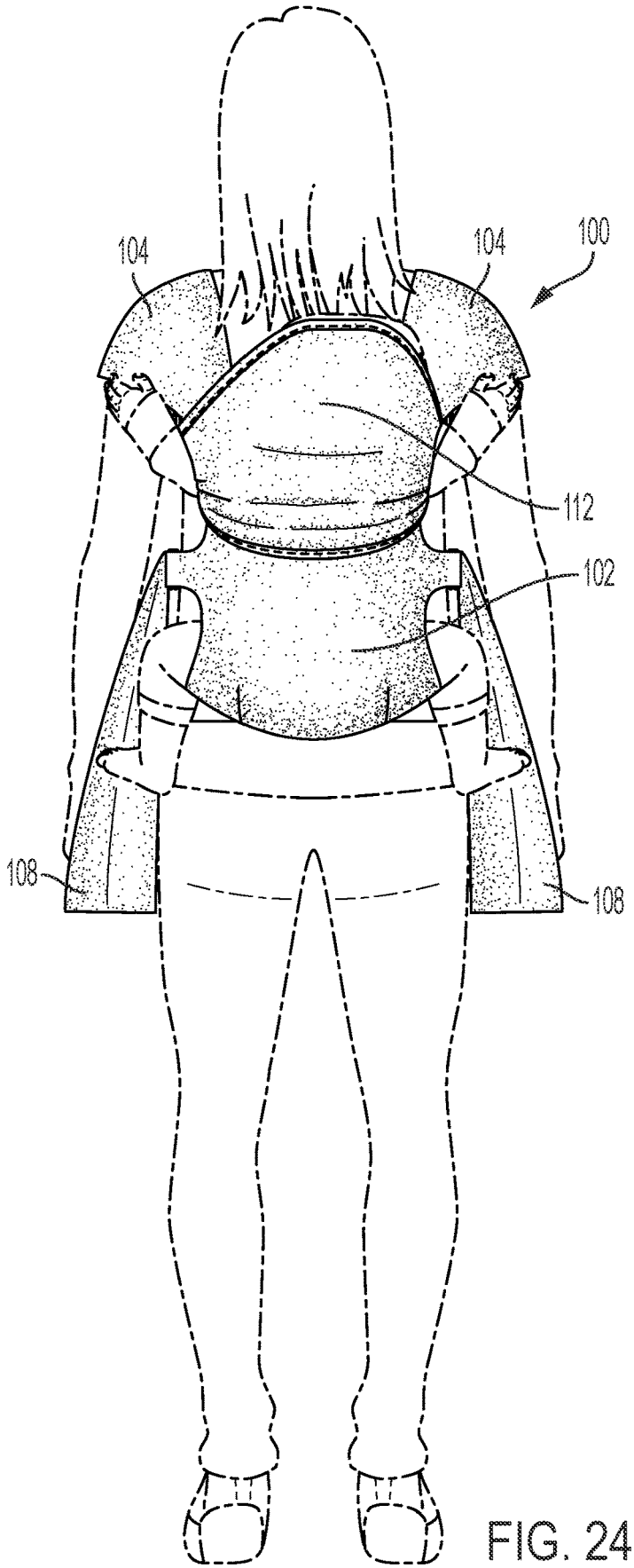
Figure 25:
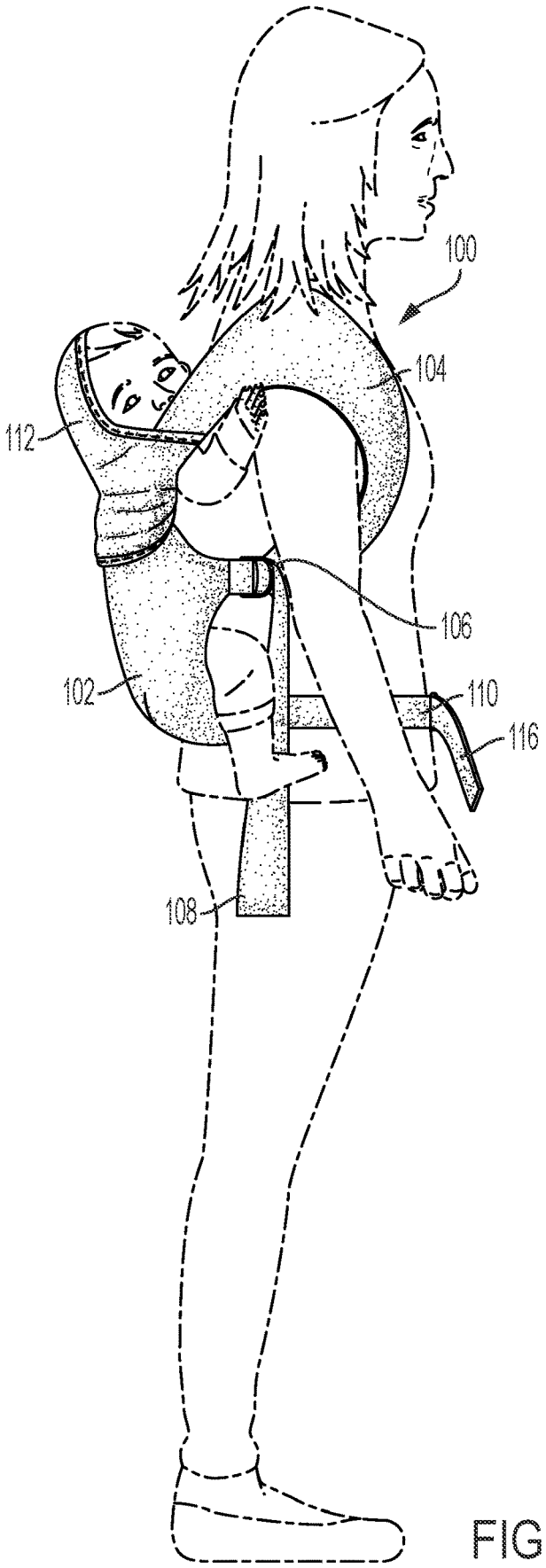
Figure 26:
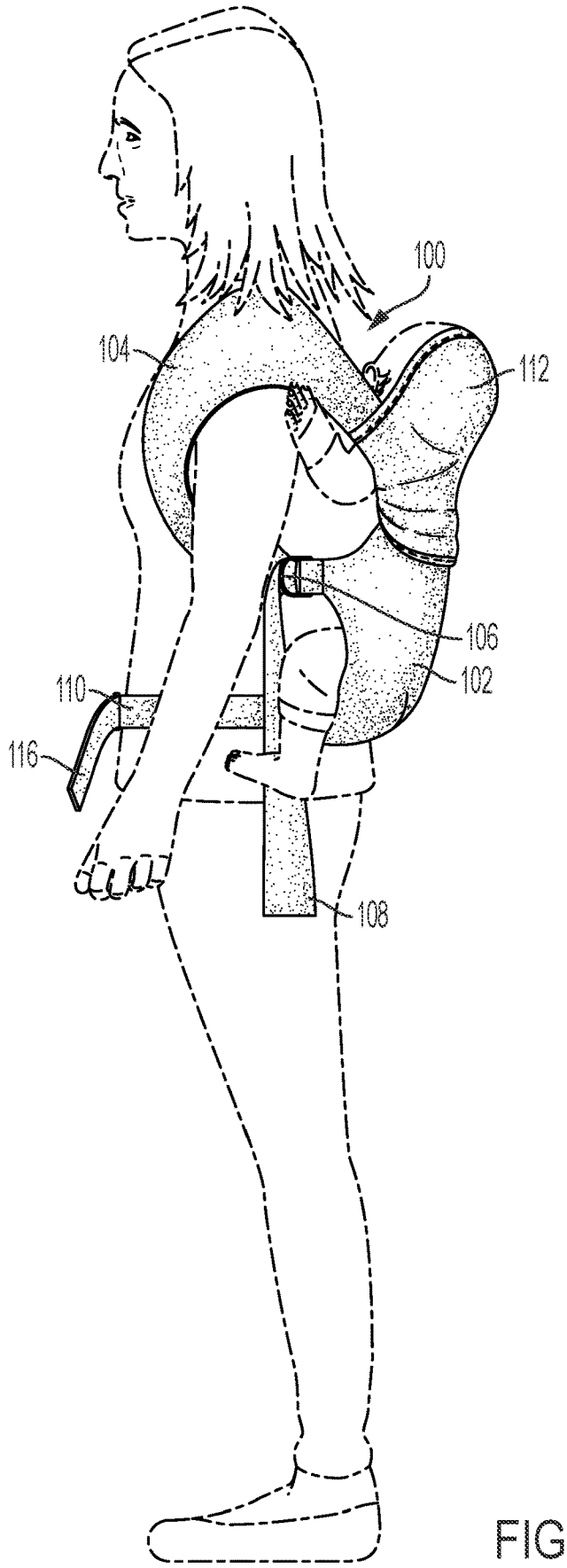
Figure 27:
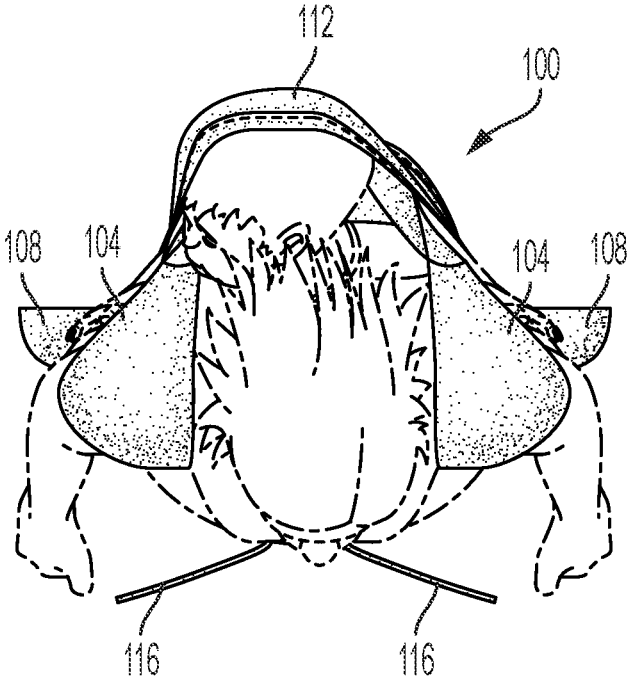
Figure 28:
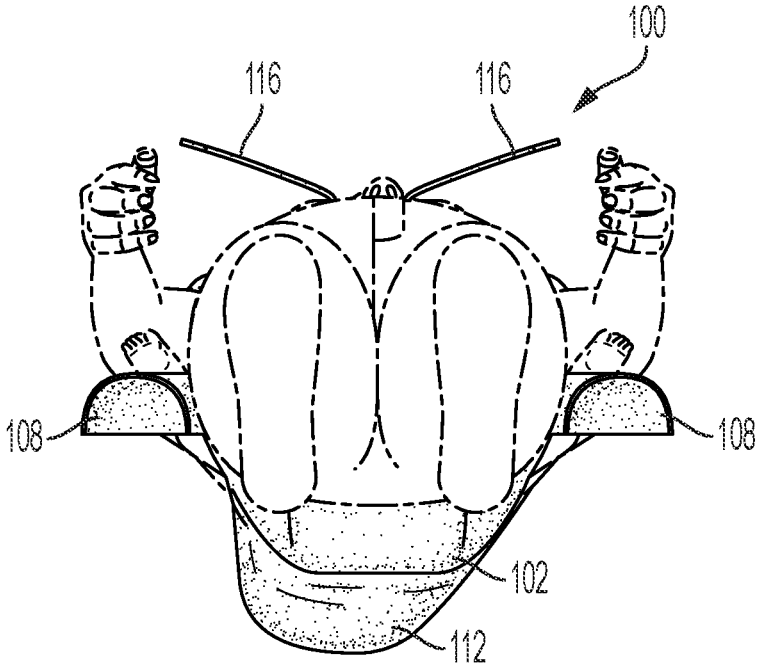

Various embodiments will now be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Conventional child carriers vary greatly in structure and configuration. Child carriers may be configured with a rigid framework to provide support for the carrier and to distribute the child's weight. These carriers are often bulky, heavy, and cumbersome. Other soft carriers provide for carrying the baby or child on the user's back or on their front. Most carriers have limitations as they are designed for a specific placement of the child on the user's back or front, which, while useful for that particular use, does not provide allow for flexibility in carrying position and comfort as the child grows. Carriers often include numerous straps and buckles to provide for optimum fit and positioning of the child's weight while being carried. Similarly, straps are often padded and bulky in an attempt to provide comfort. The result is a bulky, cumbersome carrier that is difficult or inconvenient to carry while not in use and uncomfortable due to the numerous straps, buckles, and traditional mesh and plastic materials used in the carriers.

Various concepts and technologies described herein utilize a child carrying system that includes a carrier portion that encompasses the child that is made of soft fabric material. Instead of padded "backpack style" straps that secure conventional carriers to the user, various embodiments described herein may include wide fabric straps that may be positioned around the user's shoulders and threaded through large D-rings (which are a specific example of an "adjustment mechanism") that are attached to the carrier portion to allow for easy adjustment. In various embodiments, the entire child carrying system is manufactured from one or more soft fabrics, without any internal or external framing, and without any bulky padding (although alternative embodiments may include some internal or external framing and/or padding). Because of the nature of the fabric, the configuration of the straps and carrier portion, and the manner in which the carrier is worn, various embodiments of the child carrying system described herein provide a significant improvement over conventional carriers in terms of comfort and versatility.

Various child carrying systems described herein allow for the child to be worn on the user's back or on the user's front. When the child is carried on the user's back, the wide fabric straps extend from the carrier portion, over the user's shoulders, and directly down through the D-rings attached to the carrier portion. In various embodiments, the wide fabric straps are of a length that allows for extended "tail" portions of the straps to hang below the D-rings after being threaded through. These tails may be pulled away from the carrier portion to pull the straps through the D-rings and tighten the carrier portion against the user, or pushed back through the D-rings towards the carrier portion to loosen the carrier portion from the user when putting the child carrying system on or taking it off. Because the tails are wide and long, they may be tied across the user's chest as desired for aesthetic purposes, or allowed to hang by the user's side, according to the user's preference.

When the child is carried on the user's front, the wide fabric straps extend from the carrier portion, over the user's shoulders, and cross across the user's back to the D-rings on the opposite side of the carrier portion from where the straps begin. As noted above, the wide fabric straps may be of a length that allows for extended tails to hang below the D-rings after being threaded through.

Various embodiments of the child carrying system described herein provide a head support that is comfortable, provides exceptional support, and is easily configured according to the user's preference and/or the child's needs. The respective lateral sides of the head support may, for example, be wrapped around the two fabric shoulder straps in a manner that allows the head support to slide up and down the straps between lowered and raised configurations. In certain embodiments, the respective lateral sides of the head support may each slide independently of each other between a retracted and an extended position along a respective one of the fabric shoulder straps. In alternative embodiments, the head support may be slideably connected to the respective shoulder straps using any other type of slideable fastener and/or slideable fastening connection (e.g., suitable plastic loops, ties, etc.). The head support may be made from fabric having an elasticity that allows the head support to be pulled up and over the child's head and/or any particular portion of the child's head, as desired. In various embodiments, when not needed, the head support may be lowered, and/or pushed down toward and against a top edge of the carrier portion, to a position at or below the child's neck (e.g., as shown in FIG. 1).

Referring now to FIGS. 1-28, aspects of the child carrying system 100 will be discussed in detail. As discussed above, the child carrying system 100 is configured to allow for a child to be carried on a user's front or on a user's back. FIGS. 1-14 show various views of an embodiment of the child carrying system 100 worn by an adult with a child secured within the child carrying system 100 on the front side of the user. FIGS. 15-28 show various views of this embodiment of the child carrying system 100 worn by an adult (in a different configuration) with a child secured within the child carrying system 100 on the back side of the user.

Specifically, FIGS. 1-7 show various views of an embodiment of the child carrying system 100 worn by an adult with a child secured within the child carrying system 100 on the front side of the user, and with the head support 112 in a lowered configuration. In this configuration, the child's head is not supported by the head support 112 so that the child has complete freedom of movement of his or her head. FIGS. 8-14 show various views of an embodiment of the child carrying system 100 worn by an adult with a child carried on the front side of the user, and with the head support 112 in a raised configuration. In this configuration, the child's head is fully supported by the head support 112, which is important for infants that are unable to support the weight of their heads. This configuration may also be convenient for any child that is sleeping. FIGS. 15-21 show various views of an embodiment of the child carrying system 100 worn by an adult with a child carried on the back side of the user, and with the head support 112 in the lowered configuration. FIGS. 22-28 show various views of an embodiment of the child carrying system 100 worn by an adult with a child carried on the back side of the user, and with the head support 112 in the raised configuration.

Figure 31:
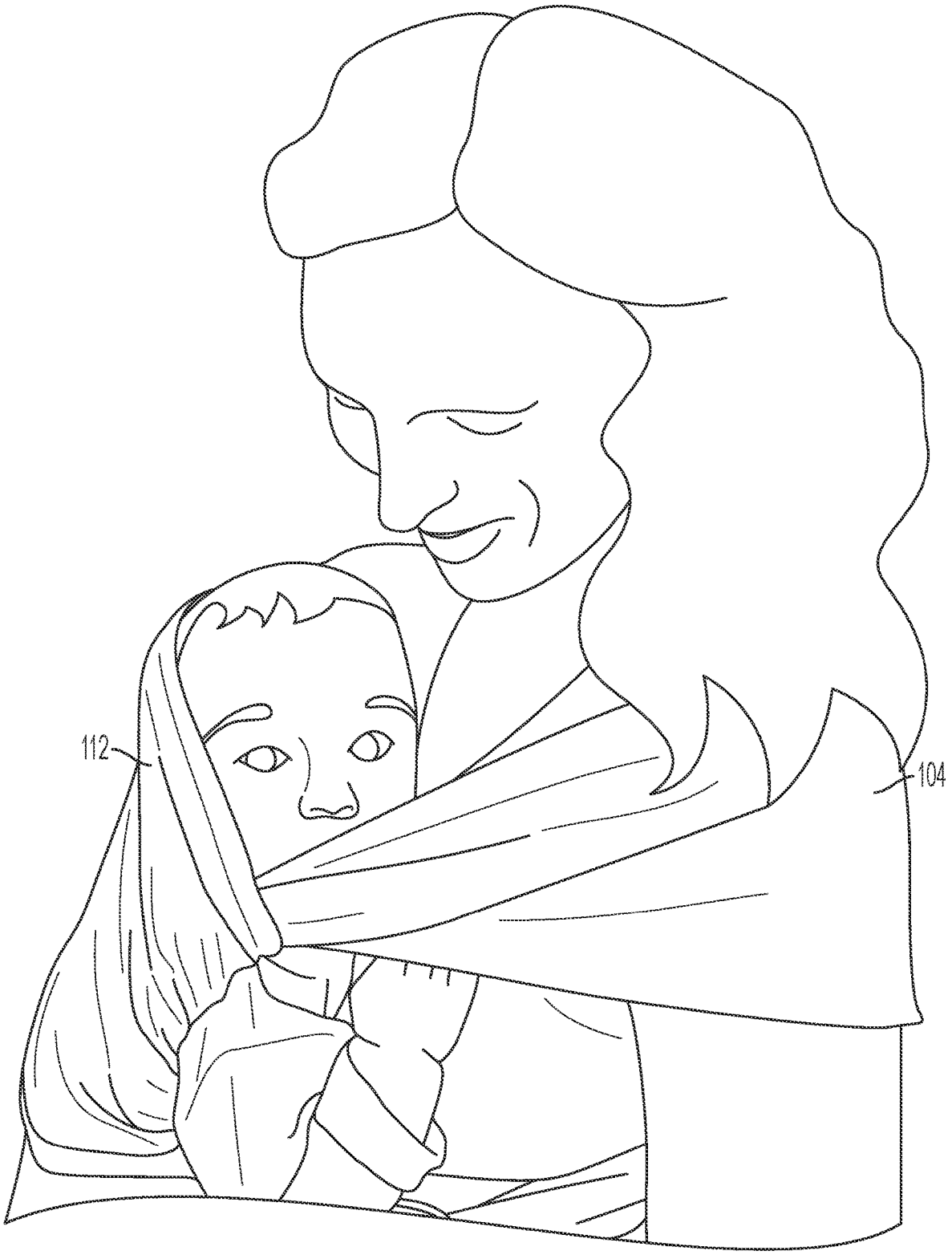
FIG. 31 is a close-up perspective view of a child in a child carrying system with the head support in a partially raised (left side raised, right side partially raised) configuration according to various embodiments.

FIG. 31 shows a close up view of a child carrying system 100 with the head support in a raised or partially raised configuration. As partially shown in FIG. 31, the head support 112 may be made by taking a generally rectangular length of appropriate fabric and sewing the opposing ends together to create a loop of fabric (see seam on head support 112). However, the loop of fabric may encompass or be looped around the two fabric shoulder straps 104 so that the sides of the head support 112 are able to slide and/or be pulled and pushed along the fabric shoulder straps 104 for raising and lowering. In this manner, each side of the head support 112 may be independently raised and lowered with or without raising or lowering the other side. Doing so provides the user with the flexibility to place the head support 112 at almost limitless positions between the fully raised and fully lowered configurations. For example, if a child is sleeping with his head turned toward the side, the parent wearing the child carrying system 100 may find it beneficial to only partially raise the side of the head support 112 on the same side as the child's face, and to fully raise the opposite side of the head support 112 to cover the back of the child's head while leaving the child's face exposed to provide visual and physical access and unrestricted breathing.

Finally, the bottom edge of the head support 112 may be sewn or otherwise coupled to the top edge of the carrier portion 102 to maintain the proper positioning of the head support 112 when it is pulled upward to the raised configuration. According to other embodiments, the head support 112 may be wrapped or looped around the fabric shoulder straps 104 but without being attached to the carrier portion 102. According to one embodiment, the head support 112 may be manufactured from a single piece of material with the opposing ends detachably connected rather than sewn together. In this embodiment, the head support 112 may be purchased separately from the child carrying system 100 and fitted onto any traditional child carrier by wrapping the head support 112 around the existing shoulder straps and connecting the ends to one another (e.g., via hook-and-loop fastening straps such as Velcro straps, snaps, or buttons).

Figure 34:
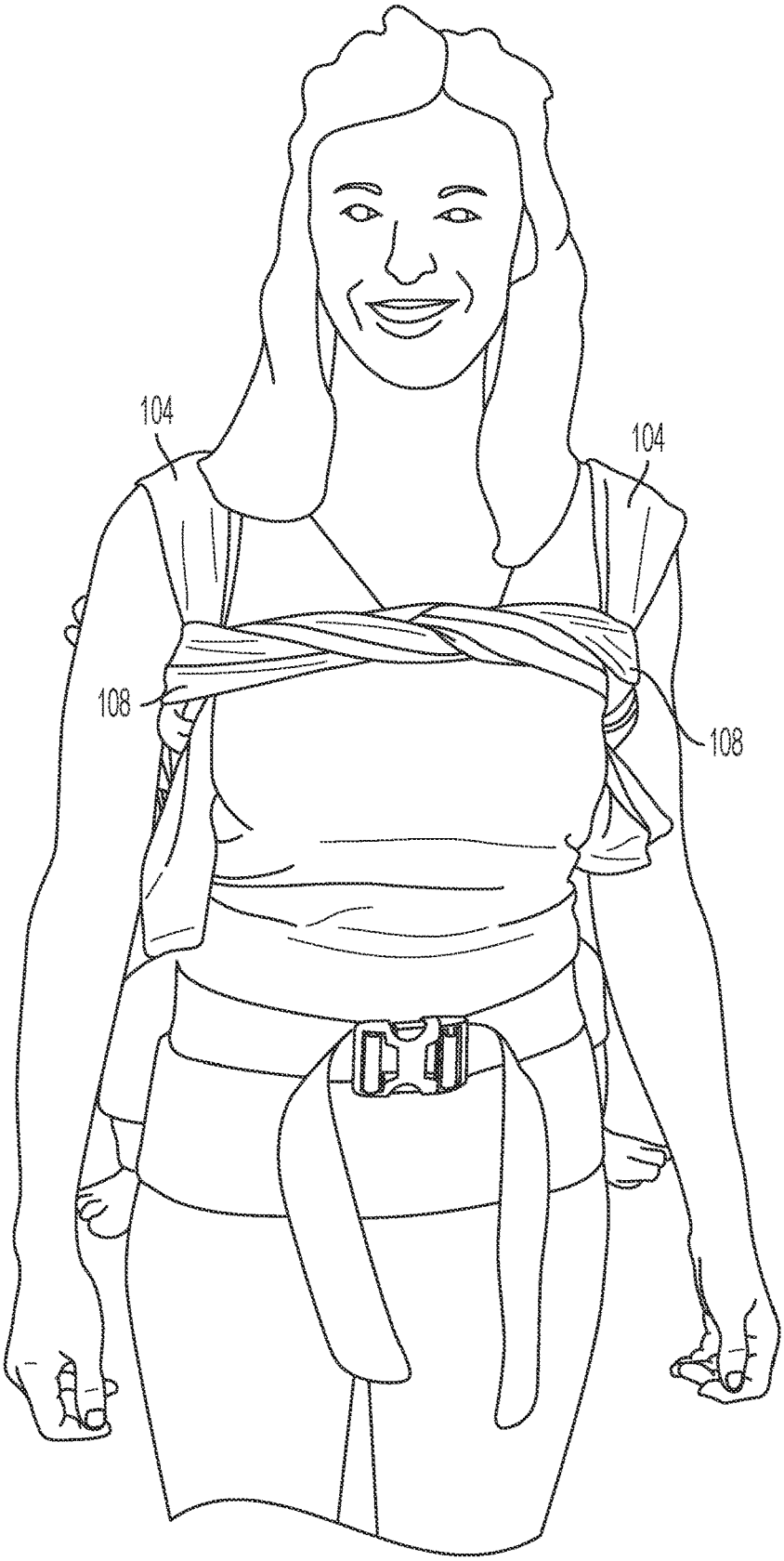
FIG. 34 is a front view of a child carrying system utilized to carry a child on the back of a person with shoulder strap tails engaged with each other across a chest of a person according to various embodiments herein.

As seen in the various embodiments, the child carrying system 100 includes a carrier portion 102 that supports the child's body. The carrier portion 102 may be selectively secured to the user using a waist belt 110 and a pair of shoulder straps 104. The shoulder straps 104 are each coupled at a first end to the carrier portion 102 proximate to a top corner of the carrier portion 102 and uncoupled at a second end opposite the first end. As mentioned above, the second end of each shoulder strap 104 is referred to herein as a tail 108. The tails 108 of the shoulder straps 104 may be left hanging down the user's side when the child is secured within the carrier portion 102 and the child carrying system 100 is being used. The length of the tails 108 allow for easy access for adjustments. Because the tails 108 are generally long enough to hang below the carrier portion 102, the user has various options for the tails 108 while carrying a child. One option is to allow the tails 108 to hang generally straight down, as shown in most of the drawings. Another option when the child is carried on the back of the user is to tie or wrap the tails 108 together across the user's chest, as shown in FIG. 34.

The fabric shoulder straps 104 are generally wide, significantly wider than a conventional shoulder strap on a backpack or typical child carrier. In doing so, the shoulder straps may be bunched up or folded to a narrower configuration where the shoulder straps 104 meet the carrier portion 102 or where the head support 112 loops around, and able to expand to a wider configuration where the shoulder straps 104 traverses the user's shoulder and back. By widening the fabric shoulder straps 104 to encompass substantially the user's entire shoulder, the child carrying system 100 is fully supported in a manner that is substantially more comfortable to the user than a conventional strap that has a minimal contact surface area and may "dig in" or irritate the user's shoulder after prolonged wear. Maximizing the contact surface area on the shoulders distributes the weight of the child, while the fabric of the shoulder straps 104 adapts to the contours of the user's body and moves with the shoulders and arms, maximizing comfort.

Figure 29:
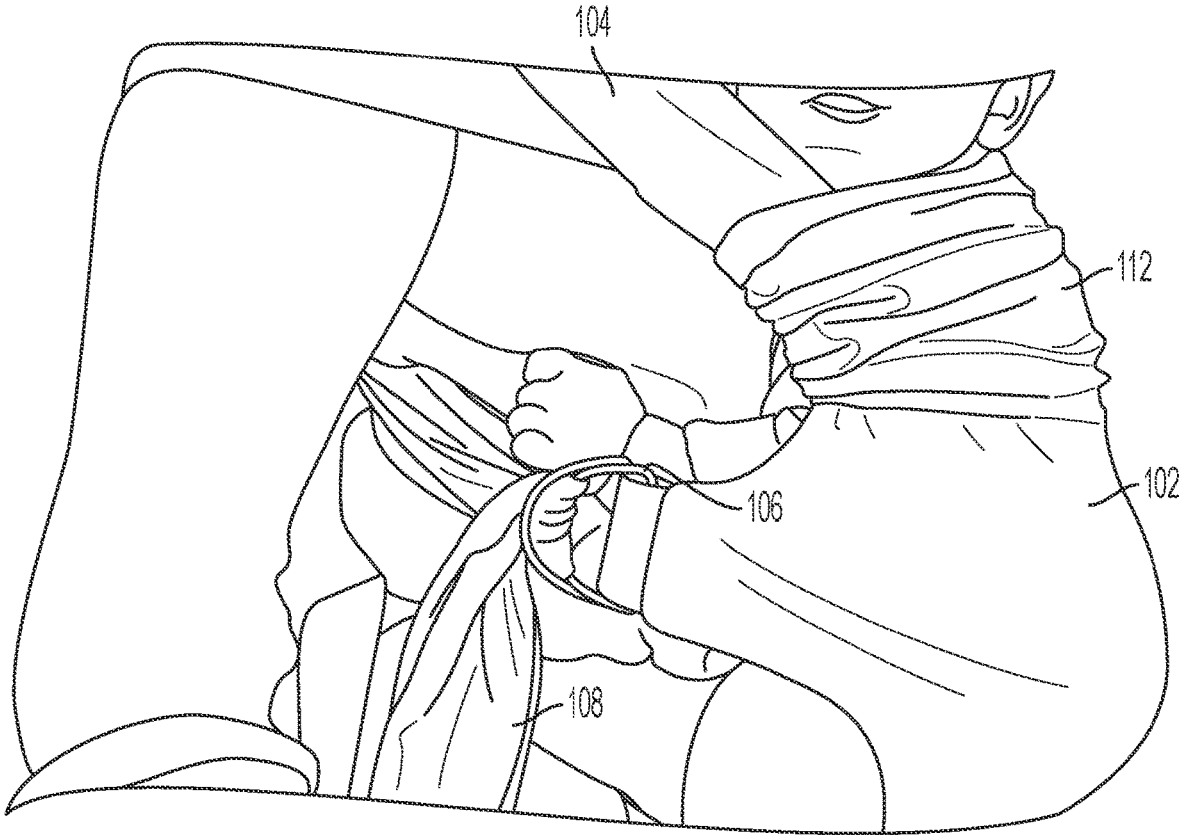
FIG. 29 is a close-up view of an adjustment mechanism of a child carrying system according to various embodiments.
Figure 30:
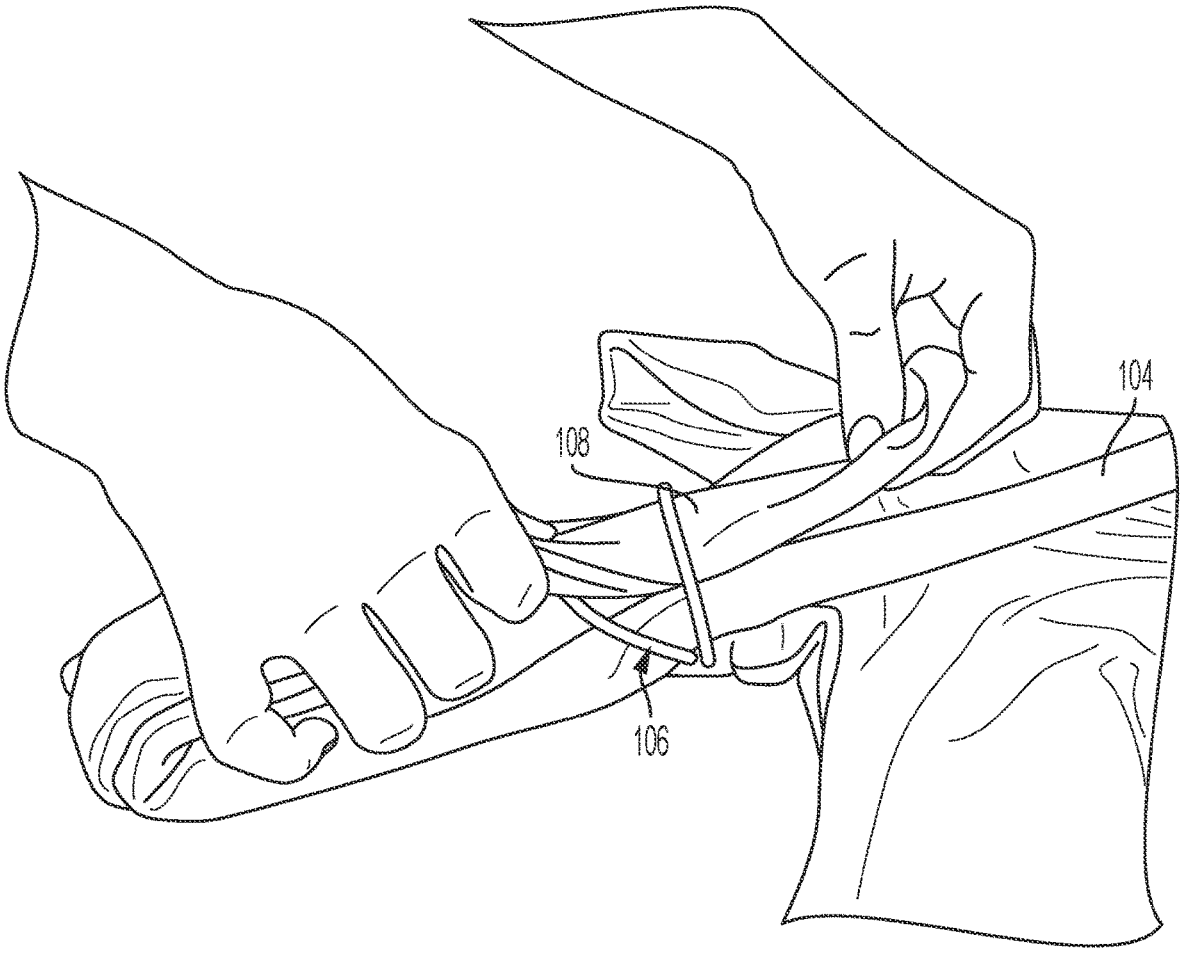
FIG. 30 is a close-up view of a shoulder strap of a child carrying system being threaded through an adjustment mechanism according to various embodiments.
Figure 32:
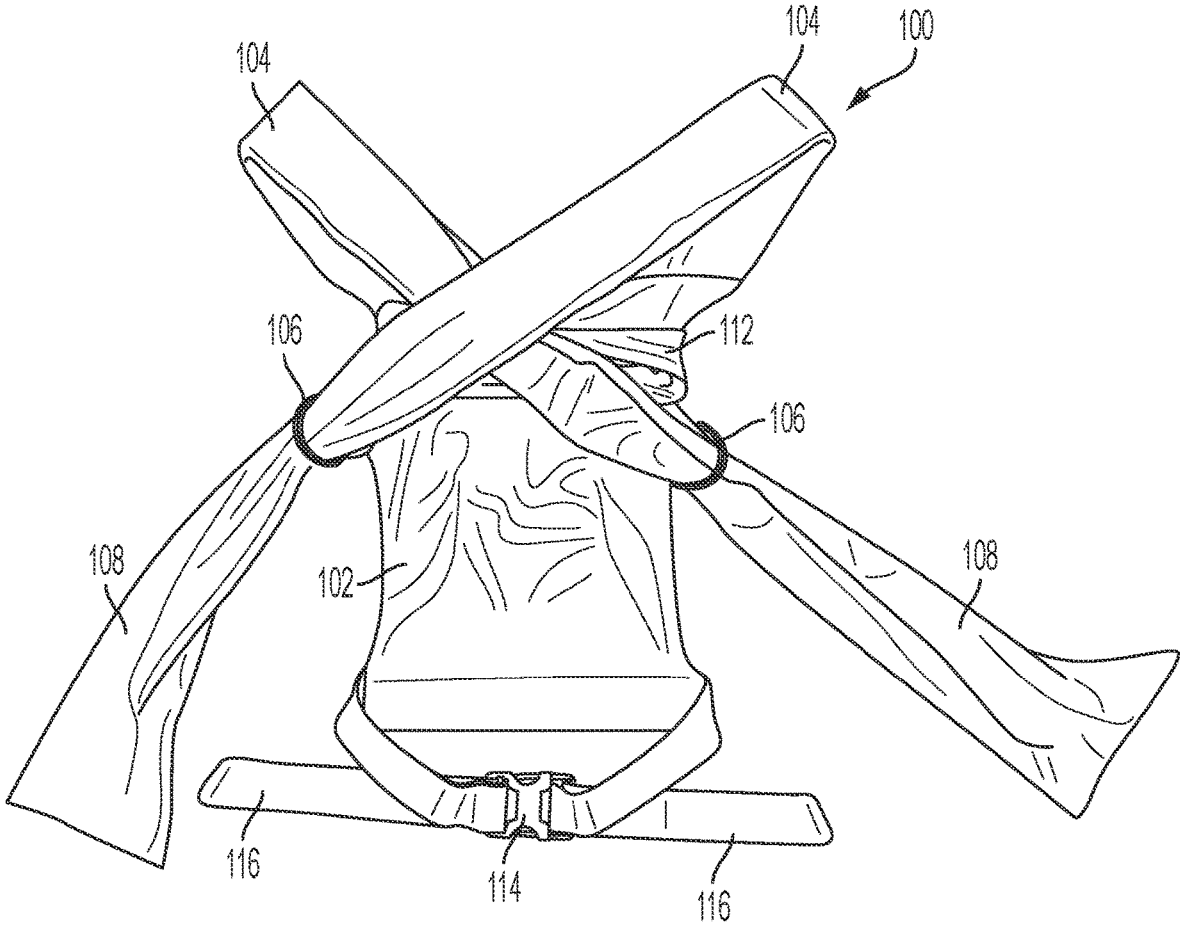
FIG. 32 is a rear view of a child carrying system without a child supported within and configured for carrying a child on a front of a person, according to various embodiments herein.
Figure 33:
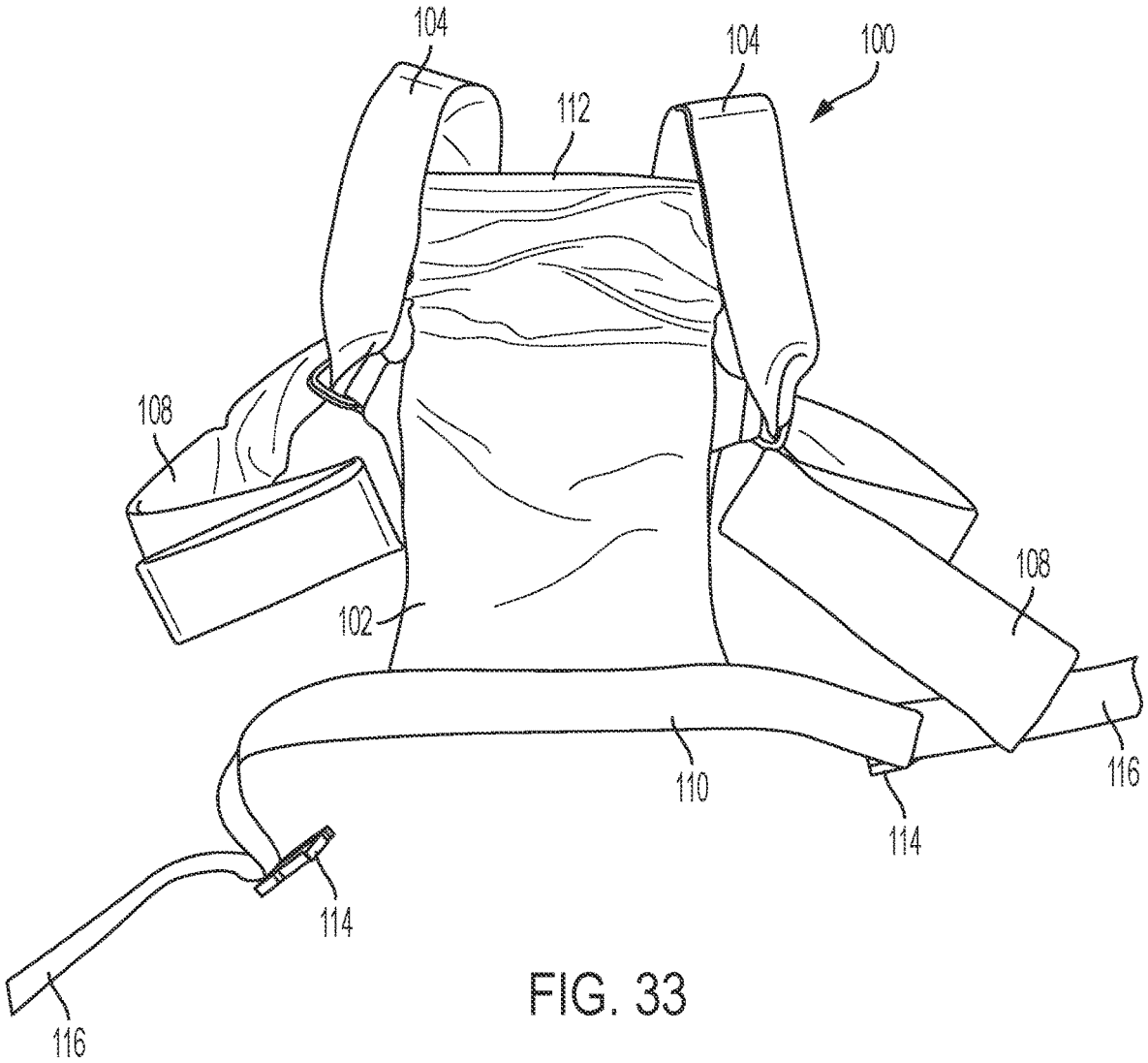
FIG. 33 is a rear view of a child carrying system without a child supported within and configured for carrying a child on a back of a person, according to various embodiments herein.

The fabric shoulder straps 104 are routed through D-rings 106 or any other suitable attachment mechanism (e.g., adjustable attachment mechanism) connected to the carrier portion 102. FIG. 29 shows a close up of a shoulder strap 104 secured through a D-ring 106, while FIG. 30 shows a close up view of the installation process for routing the shoulder strap 104 through the D-ring 106. For support and comfort purposes, the fabric shoulder straps 104 may be crisscrossed to opposite D-rings 106 when the child carrying system 100 is configured for carrying a child on a user's front. This configuration is shown in FIG. 32. FIG. 33 shows the configuration of the fabric shoulder straps 104 when the child carrying system 100 is configured for carrying a child on a user's back. In this configuration, the fabric shoulder straps 104 are routed downward from the user's shoulder to a set of D-rings 106 on the same side of the carrier.

Figure 35:
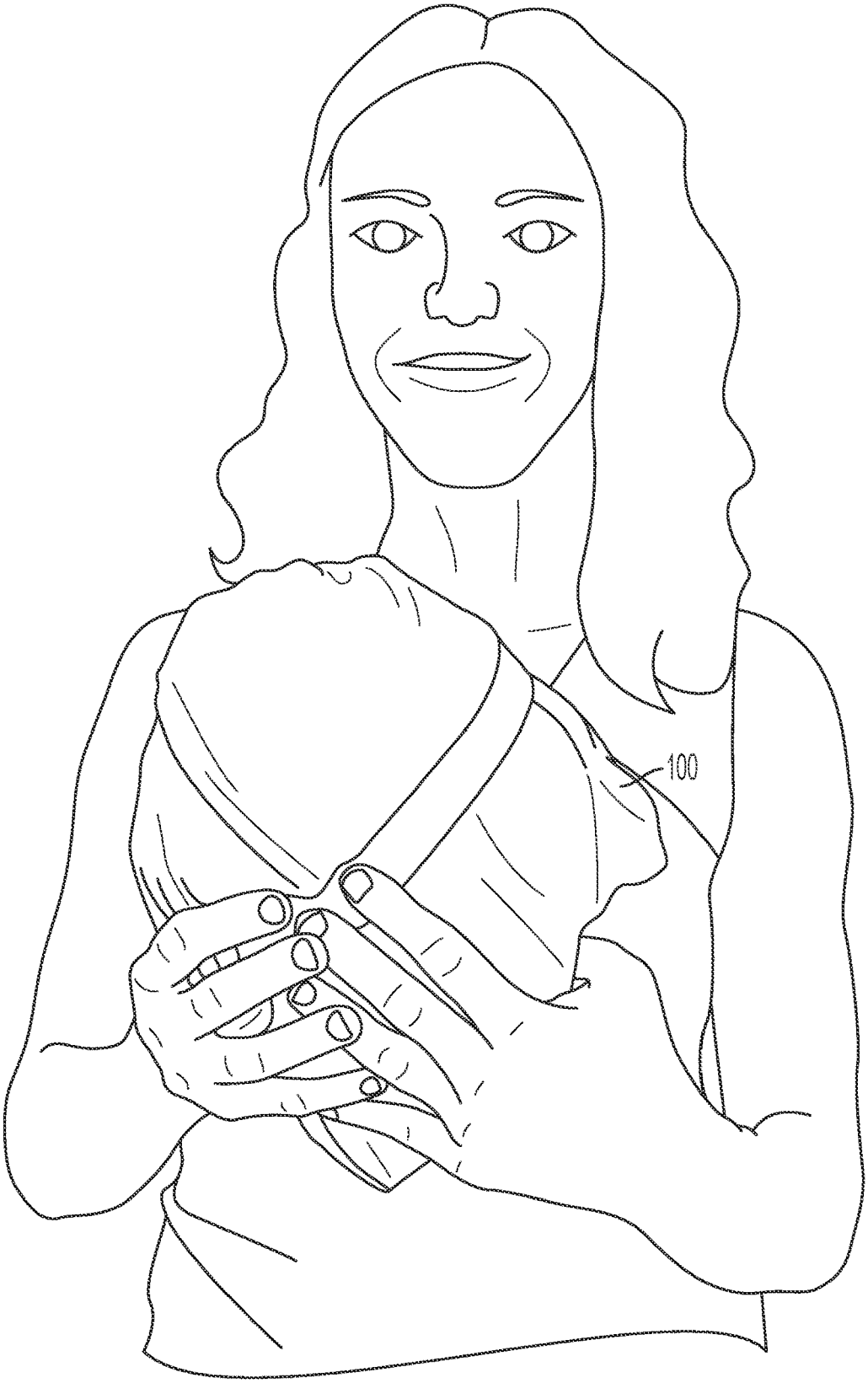
FIG. 35 is a front view of a child carrying system configured in a stowed configuration according to various embodiments herein.

The child carrying system 100 includes a waist belt 110 that is attached to a bottom edge or portion of the carrier portion 102. The waist belt 110 is preferably fabric, but may be any material. The waist belt 110 has waist belt tails 116 that thread through a fastener mechanism 114 and are adjustable to various waist sizes. The waist belt 110 is most clearly shown in FIGS. 32-34. When not in use, at least in part because the child carrying system 100 is made from a soft fabric without the bulky padding and various semi-rigid materials of conventional carriers, the child carrying system 100 is able to be folded up to a small stowage configuration, which is shown in FIG. 35. Finally, FIGS. 36-39 show detailed instructions for putting on and adjusting the child carrying system 100, as well as for folding the child carrying system 100 to the stowage configuration.

Use of the Child Carrying System

In various embodiments, the child carrying system includes a first, "3 to 6 months" indicia printed on the inside of the carrier portion 102, which is used to help a user configure the child carrying system for use with a small (e.g., 3 to 6 month old) child, and a second, "6 months and up" indicia to help a user configure the child carrying system for use with larger children (e.g., those that are older than 6 months old.

Figure 36A:
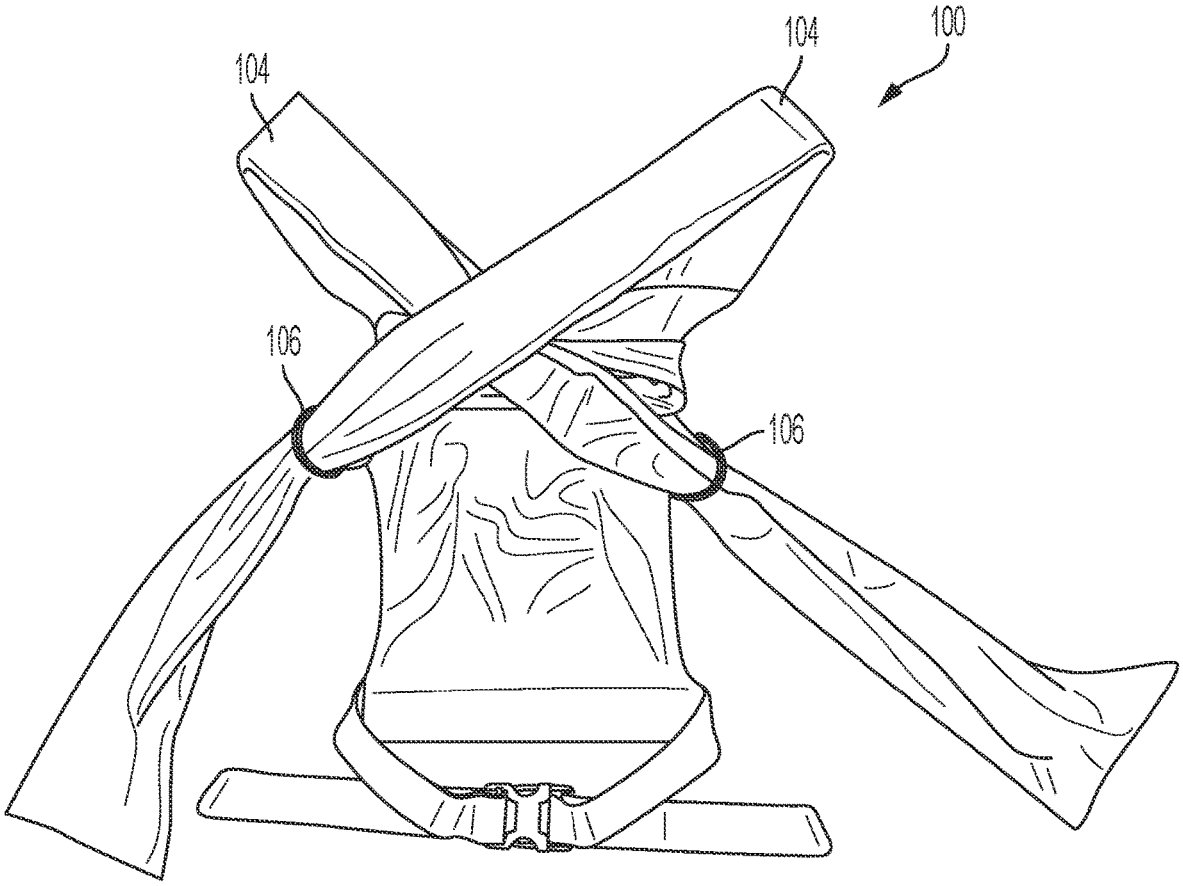
FIGS. 36A-36G, 37A-37G, and 38A-38G, and 39A-39E illustrate a process for wearing and stowing a child carrying system according to various embodiments herein.
Figure 36B:
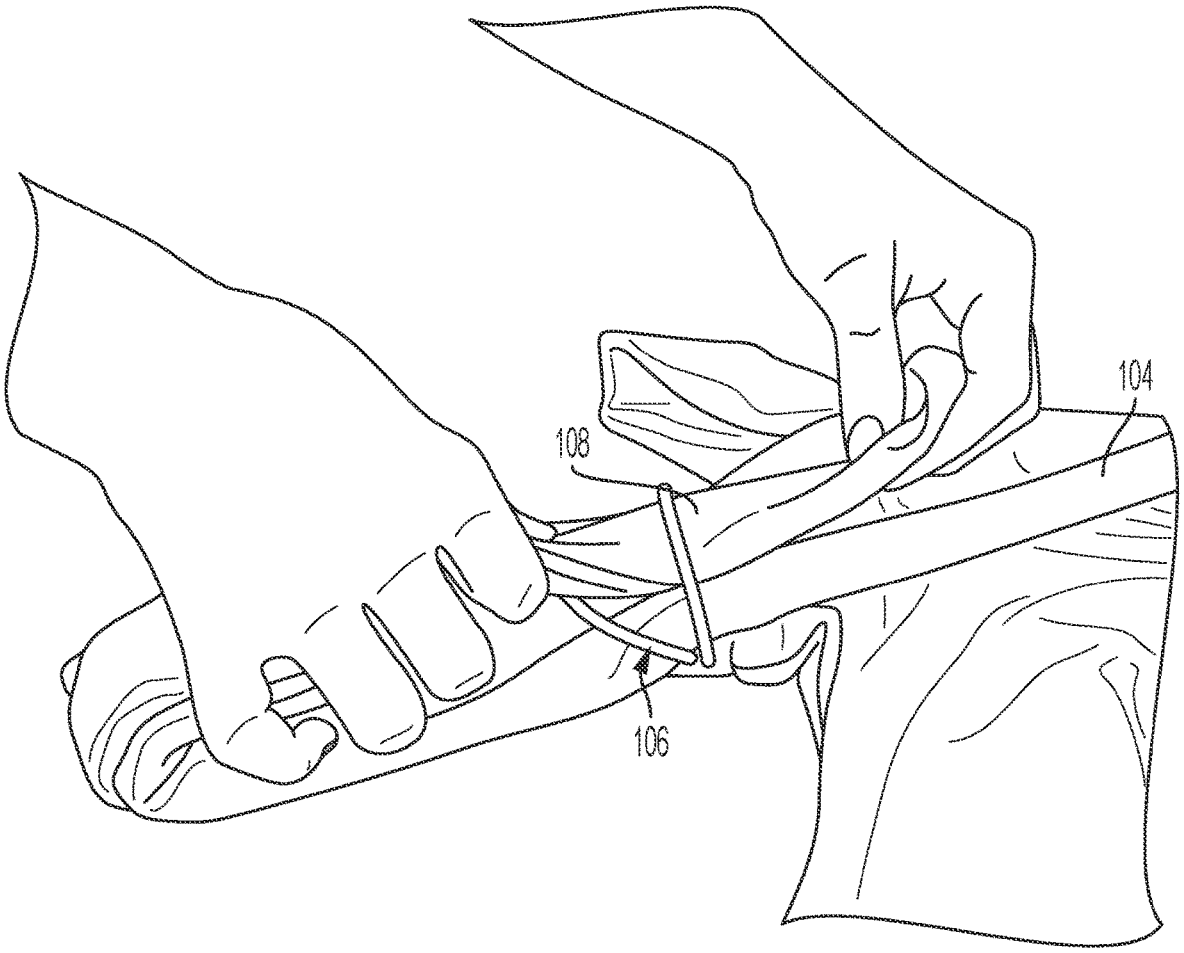

In particular embodiments, to prepare the child carrying system for front wear, a user first orients the child carrying system 100 so that the first, "3 to 6 months" indicia is facing them. The user then crosses the shoulder straps 104 and threads the distal end of each shoulder strap 104 through a fastener mechanism 114 on an opposite lateral side of the child carrying system 10 as the proximal end of the shoulder strap 104 as shown in FIG. 36A. In doing so, the user threads the distal end of each strap through both rings of each respective fastener mechanism 114 from the inside to the outside. The user then loops the strap back over the outside ring and under and through the inside ring (See FIGS. 36B and 36D). This serves to adjustably maintain each strap in place relative to the fastener mechanism so that the shoulder straps are maintained at the length desired by the user.

Figure 36C:
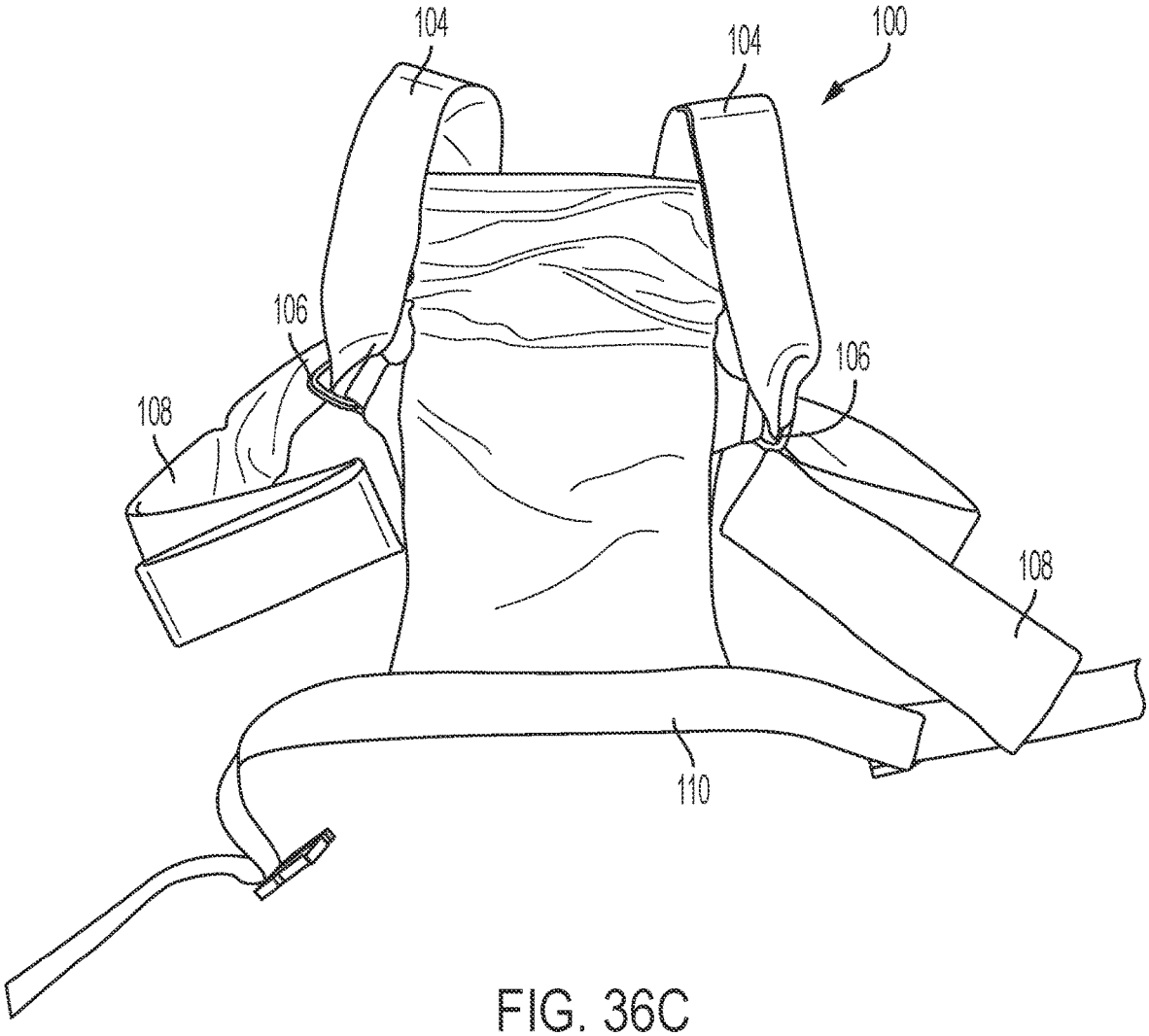
Figure 36D:
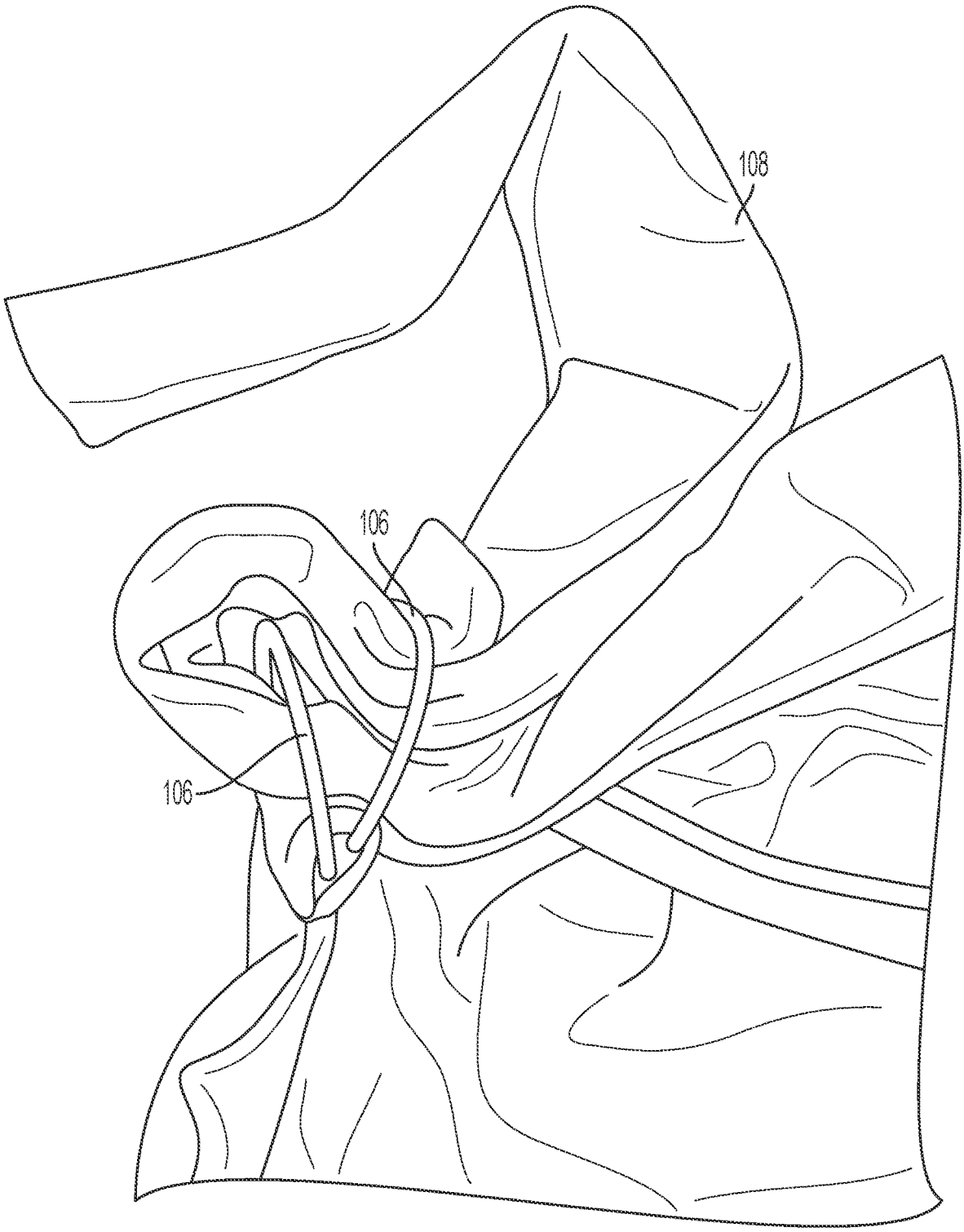

To prepare the child carrying system for back wear, in various embodiments, the user first orients the child carrying system 100 so that the first, "3 to 6 months" label is facing the user. The user then threads the distal end of each shoulder strap 104 through a fastener mechanism 114 on the same lateral side of the child carrying system as the proximal end of the shoulder strap 104, as shown in FIG. 36C. In doing so, the user threads the distal end of each strap through both rings of each respective fastener mechanism 114 from the inside to the outside. The user then loops the strap back over the outside ring and under and through the inside ring. This serves to adjustably maintain each strap in place relative to the fastener mechanism so that the shoulder straps are maintained at the length desired by the user. It should be noted that, rather than making an X with the straps for front wear, the user is creating a substantially vertical strap arrangement, like those of a backpack.

In various embodiments, the child carrying system in configured to allow the user to selectively adjust the operable length of the carrier portion 102 by wrapping a lower portion of the carrier portion 102 around the waist belt 110 before fastening the waist belt 110 around the user's waist. This may be useful, for example, when using the child carrying system 100 to carry younger and/or shorter children.

Figure 36E:
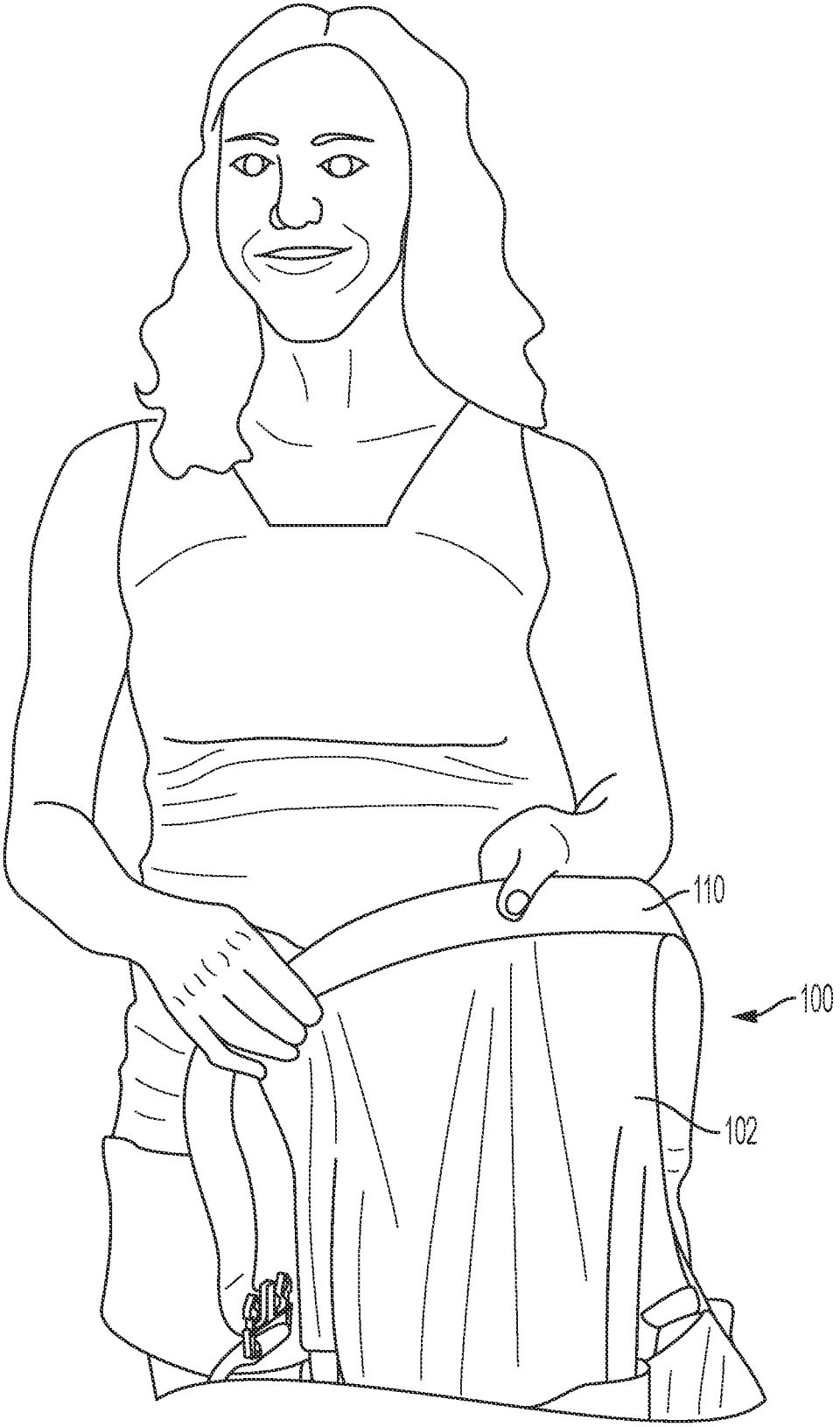
Figure 36F:
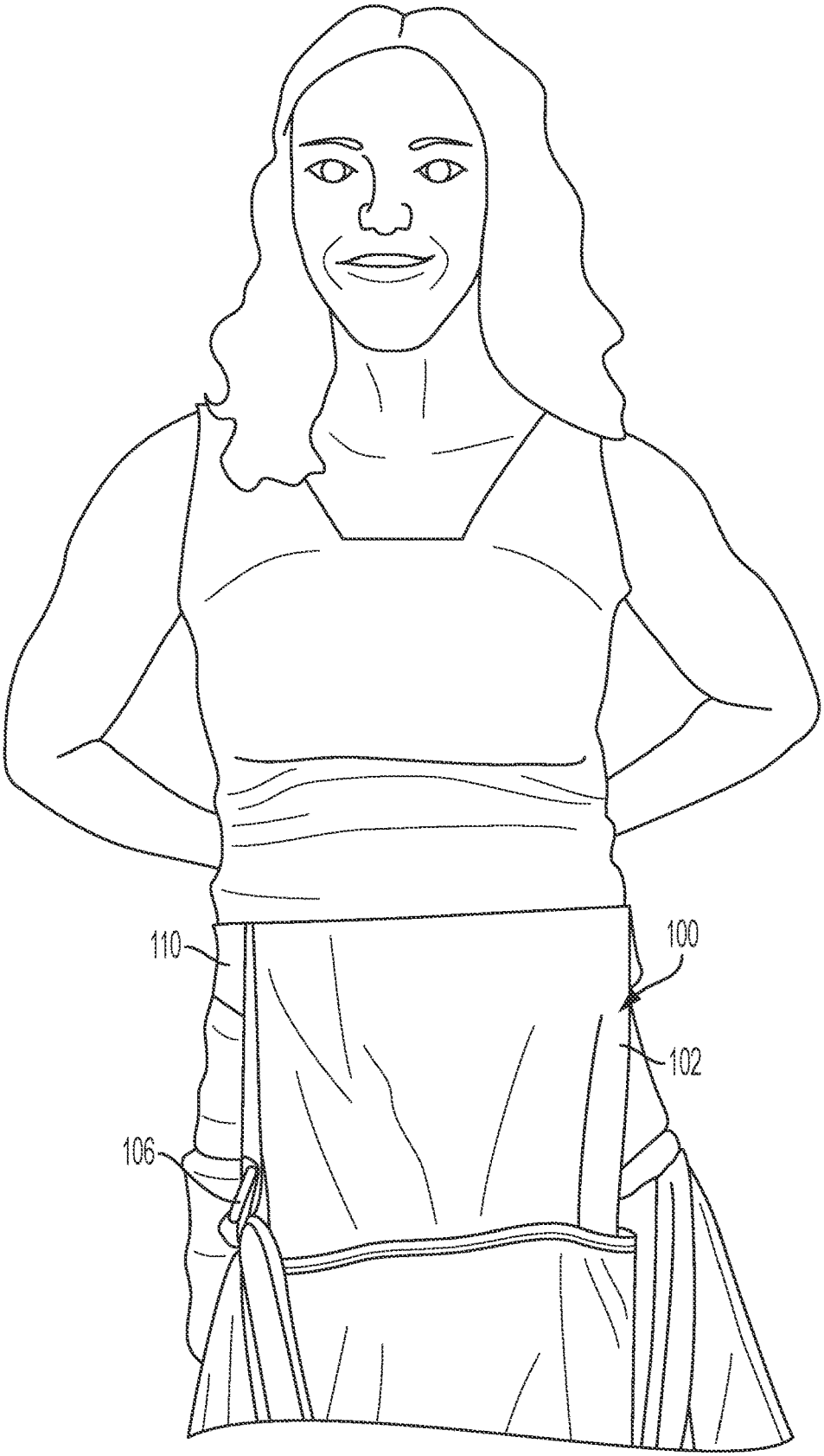
Figure 36G:
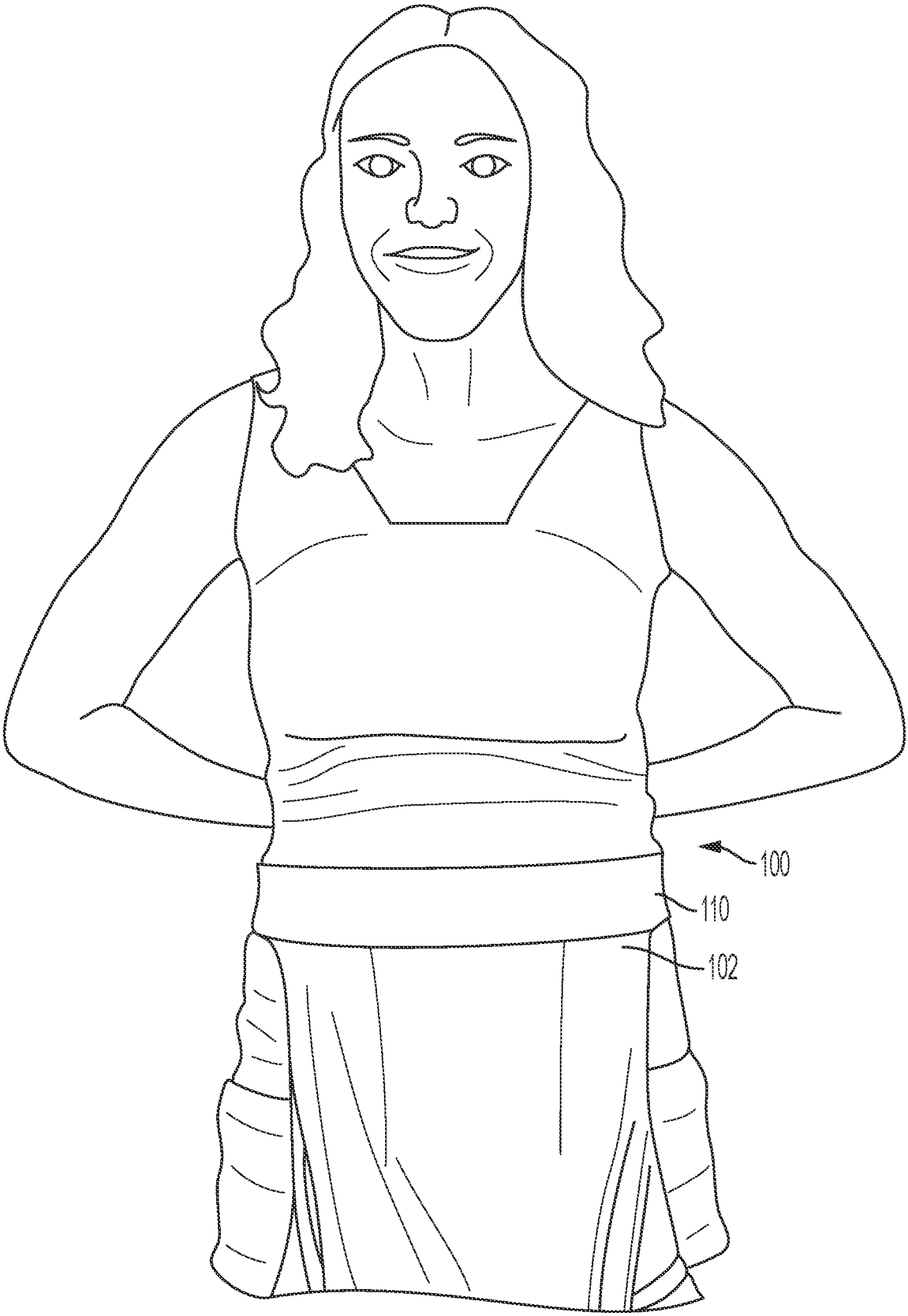

For example, in one embodiment, to use the child carrying system 100 with a child that is 3-6 months old, the user first shortens the carrier portion 102 by wrapping the bottom of the carrier portion around the waist belt 110 twice before wrapping the waist belt 110 around the user's waist and fastening it together (e.g., like a belt)—See FIGS. 36E and 36F. For larger children (e.g., those over 6 months old), in various embodiments, the carrier portion 102 doesn't need to be shortened. The user simply wraps the waist belt 110 around their waist and fastens it together (See FIG. 36G).

Figure 37A:
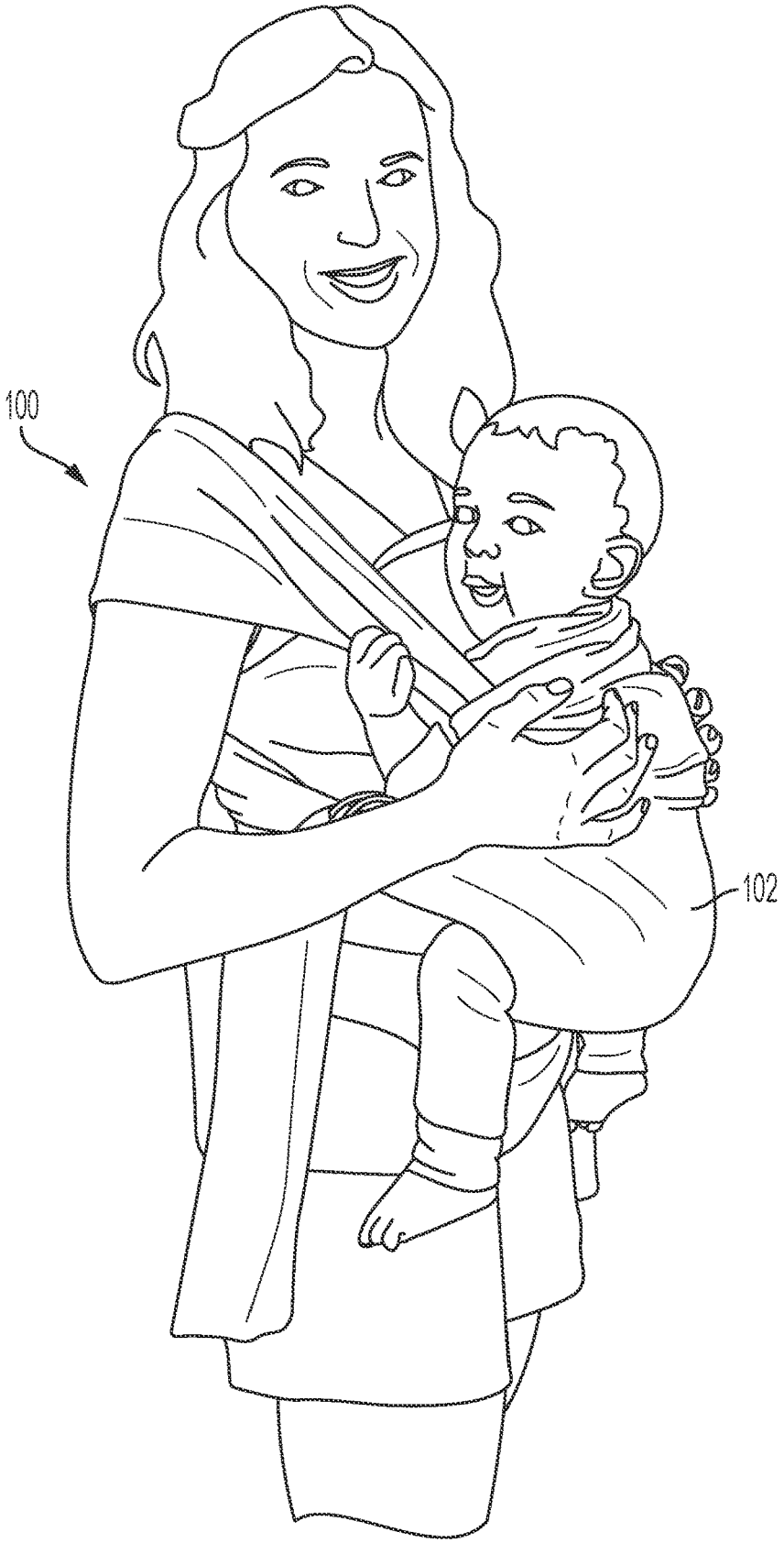
Figure 37B:
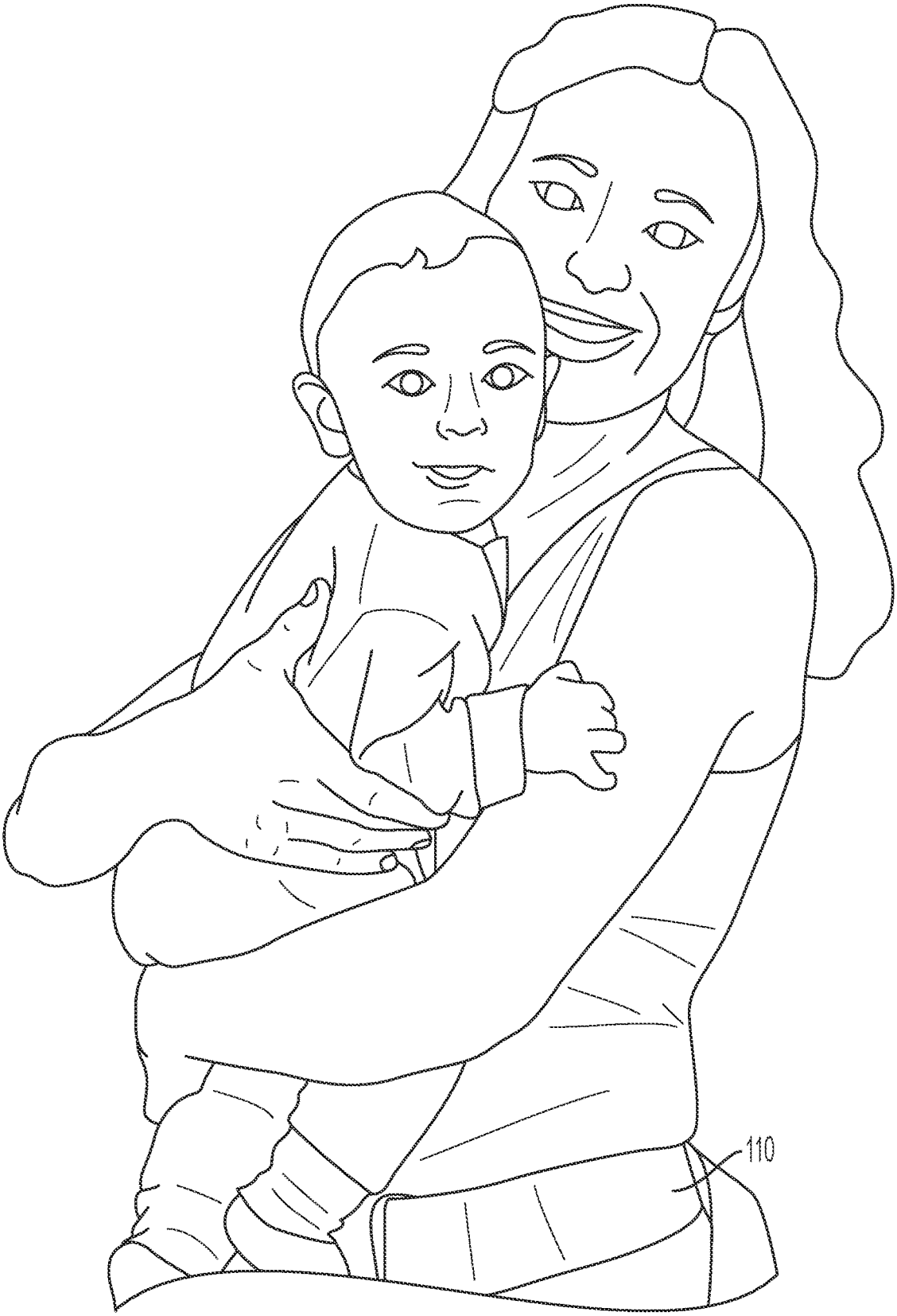
Figure 37C:
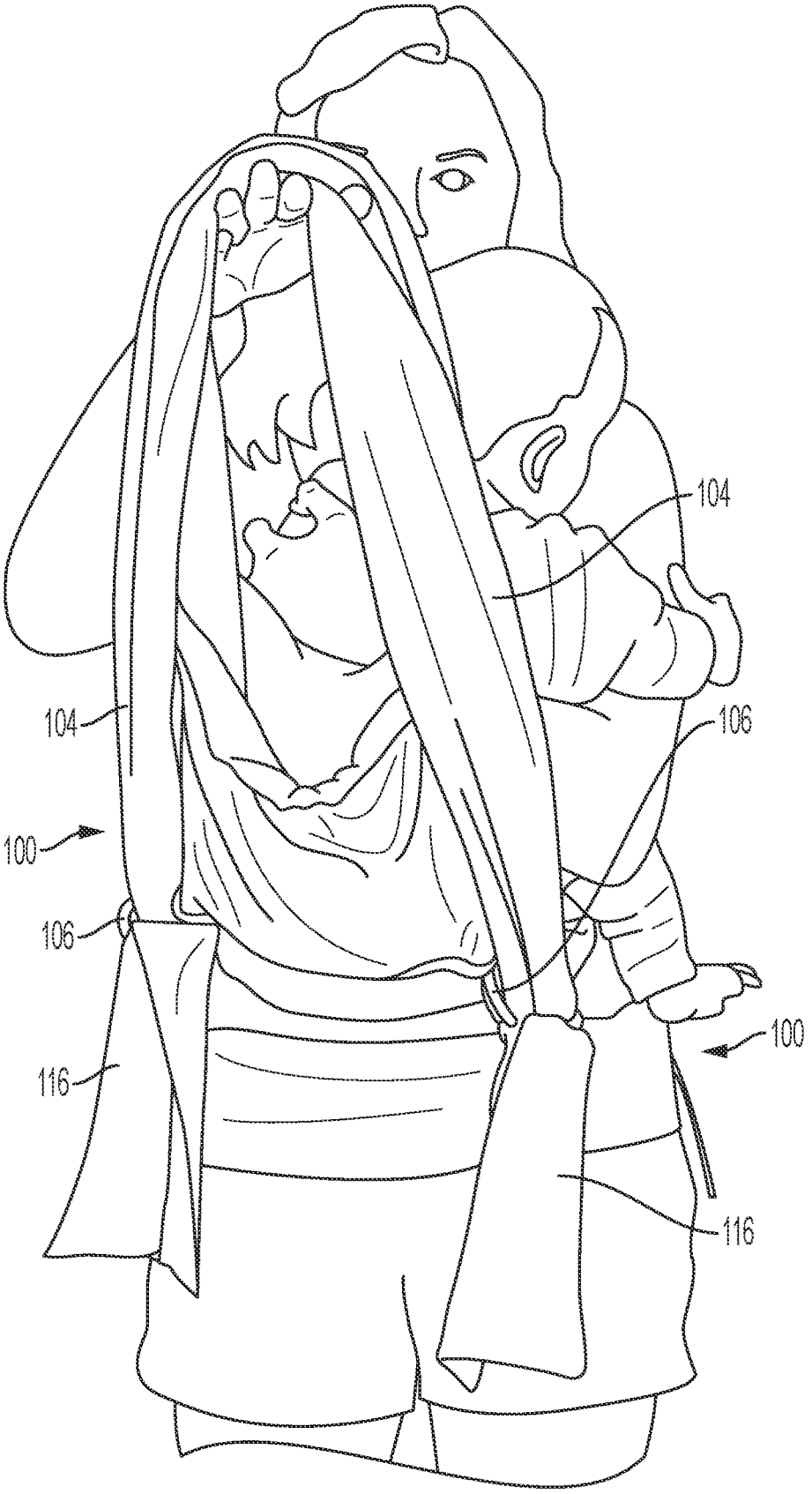
Figure 37D:
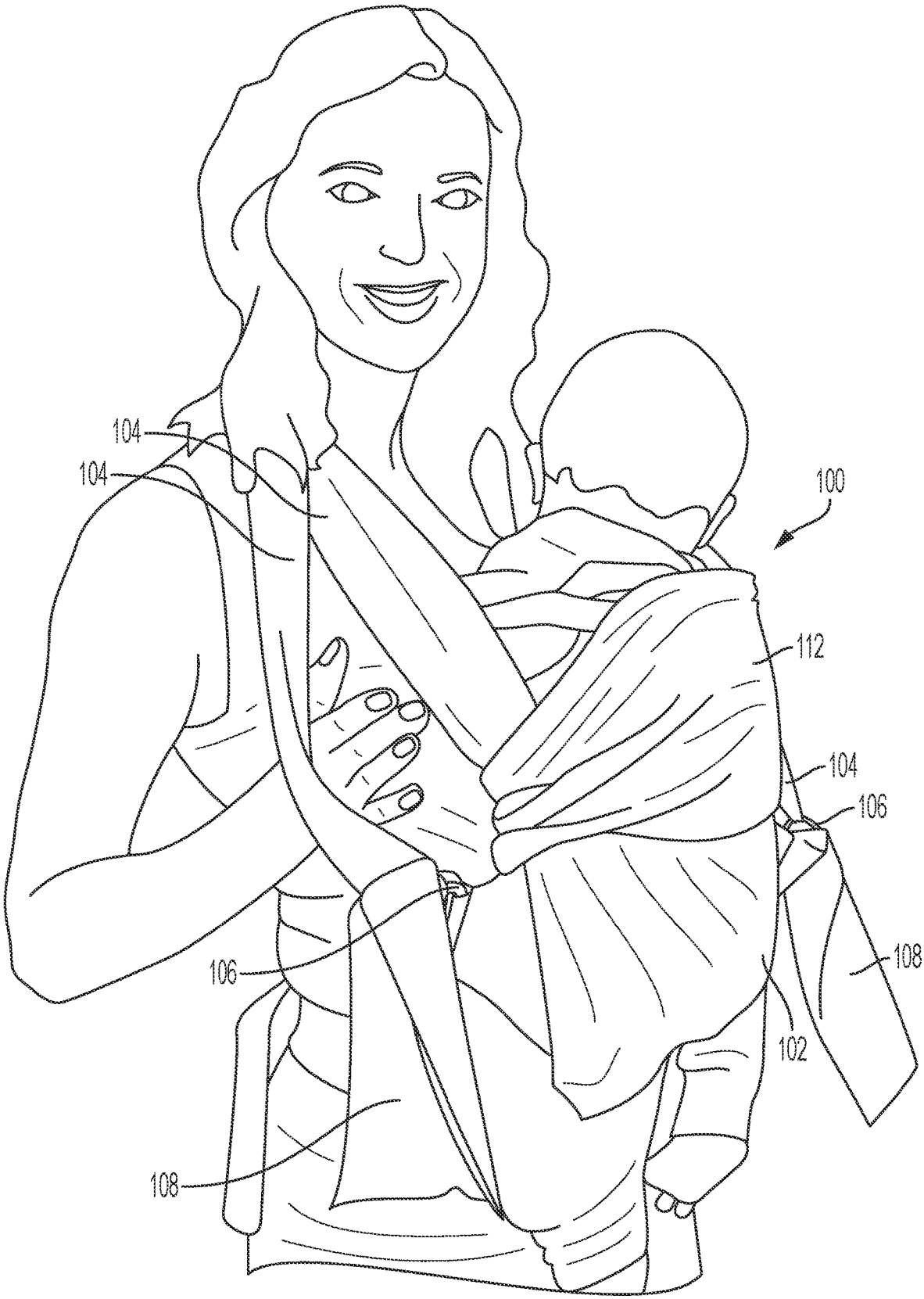
Figure 37E:
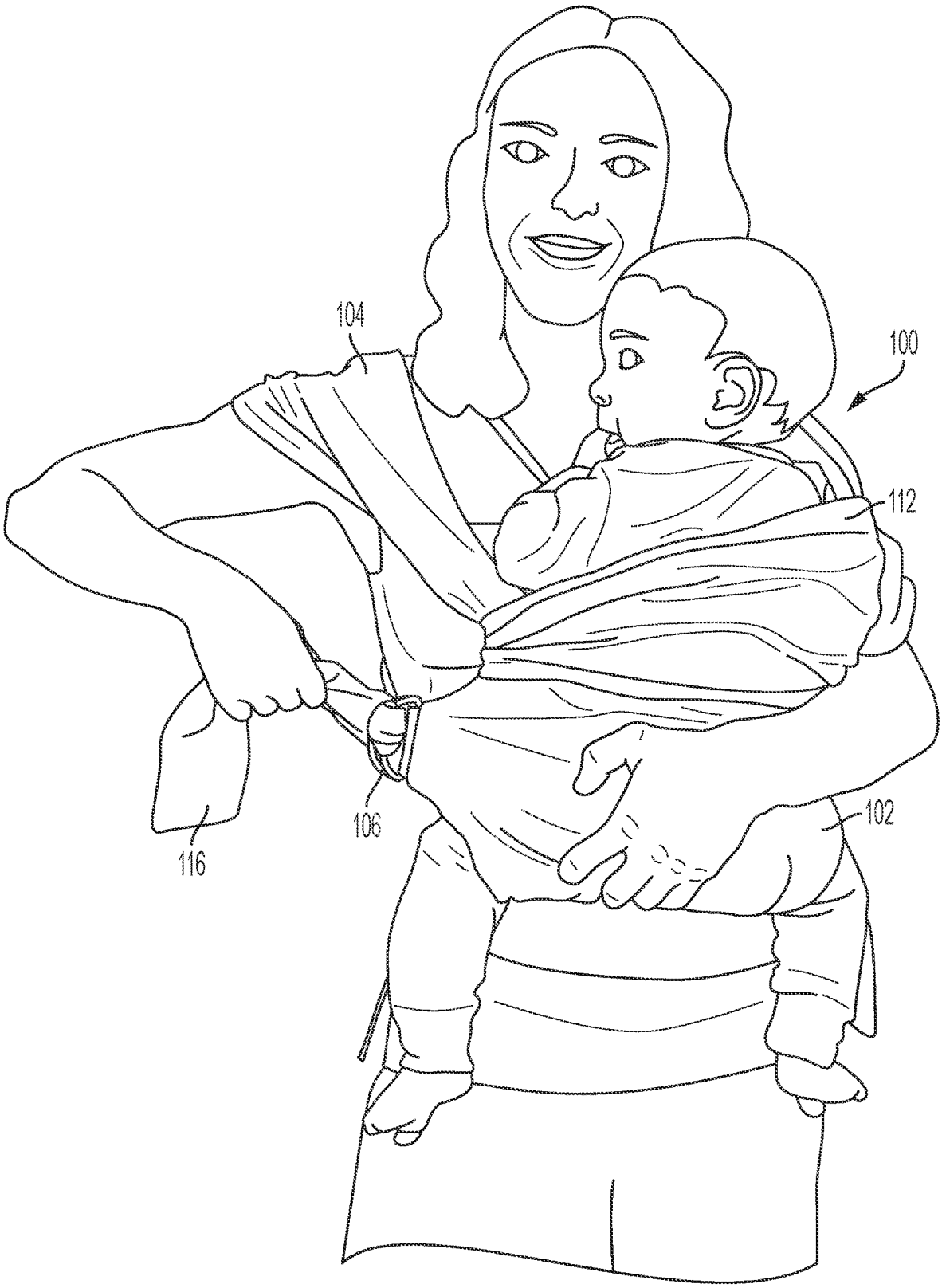

To front carry a child, a user may follow the following steps, which are illustrated in FIGS. 37A-37F. First, as shown in FIG. 37B, the user wraps the waist belt around their waist and attaches it so that the buckle is on their back. In various embodiments, the higher the user places the waist belt on their body, the higher the child will be. Next, as shown in FIG. 37C, while the carrier is hanging in front of the user, the user holds the child against their chest. The user then lifts both shoulder straps up and over their head so the straps rest behind the user's neck. Next, as shown in FIG. 37D, the user inserts their left arm between the two fabric straps on the user's left. The user then inserts their right arm between the two fabric straps on their right. On both sides, the strap fabric going into the fastener mechanism's rings should be the farthest outside and the strap fabric going to the pouch should be on the inside (See FIG. 37E).

Figure 37F:
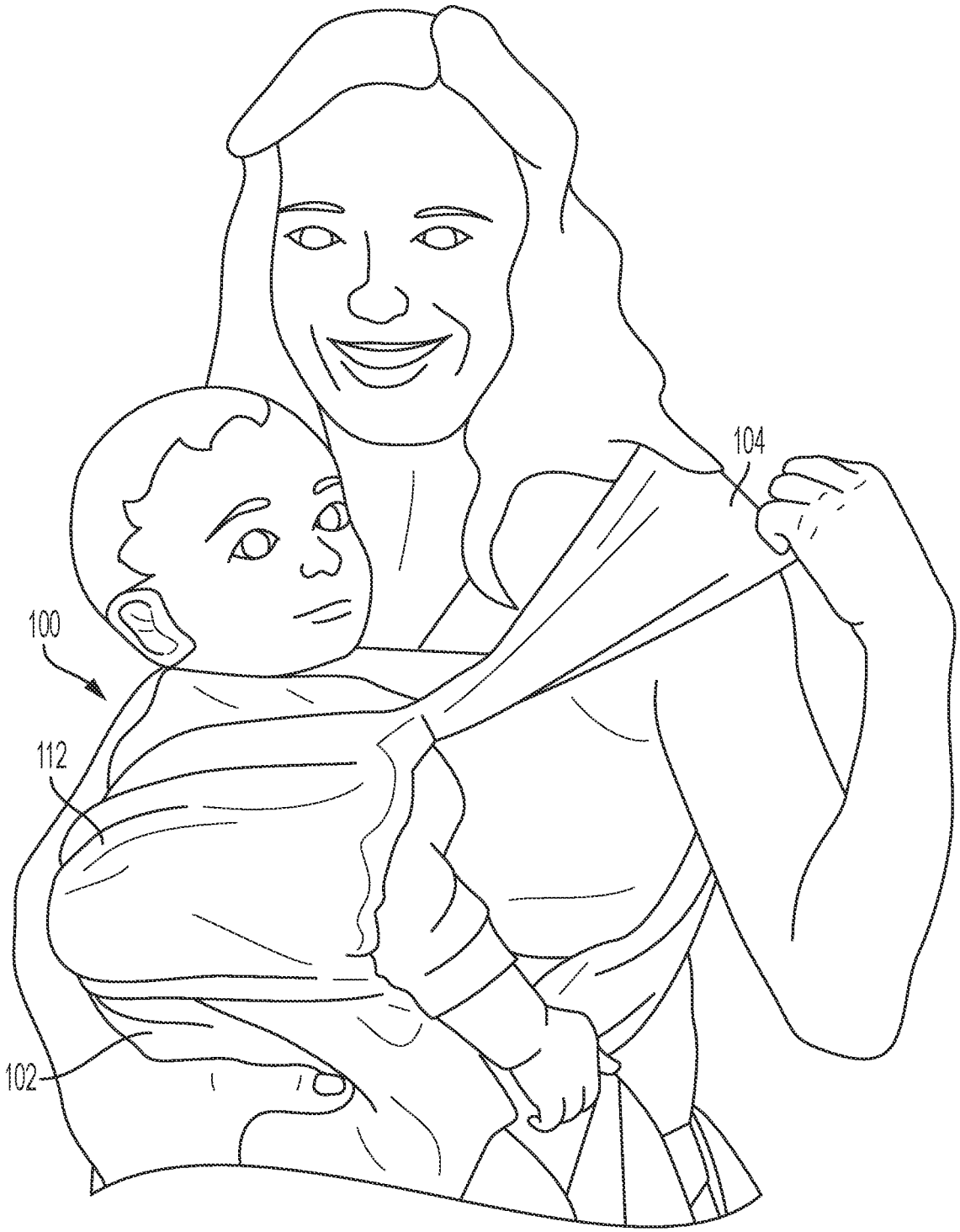
Figure 37G:
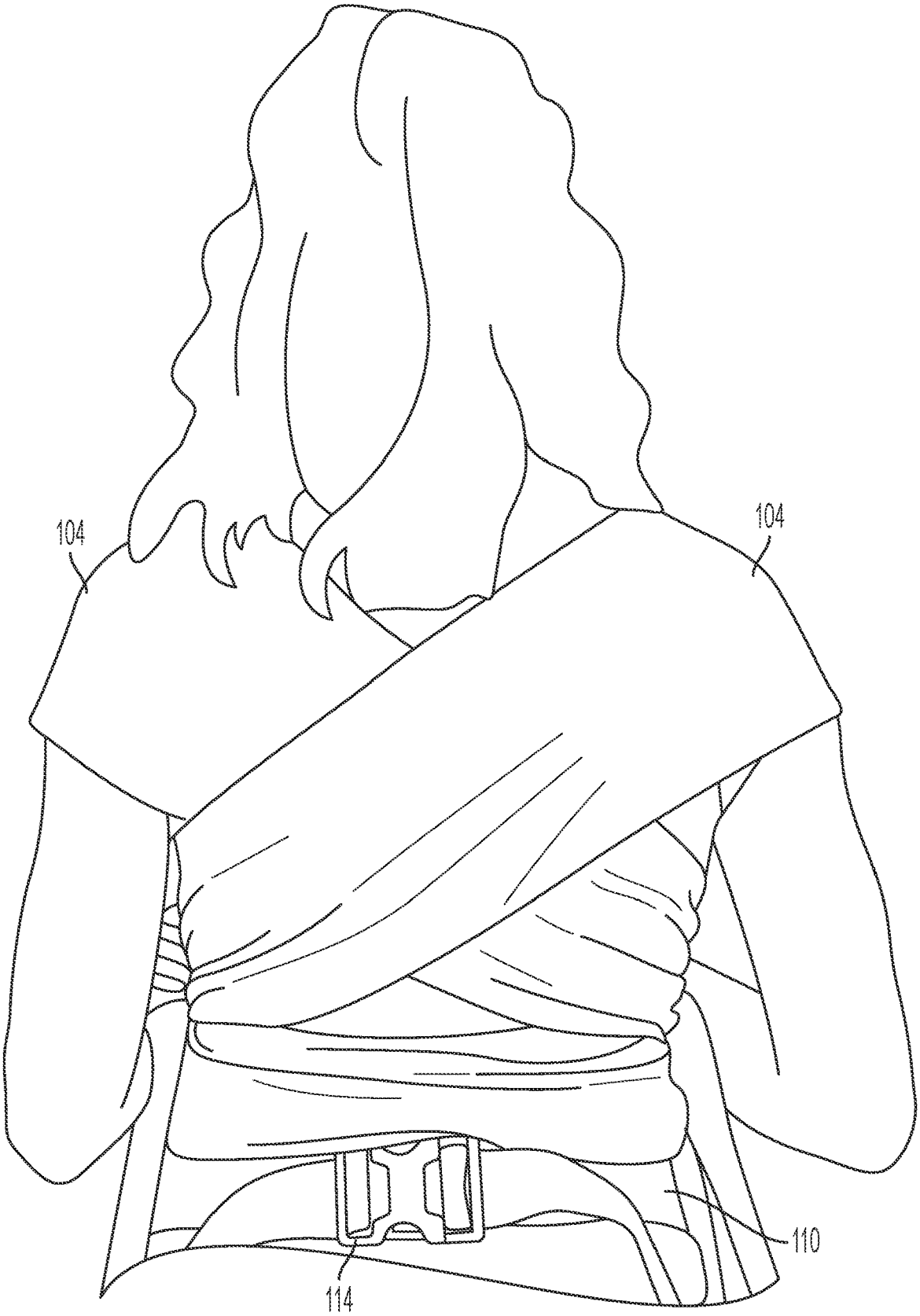

Next, the user adjusts the carrier portion to position the child where the user wishes them to be held adjacent the user's body). The user then pulls the distal end "tail" of each should strap 104 at each fastener mechanism 114 toward the user's back to tighten the carrier portion 102 and to secure the child against the user's body (See FIG. 37E). It is noted that the user can pull either shoulder strap 104 down and across their back towards the fastener mechanism 114 first, and then pull the strap tail to tighten the shoulder strap 104 in place. This method makes tightening the straps easier. Finally, as shown in FIG. 37F, the user may optionally spread the fabric of the shoulder straps 104 across their respective shoulder to increase comfort by distributing the child's weight more evenly across the user's body. For reference, FIG. 37G shows the shoulder straps 104 in a crossed arrangement across the user's back after the fabric straps 104 have been spread out across the user's shoulders.

Figure 38A:
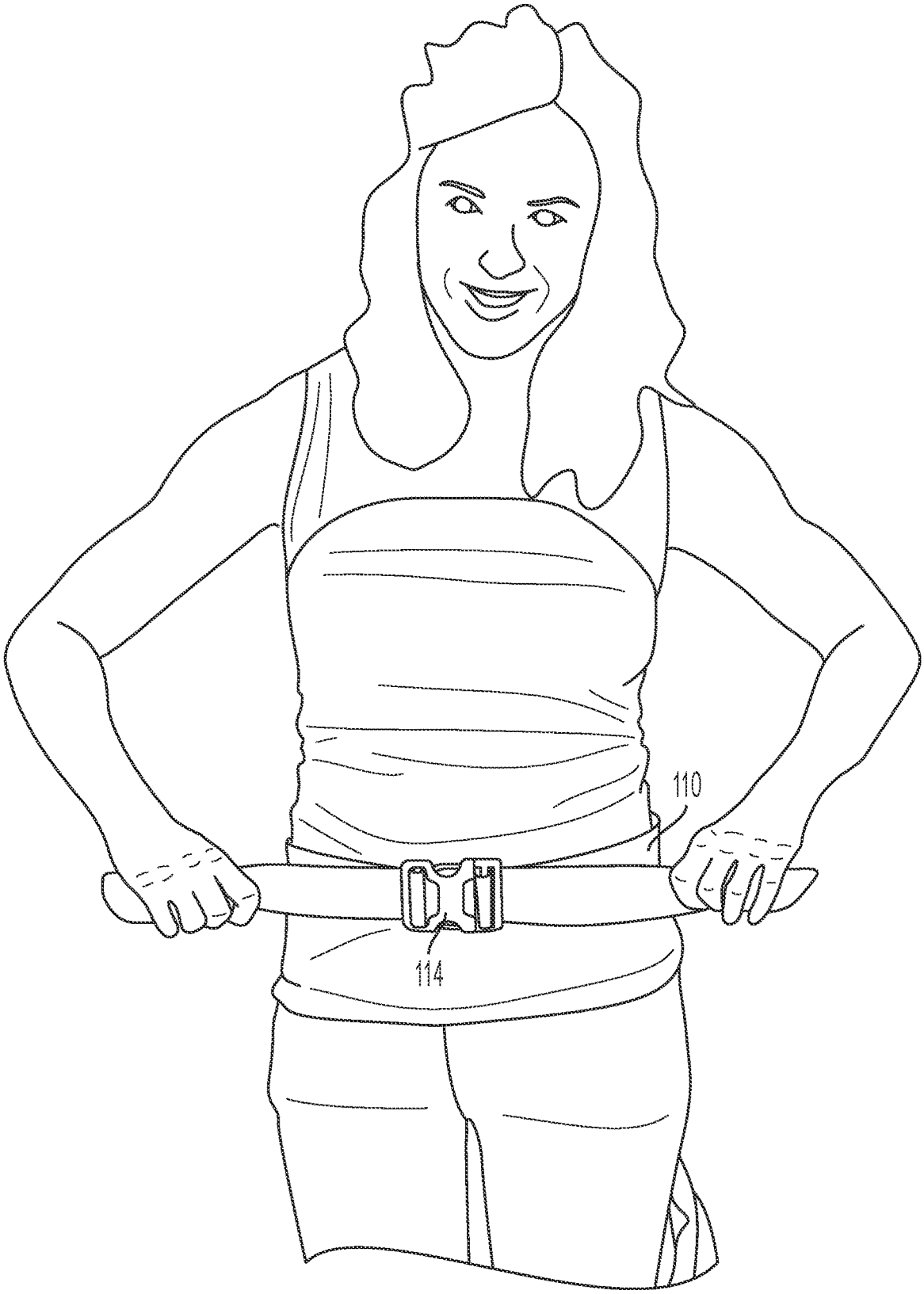
Figure 38B:
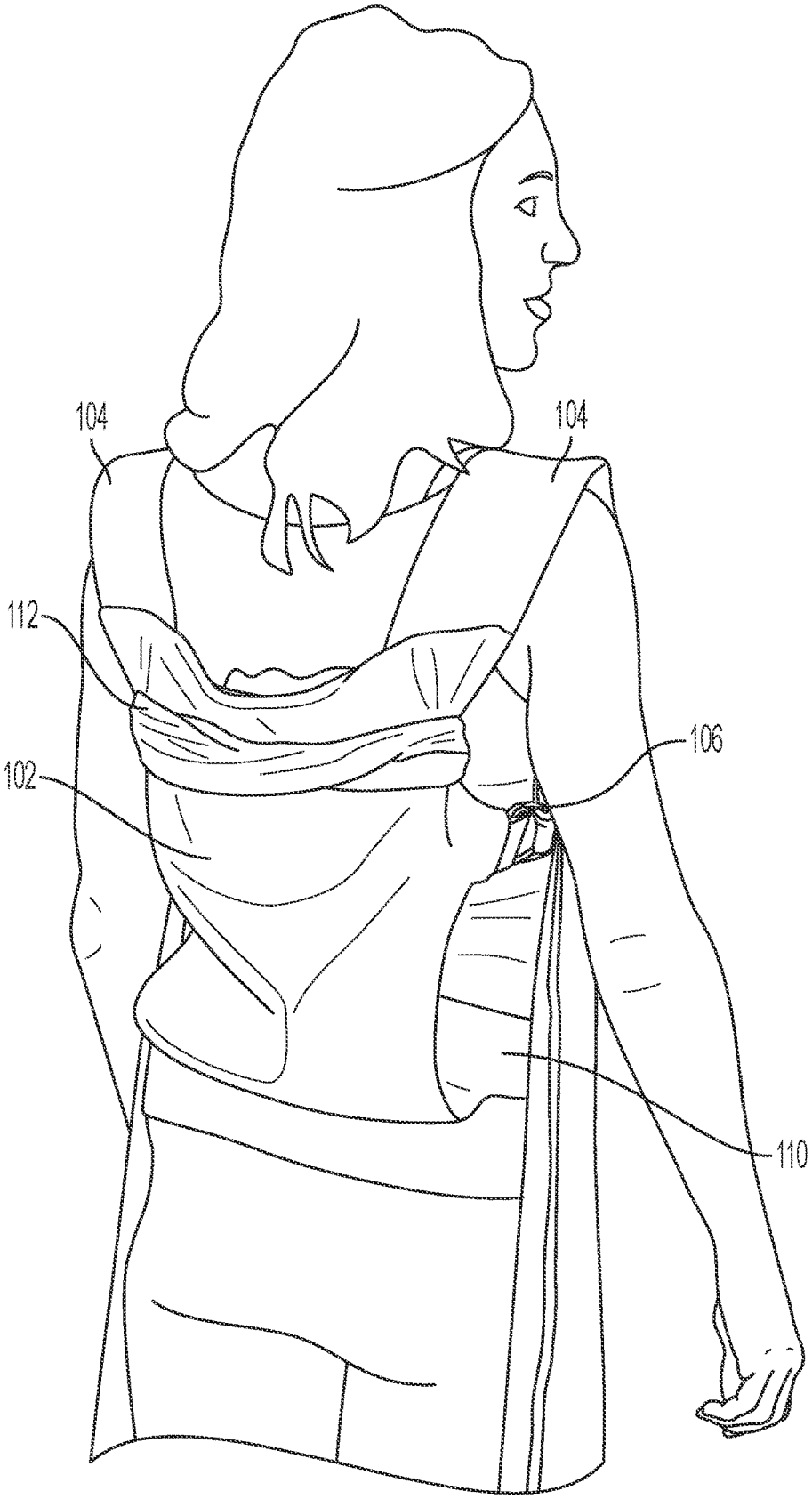
Figure 38C:
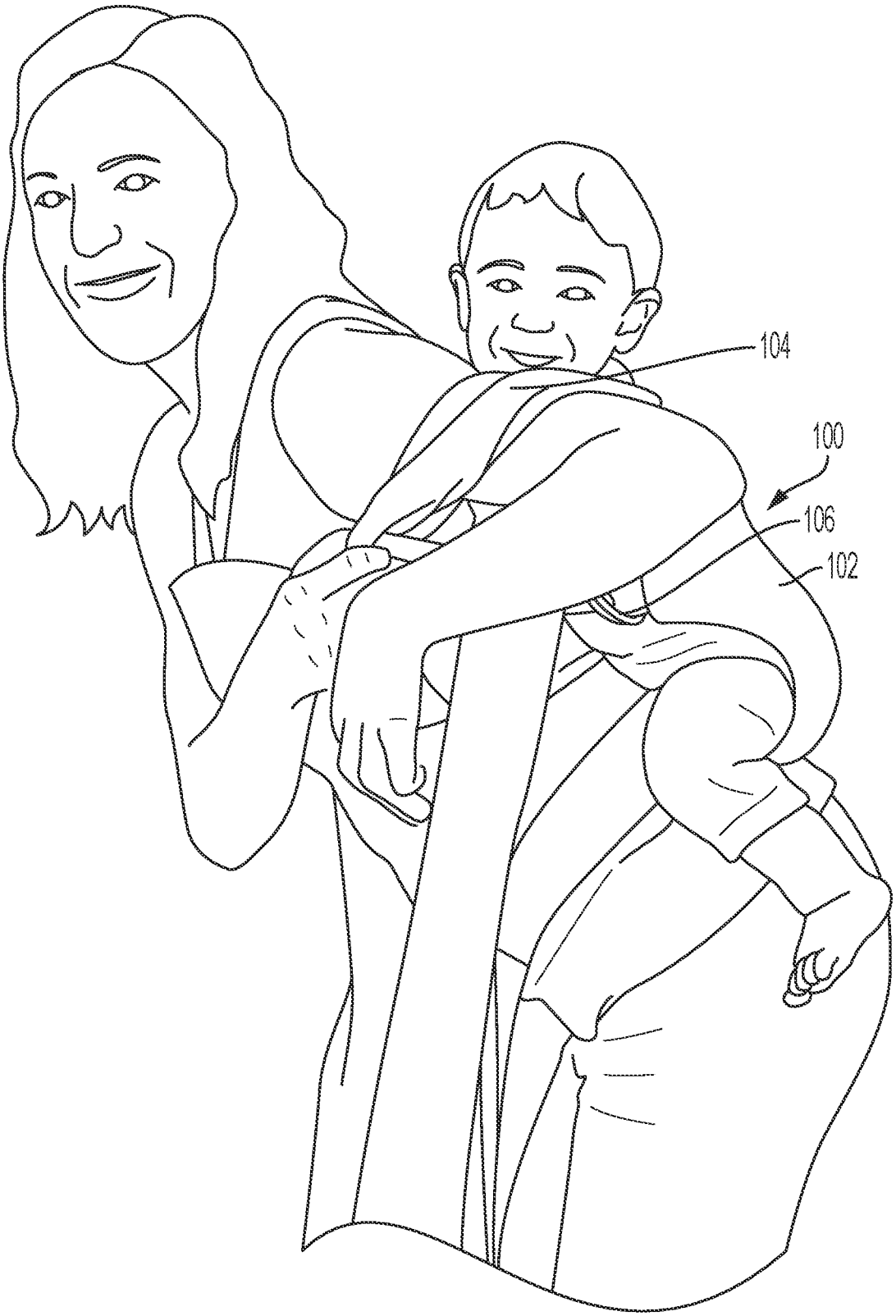
Figure 38D:
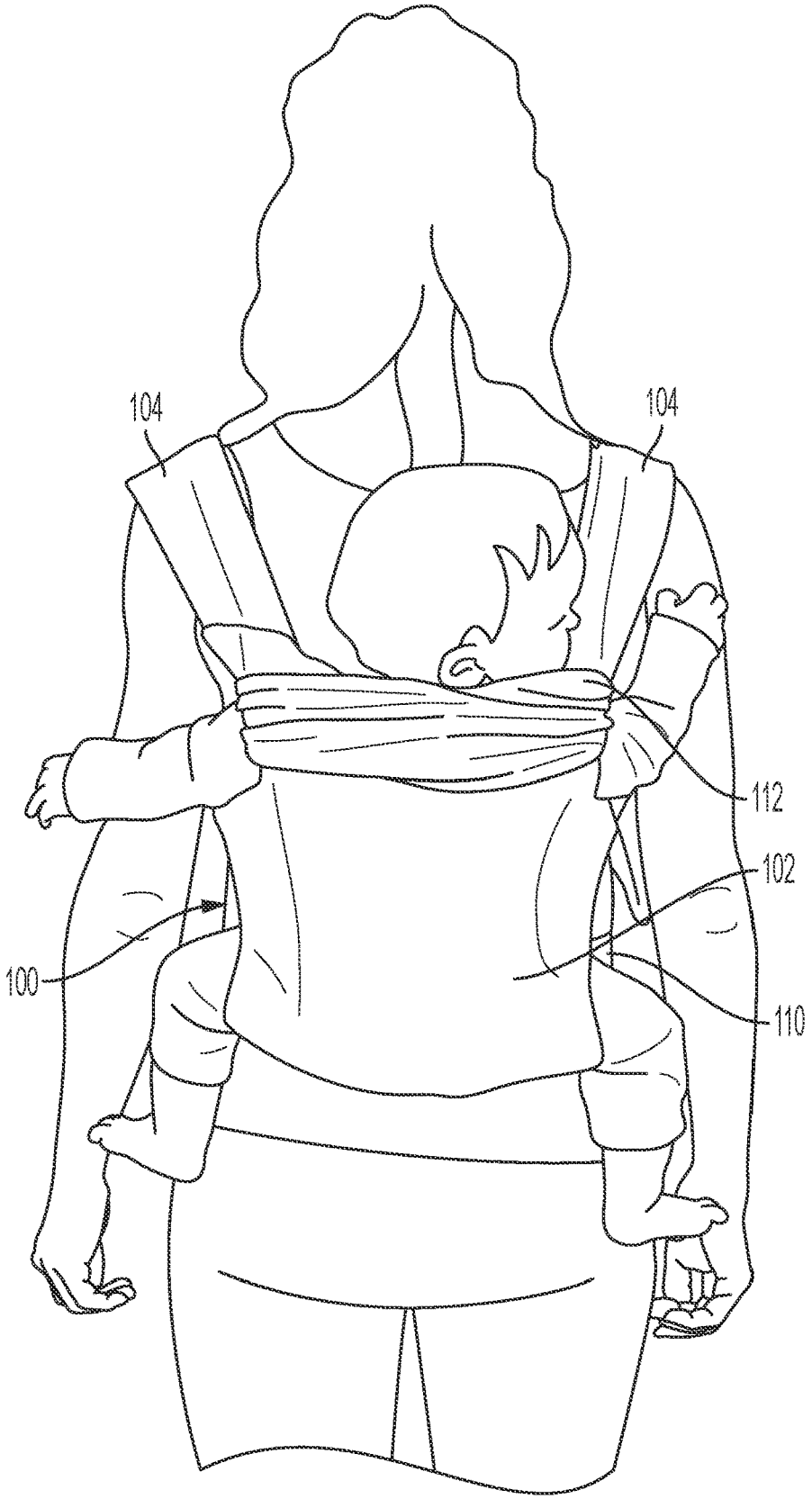
Figure 38E:
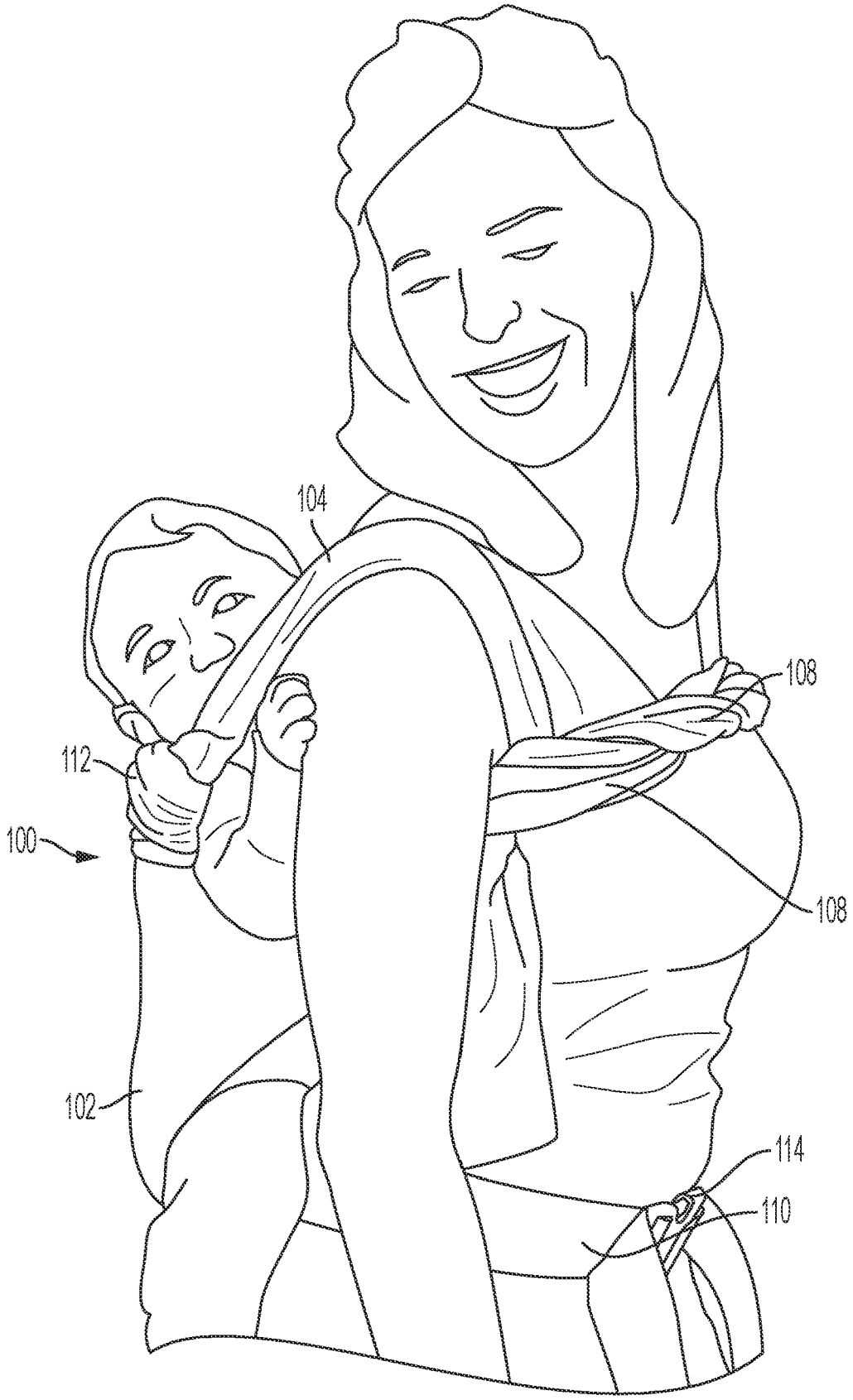
Figure 38F:
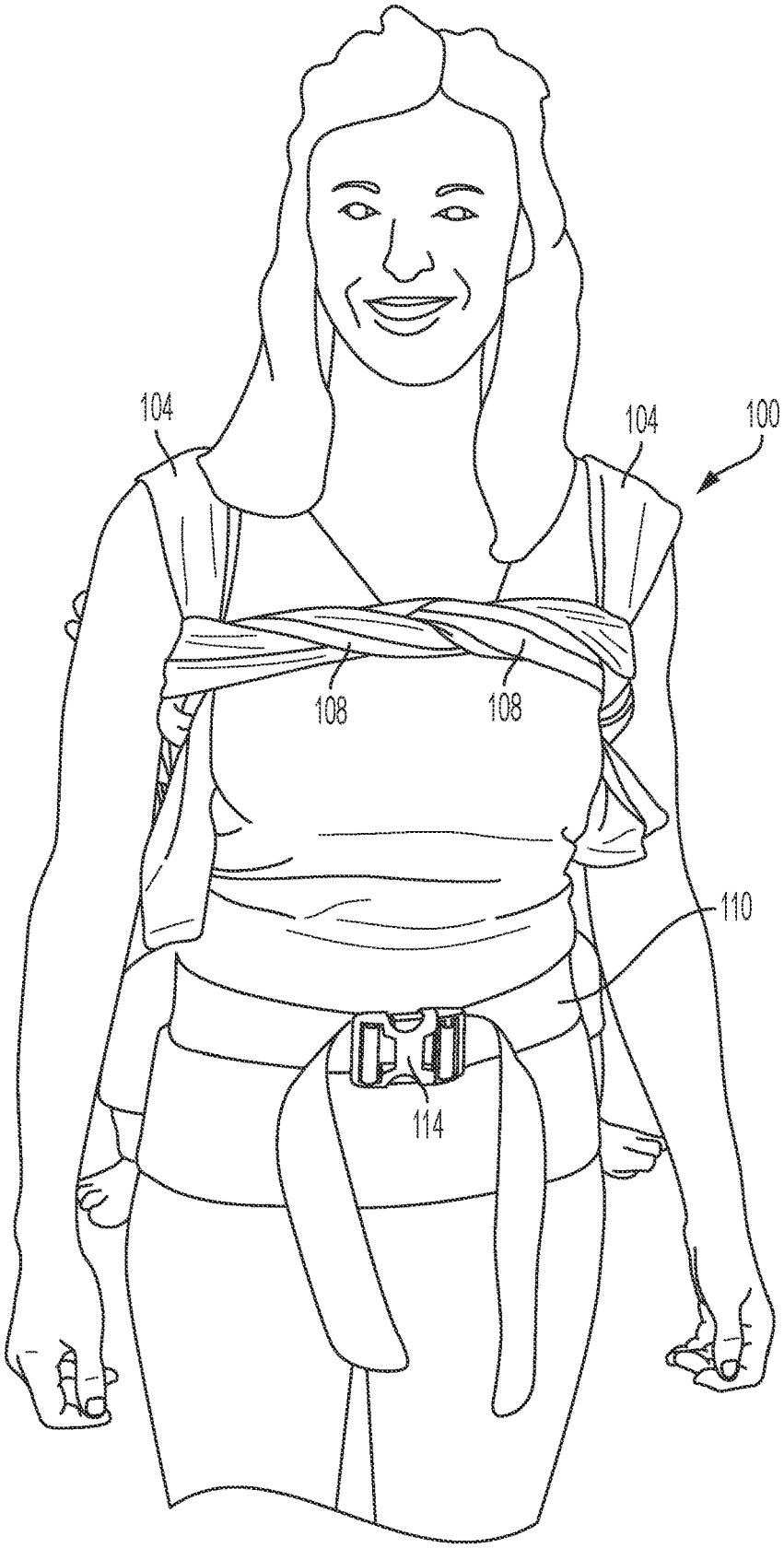
Figure 38G:
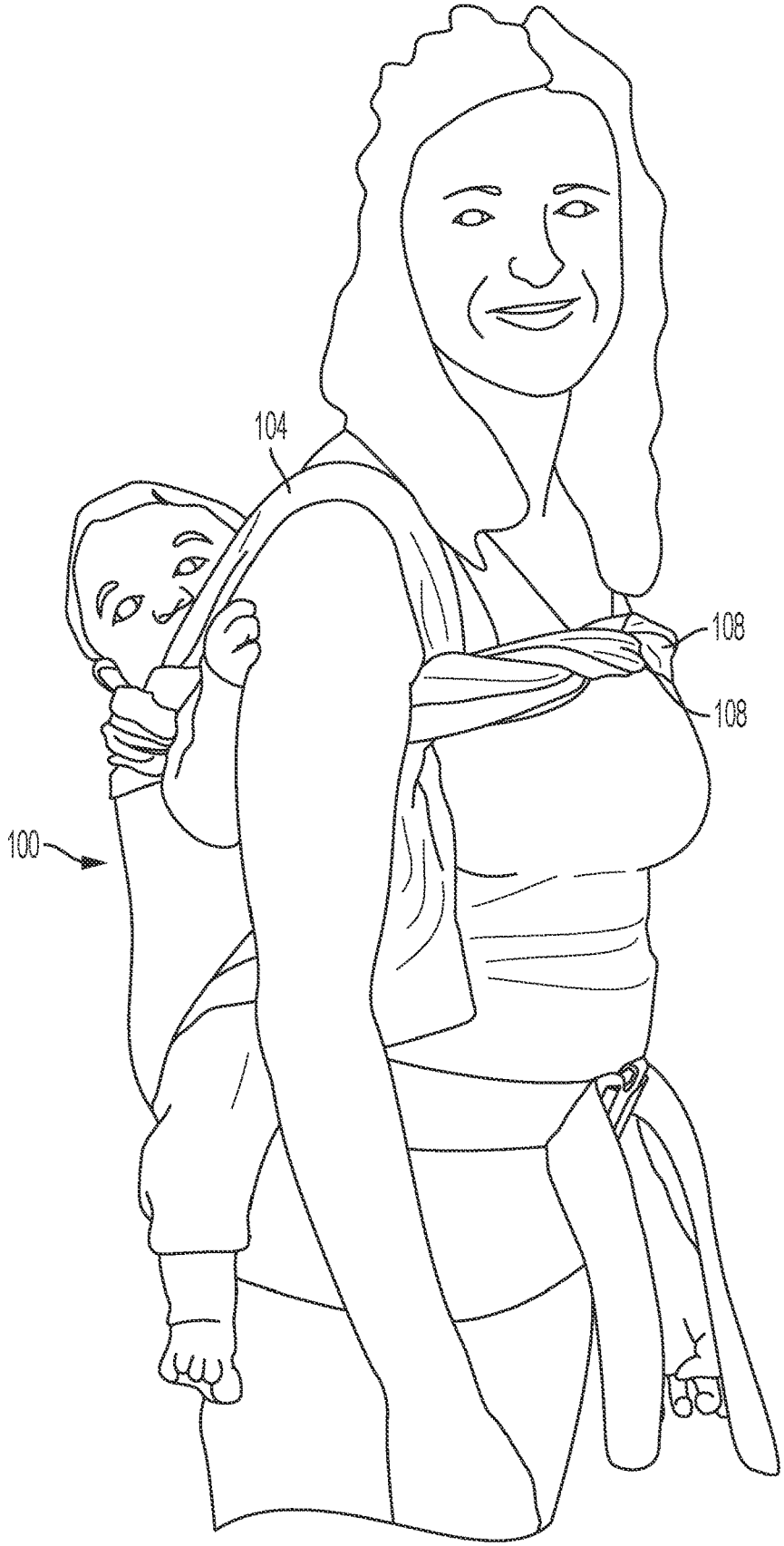

To back carry a child, the user may follow the following steps. First, the user wraps the waist belt around their waist and attaches it so that the buckle is on their front (e.g., adjacent their navel)—See FIG. 38A. Next, as shown in FIG. 38B, the user places the shoulder straps 104 over the user's shoulders and tightens the shoulder straps 104 leaving only a small amount of slack. The user should secure the distal ends of the shoulder straps 104 through the respective adjustment mechanisms 106 before putting the baby into the child carrying system 100. Next, as shown in FIG. 38C, the user leans forward at the waist and places and balances the child on their back with the child's stomach on the user's back. While the user keeps a first arm on the child, the user threads their second, free arm through the first shoulder strap 104, which is adjacent the user's second, free arm. The user then switches arms holding the child and continues holding the child with their second arm (which is already through a strap) while the user threads their first arm through the second shoulder strap 104. During this process, the user should optionally check to make sure the baby's bottom is centered in the pouch with one leg on either side of the pouch. The user should then then check the child's positioning and adjust the carrier accordingly. When in the correct position, the child's shoulders should, in various embodiments, be covered by the pouch. Once the child is positioned correctly, the users tightens the shoulder straps 104 by pulling the distal ends of the shoulder straps 104 forward until, as shown in FIGS. 38D-38E and 38G, the child carrying system 100 is comfortable and snug. The user may then optionally spread the fabric of the shoulder straps 104 across their shoulders to distribute the child's weight across the shoulders or simply leave the fabric narrow depending on the user's preference. The user may then take any suitable action with the distal "tail" ends of the shoulder straps, including without limitation the following three options. The first option is to simply leave the tail ends of the shoulder straps 104 hanging at the user's sides. A second option is to tie the tails together under the user's chest (e.g., bust). A final option is to tie the tails together above the user's chest/bust as shown in FIG. 38F.

It is noted that, in various embodiments, the head support 112 has two layers. It may be advantageous to use both layers to support the child's head while they are sleeping. As mentioned above, in various embodiments, the head support is slideably attached on each lateral side to a respective one of the fabric shoulder straps 104. As a result, in such embodiments, it is possible to raise and lower each side of the head support independently. For example, the user may raise the left side of the head support into a fully extended position and only partially raise the right side of the head support so that the back side of the child's head is fully supported, but so that the child's face is visible while the child is sleeping (See FIG. 39A). It should be understood that the user may alternatively orient the head support so that: (1) both sides of the head support are fully extended; (2) both sides of the head support are fully retracted (e.g., so that the child's head is not supported by the head support and the child has freedom to move their head without restriction—See FIGS. 38G and 39B); and/or (3) the left and right sides, are, respectively, in any other suitable extended or retracted position.

To remove the child, the user may first loosen one or more of the shoulder straps 104 from the respective fastener mechanisms 114. The user may do this, for example, by pushing the two rings of the fastener mechanism 114 forward with one hand while pulling out some fabric, creating slack, with the other. The user then simply reverses the steps of how they put the baby on. For example, for front wear, the user may lift the fabric shoulder straps 104 back over the baby's head and the user's head. For back wear, the user balances and supports the child on the user's back while the user takes their arms out of the fabric shoulder straps 104. Finally, the user releases the buckle of the waist belt 110 and stows the unit for next time.

Figure 39A:
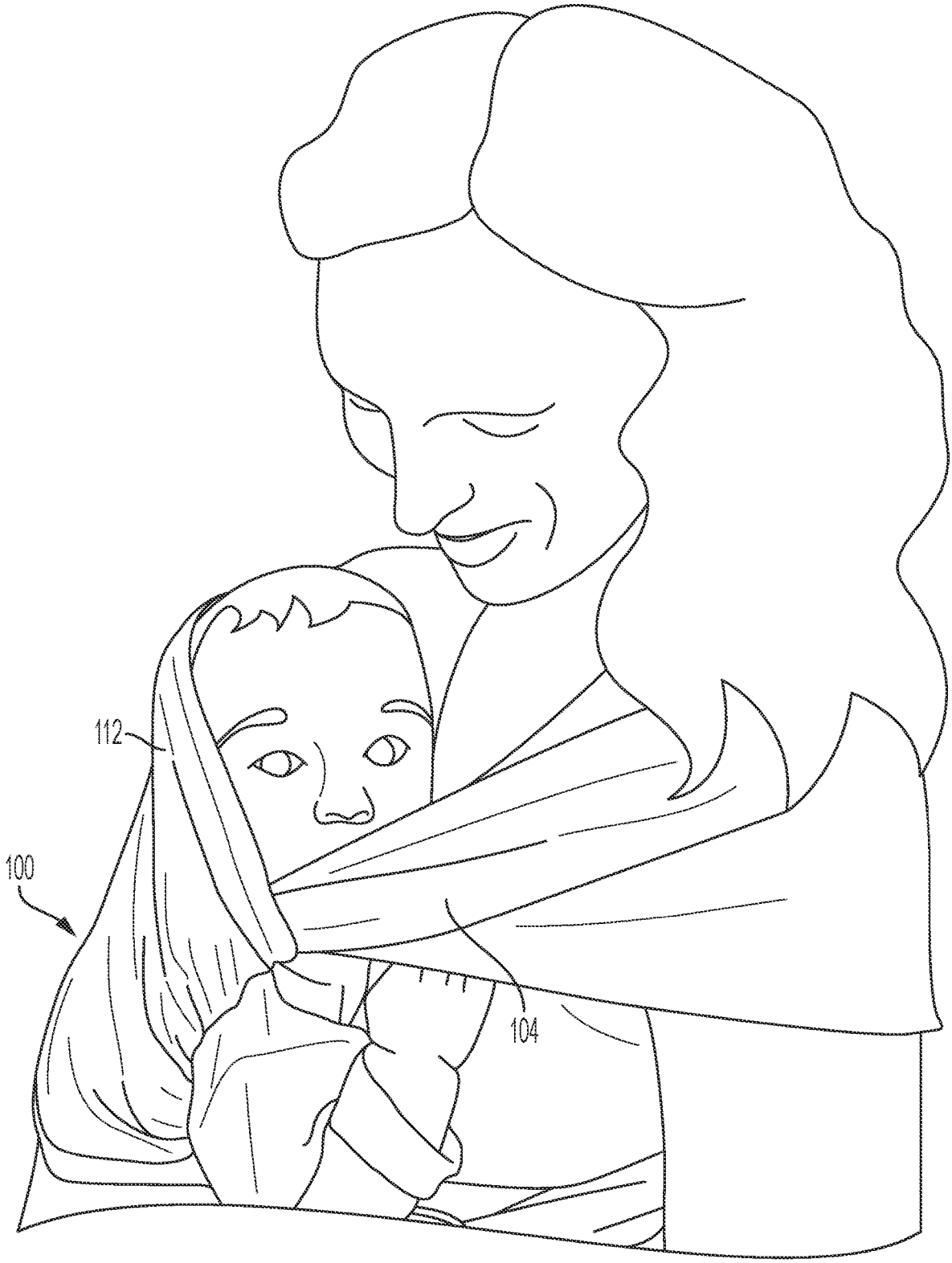
Figure 39B:
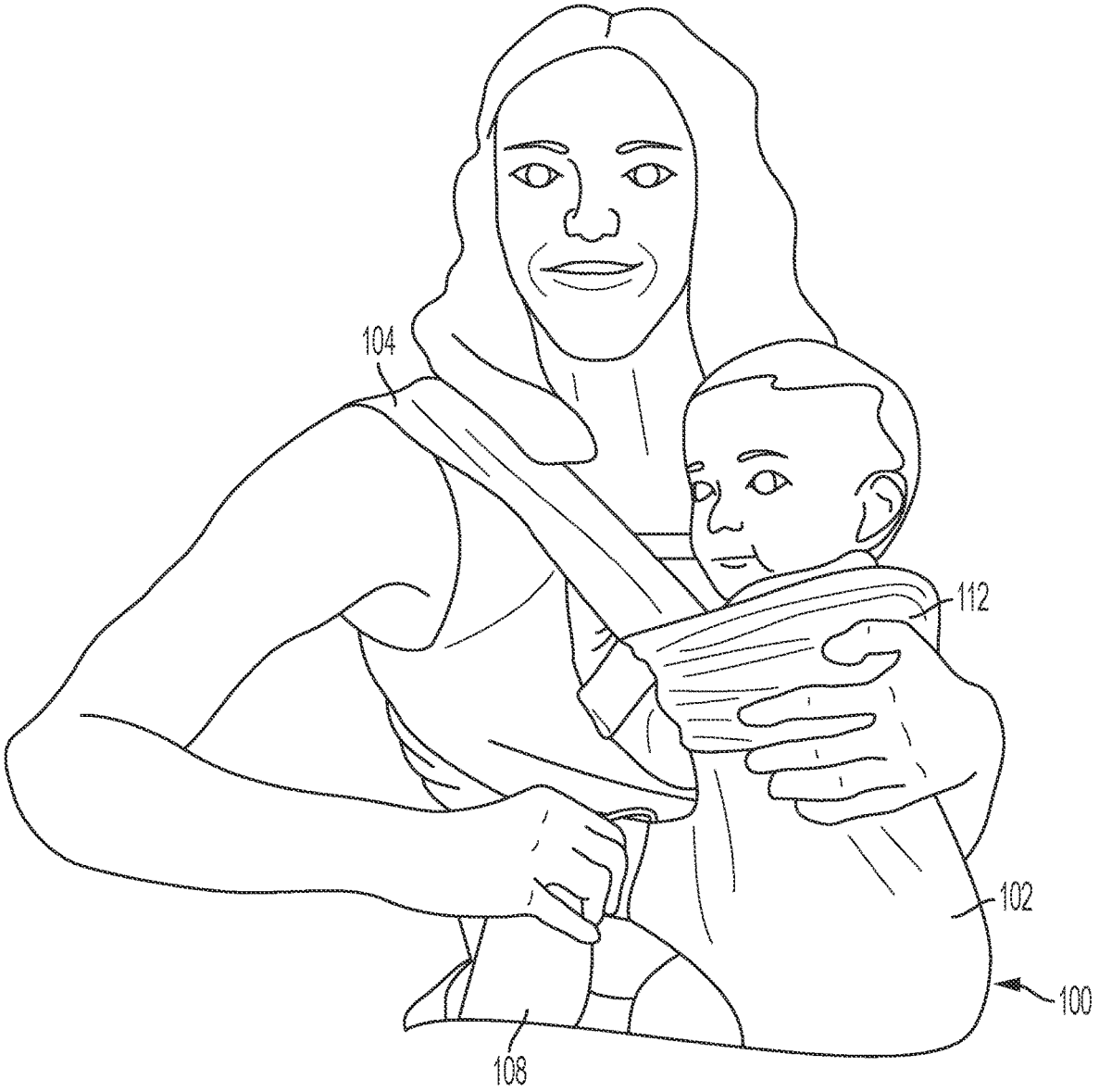
Figure 39C:
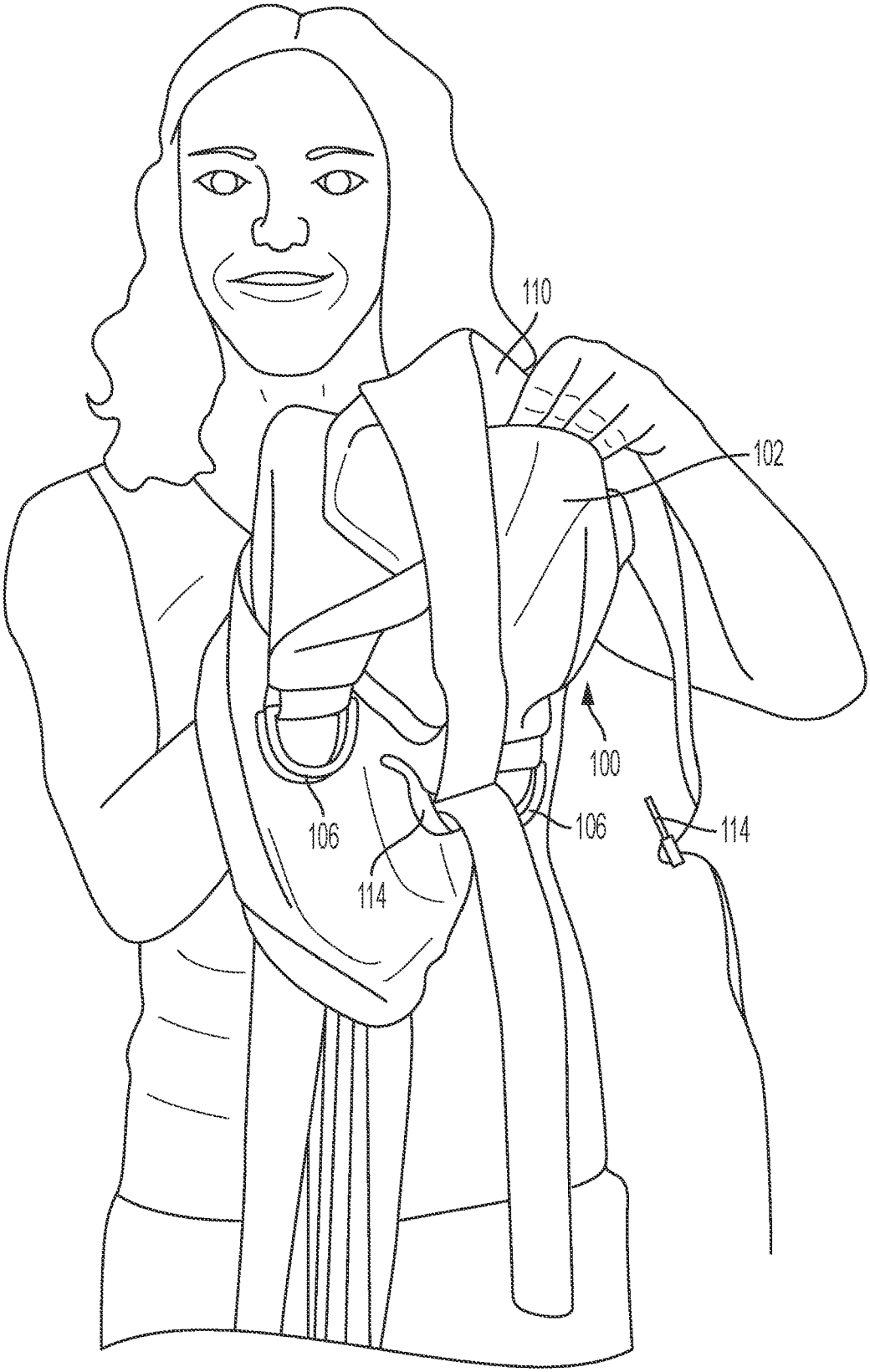
Figure 39D:
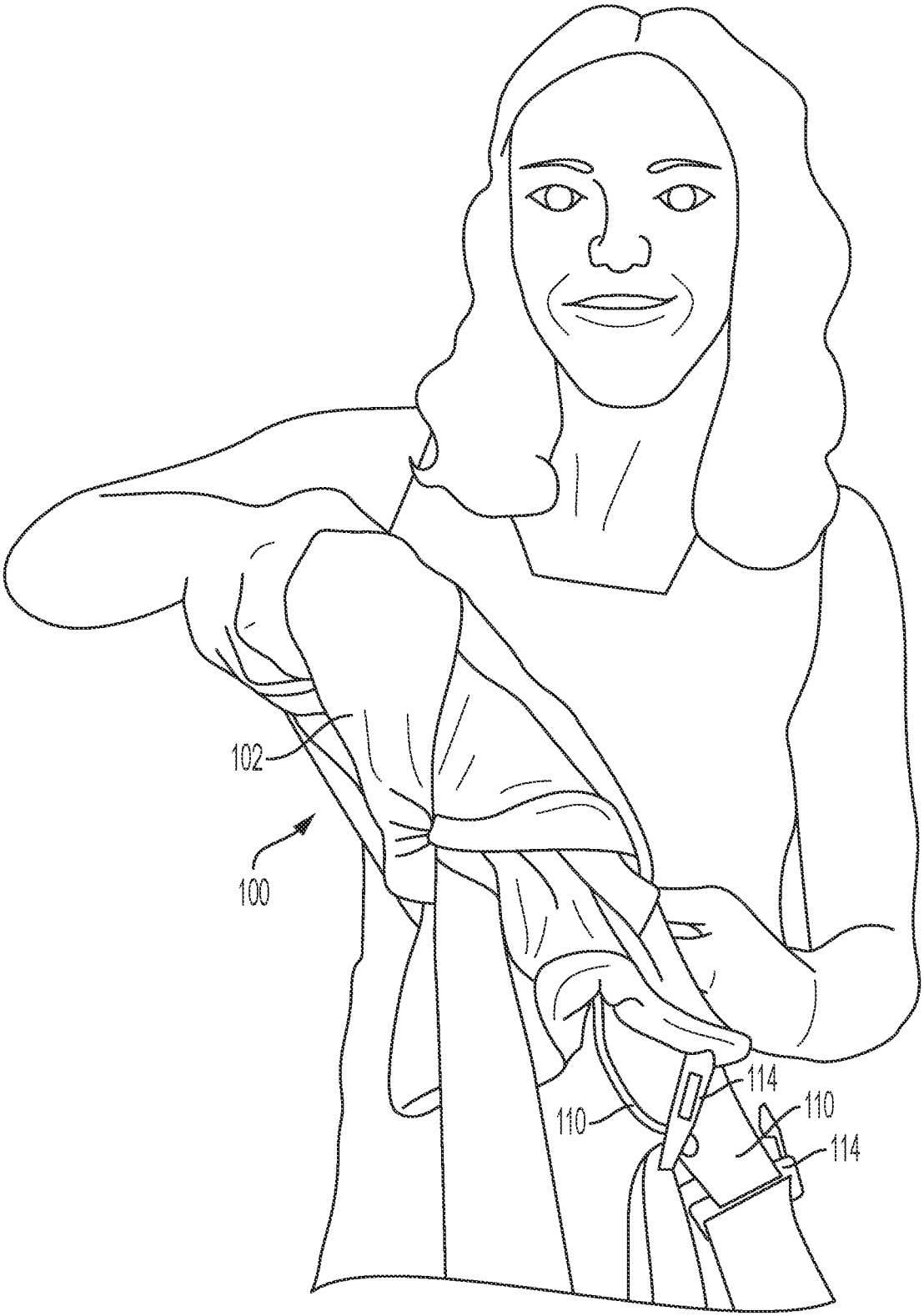
Figure 39E:
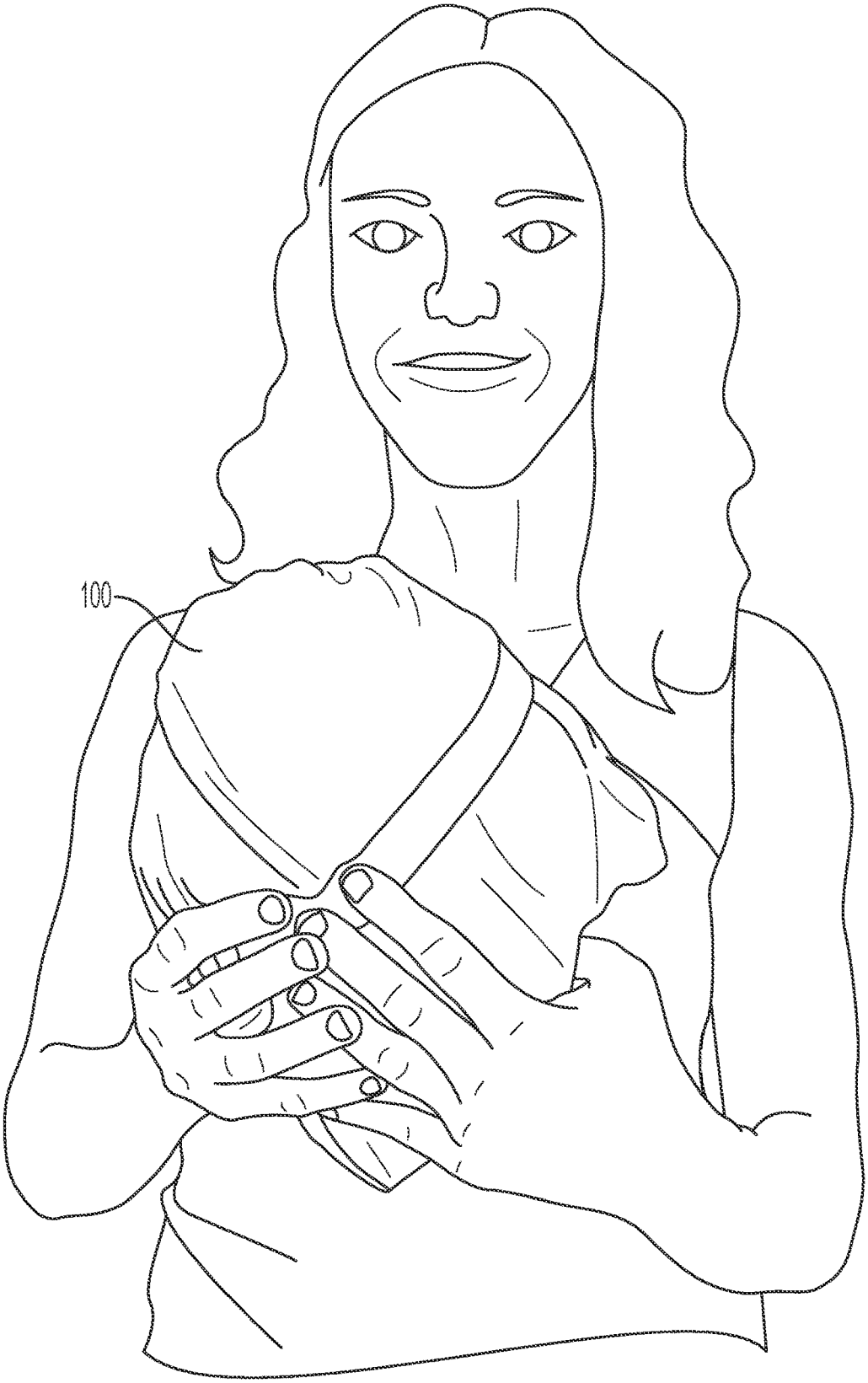

To stow the child carrying system, as shown in FIG. 39C, the user may reach their hand into the carrier portion 102 and grab a hold of the waist belt 110 with their hand. During this motion, the carrier portion 102 serves as a sort of glove for the user's hand as the user grabs hold of the waist belt 110. While continuing to hold the belt, as shown in FIG. 39D, the user pulls their hand back out of the carrier portion 102. This pulls the belt and part of the child carrying system 100 into the carrier portion and frees the user's hand. The user then arranges the remainder of the child carrying system 100 into the pouch until the child carrying system is in a ball as shown in FIG. 39E.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed:

1. A child carrying system configured to be worn by a person to enable the person to carry a child, the child carrying system comprising:

a carrier portion configured to support a child within;

a pair of shoulder straps, each shoulder strap coupled at a first end to the carrier portion proximate to a top corner of the carrier portion and uncoupled at a second end opposite the first end;

an adjustment mechanism coupled to each side of the carrier portion, each adjustment mechanism configured to adjustably engage a particular respective one of the pair of shoulder straps proximate the second end of the particular shoulder strap;

a waist belt coupled to a bottom end of the carrier portion, the waist belt having two opposing ends configured to wrap around the person and secure to one another; and a head support moveably engaged with the pair of shoulder straps and configured to be moveable along the pair of shoulder straps between a lowered configuration and a raised configuration, wherein the head support is configured as a wide loop of material that is looped around the pair of shoulder straps to create a continuous, width-adjustable bridge between the pair of straps.

2. The child carrying system of claim 1, wherein a bottom edge of the head support is secured to a top edge of the carrier portion and the top edge of the head support is unsecured such that the top edge may be pulled away from the carrier portion to transition from the lowered configuration to the raised configuration.

3. The child carrying system of claim 2, wherein the head support comprises an elastic material.

4. The child carrying system of claim 1, wherein the head support comprises a first side slideable along a first shoulder strap and a second side slideable along a second shoulder strap such that the first side is independently configurable between the lowered configuration and the raised configuration and the second side is independently configurable between the lowered configuration and the raised configuration.

5. The child carrying system of claim 1, wherein each adjustment mechanism comprises a pair of D-rings such that the second end of a shoulder strap is threaded through one of the pair of D-rings and pulled to adjust the carrier portion toward the person and loosened to adjust the carrier portion away from the person.

6. The child carrying system of claim 1, wherein each shoulder strap comprises a variable width to allow the shoulder strap to be widened at a location where the shoulder strap traverses the person's shoulder to fully encompass the person's shoulder from a substantially vertical portion of the person's arm to a substantially horizontal portion of the person's shoulder.

7. The child carrying system of claim 6, wherein when the child is secured within the carrier portion, the second end of each shoulder strap extends from the adjustment mechanism having a length that allows the second end to hang below the waist belt.

8. The child carrying system of claim 6, wherein the pair of shoulder straps are configured to crisscross on a back of the person when the child is carried on a front of the person.

9. The child carrying system of claim 6, wherein each shoulder strap is configured to extend downward from a shoulder of the person directly to the adjustment mechanism on a same side of the child carrying system when the child is carried on a back of the person.

10. The child carrying system of claim 1, wherein the child carrying system is configured to allow the person to carry the child on a back of the person and on a front of the person.

11. A child carrying system for supporting a child adjacent the body of a user, the child carrying system comprising:

a waist belt that is adapted to be selectively attached to a waist of the user;

a child carrier portion;

a first adjustment mechanism attached adjacent a first lateral side of the child carrier portion;

a second adjustment mechanism attached adjacent a second lateral side of the child carrier portion;

a first shoulder strap extending from a top of the child carrier portion adjacent the first lateral side; and a second shoulder strap extending from a top of the child carrier portion adjacent the second lateral side, wherein:

the child carrying system is adapted to support a child on a front side of the user's body when: (1) the first shoulder strap is attached to the second adjustment mechanism; (2) the second shoulder strap is attached to the first adjustment mechanism; and (3) the first and second shoulder straps are crossed over each other adjacent the user's back; and the child carrying system is adapted to support a child on a back of the user when: (1) the first shoulder strap is attached to the first adjustment mechanism; and (2) the second shoulder strap is attached to the second adjustment mechanism and a head support moveably engaged with each of the first and second shoulder straps and configured to be moveable along the pair of shoulder straps between a lowered configuration and a raised configuration, wherein the head support is configured as a wide loop of material that is looped around both the first and second shoulder straps to create a continuous, width-adjustable bridge between the pair of straps.

12. The child carrying system of claim 11, wherein the child carrying system is adapted so that, when the child carrying system is being used to support the child on a back of the user, the first and second shoulder straps extend substantially vertically adjacent the front side of the user's body.

13. The child carrying system of claim 11, wherein the child carrying system is adapted so that, when the child carrying system is being used to support the child on a back of the user, a fastener of the waist belt is positioned adjacent the front side of the user's body.

14. The child carrying system of claim 13, wherein the child carrying system is adapted so that, when the child carrying system is being used to support the child on a front of the user, a fastener of the waist belt is positioned adjacent the user's lower back.

15. The child carrying system of claim 11, wherein the child carrying system further comprises a head support that extends between the first and second shoulder straps.

16. The child carrying system of claim 15, wherein:

a first lateral side of the head support is slideably attached to the first shoulder strap so that the first lateral side of the head support may slide along the first shoulder strap between a retracted position to an extended position; and a second lateral side of the head support is slideably attached to the second shoulder strap so that the second lateral side of the head support may slide along the second shoulder strap between a retracted to an extended position.

17. The child carrying system of claim 16, wherein the first lateral side of the head support is adapted to move between the retracted position to the extended position independently of the second lateral side of the head support.

18. The child carrying system of claim 17, wherein the head support is a fabric head support.

19. A method of carrying a child on a user's body comprising:

providing a child carrying system for supporting a child adjacent the body of a user, the child carrying system comprising:

a waist belt that is adapted to be selectively attached to a waist of the user;

a child carrier portion;

a first adjustment mechanism attached adjacent a first lateral side of the child carrier portion;

a second adjustment mechanism attached adjacent a second lateral side of the child carrier portion;

a first shoulder strap extending from a top of the child carrier portion adjacent the first lateral side; and a second shoulder strap extending from a top of the child carrier portion adjacent the second lateral side, wherein:

the child carrying system is adapted to support the child on a front side of the user's body when the child carrying system is in a first orientation in which: (1) the first shoulder strap is attached to the second adjustment mechanism; (2) the second shoulder strap is attached to the first adjustment mechanism; and (3) the first and second shoulder straps are crossed over each other adjacent a back of the user;

the child carrying system is adapted to support the child on the back of the user when the child carrying system is in a second orientation in which: (1) the first shoulder strap is attached to the first adjustment mechanism; and (2) the second shoulder strap is attached to the second adjustment mechanism; and the child carrying system is adapted to support the child on the front side of the user when the child carrying system is in the first orientation and a head support moveably engaged with each of the first and second shoulder straps and configured to be moveable along the pair of shoulder straps between a lowered configuration and a raised configuration, wherein the head support is configured as a wide loop of material that is looped around both the first and second shoulder straps to create a continuous, width-adjustable bridge between the pair of straps.

20. The method of claim 19, further comprising supporting the child on the user's back when the child carrying system is in the second orientation.

* * * * *